US009950842B2

(12) United States Patent
Turvey et al.

(10) Patent No.: US 9,950,842 B2
(45) Date of Patent: Apr. 24, 2018

(54) MULTIPLE ZIPPER SLIDER BAG

(71) Applicant: S.C. Johnson & Son, Inc., Racine, WI (US)

(72) Inventors: Robert R. Turvey, Sanford, MI (US); Lawrence C. Stanos, Midland, MI (US); Bryan L. Ackerman, Freeland, MI (US); Christina J. Korinda, Midland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 79 days.

(21) Appl. No.: 14/744,556

(22) Filed: Jun. 19, 2015

(65) Prior Publication Data

US 2015/0367995 A1 Dec. 24, 2015

Related U.S. Application Data

(60) Provisional application No. 62/014,977, filed on Jun. 20, 2014, provisional application No. 62/014,957, filed on Jun. 20, 2014.

(51) Int. Cl.
*B65D 33/25* (2006.01)
*A44B 19/26* (2006.01)

(52) U.S. Cl.
CPC ..... *B65D 33/2591* (2013.01); *A44B 19/26* (2013.01); *A44B 19/262* (2013.01); *B65D 33/255* (2013.01); *B65D 33/2558* (2013.01); *Y10T 24/158* (2015.01)

(58) Field of Classification Search
CPC ..... B65D 33/25; B65D 33/2533; B65D 33/2541; B65D 33/2516; B65D 33/255; B65D 33/2558; B65D 33/2591; B65D 33/2508; B65D 33/2525; B65D 33/2566; B65D 33/2575; B65D 33/2583; A44B 19/267; A44B 19/265
USPC ..... 383/61.1, 63–65; 24/415, 399, 400
See application file for complete search history.

(56) References Cited

U.S. PATENT DOCUMENTS

| | | | | |
|---|---|---|---|---|
| 3,115,689 A | | 1/1961 | Jacobs | |
| 3,338,285 A | | 8/1967 | Jaster | |
| RE28,969 E | * | 9/1976 | Naito | B65D 33/2541 383/65 |
| 5,070,584 A | * | 12/1991 | Dais | B29C 67/0044 24/400 |

(Continued)

FOREIGN PATENT DOCUMENTS

| | | |
|---|---|---|
| NL | 6413583 | 5/1965 |
| WO | 2006/112035 A1 | 10/2006 |

OTHER PUBLICATIONS

Notification of and International Search Report and Written Opinion dated Nov. 4, 2015, in counterpart International Patent Application No. PCT/US2015/036712.

*Primary Examiner* — Jes F Pascua
*Assistant Examiner* — Nina Attel

(57) ABSTRACT

A storage bag comprising first and second zipper profiles provided adjacent to an opening to the interior of the bag. The first and second zipper profiles are provided with opposing closure elements that respectively interlock with each other. The storage bag further includes first and second isolation sections between the first and second zipper profiles to prevent the opening of the first zipper profile from impacting the opening of the second zipper profile by a slider.

21 Claims, 43 Drawing Sheets

(56) References Cited

U.S. PATENT DOCUMENTS 5,442,837 A * 8/1995 Morgan ..... B65D 33/2591 24/400
5,718,024 A 2/1998 Obbins
5,983,466 A 11/1999 Petkovsek
6,014,795 A 1/2000 McMahon et al.
6,088,887 A 7/2000 Bois
6,112,374 A 9/2000 Van Erden
6,185,796 B1 2/2001 Ausnit
6,220,754 B1 4/2001 Stiglic et al.
6,247,844 B1 6/2001 Tomic et al.
6,257,763 B1 7/2001 Stolmeier et al.
6,306,071 B1 10/2001 Tomic
6,461,042 B1 10/2002 Tomic et al.
6,595,689 B1 7/2003 Borchardt et al.
6,739,755 B2 5/2004 Schreiter
6,854,887 B2 2/2005 Anderson
6,915,546 B2 * 7/2005 Kasai ..... B65D 33/2591 24/30.5 R
6,948,848 B2 9/2005 Ausnit
6,951,421 B2 10/2005 Crunkleton et al.
7,017,240 B2 3/2006 Savicki
7,036,987 B2 5/2006 Crunkleton et al.
7,137,736 B2 11/2006 Pawloski et al.
7,165,292 B2 1/2007 Kasai
7,269,883 B2 9/2007 Savicki
7,410,298 B2 8/2008 Pawloski
7,461,434 B2 12/2008 Ackerman
7,496,992 B2 3/2009 Ausnit
7,574,781 B2 8/2009 Ackerman et al.
7,574,782 B2 8/2009 Ackerman
7,670,051 B2 3/2010 Chaturvedi
7,850,368 B2 12/2010 Pawloski et al.
8,075,187 B2 * 12/2011 Bois ..... B65D 33/2591 24/399
8,256,959 B2 * 9/2012 Hui ..... B65D 33/2591 383/59
8,523,438 B2 9/2013 Roger
8,926,179 B2 1/2015 Ackerman
2003/0077009 A1 * 4/2003 Schreiter ..... B65D 33/2591 383/64
2004/0045138 A1 * 3/2004 Kasai ..... B65D 33/2591 24/399
2004/0234172 A1 * 11/2004 Pawloski ..... B65D 33/2541 383/61.2
2005/0220372 A1 * 10/2005 Withers ..... B65D 33/2591 383/64
2005/0271308 A1 * 12/2005 Pawloski ..... B65D 33/2508 383/63
2006/0210201 A1 9/2006 Ackerman et al.
2006/0282996 A1 12/2006 Ackerman et al.
2007/0180668 A1 8/2007 Ackerman et al.
2011/0311167 A1 12/2011 Hall
2012/0027322 A1 * 2/2012 Ackerman ..... A44B 19/16 383/64
2014/0119678 A1 * 5/2014 Ausnit ..... B65D 33/2591 383/64

* cited by examiner

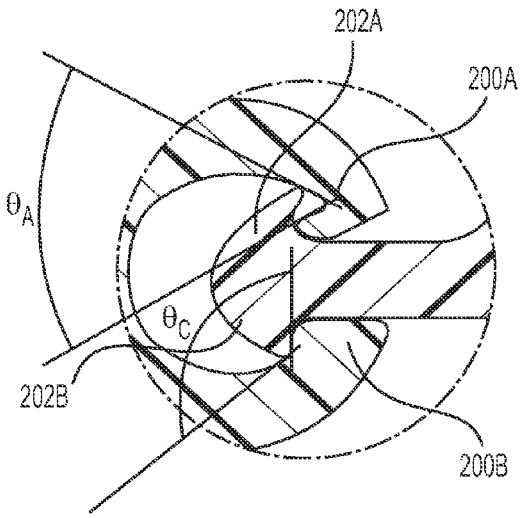
FIG. 3B1
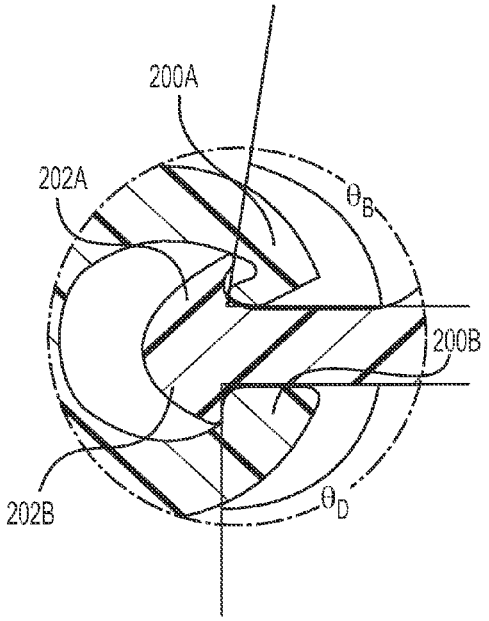
FIG. 3B2
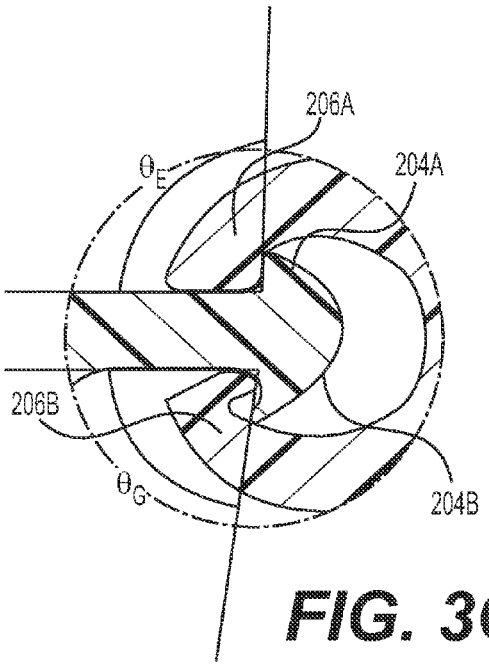
FIG. 3C1
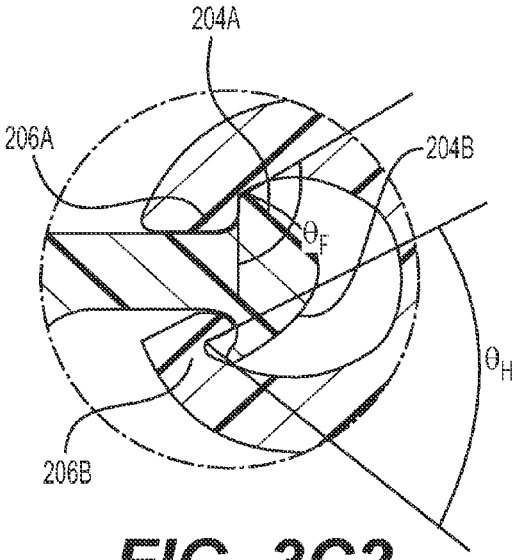
FIG. 3C2

MULTIPLE ZIPPER SLIDER BAG

This application claims the benefit of priority of U.S. Provisional Patent Application No. 62/014,957, filed Jun. 20, 2014, and U.S. Provisional Patent Application No. 62/014,977, filed Jun. 20, 2014.

BACKGROUND

Field of the Invention

Our invention relates generally to closure assemblies. More specifically, our invention relates to closure assemblies comprising at least two pairs of interlocking profiles, as well as a slider for opening and closing the interlocking profiles. The closure assemblies of our invention are often disposed on, for example, pouches, such as resealable thermoplastic storage bags.

Related Art

Storage bags made from flexible plastic materials are well known. Such storage bags are made in a variety of sizes, and can be used to contain a variety of items, including food, utensils, clothing, tools, etc. Such storage bags often include some type of zipper-like closure mechanism to resealably seal the interior of the bag. Plastic storage bags with closure mechanisms are sold by the assignee of the present application under the ZIPLOC® trademark.

The closure mechanisms of plastic storage bags, which are often referred to as a fastener assembly or a zipper, include interlocking closure profiles at a top end of the bag. Closure mechanisms having a single pair of opposing elongate interlocking profiles that are occluded between a user's fingers to create a resealable seal are well known. In addition, closure mechanisms having multiple pairs of elongate interlocking profiles, for example, opposing upper and lower interlocking profiles that are pressed together by the user's fingers, are also used to create a stronger and more secure seal than single pairs. It is also known to use sliders with closure assemblies that have single and multiple interlocking profile pairs to open and to close the seal.

In one instance, a seal assembly is sealed and unsealed by occluding and de-occluding the interlocking profiles in a pinch and seal manner by the user's fingers. A user seals the bag by pressing together the interlocking profiles with his/her fingers and unseals the bag by pulling the profiles apart with his/her fingers. The seal assembly has a first closure strip disposed on one bag wall and a second strip disposed on an opposing bag wall. Each of the first and second closure strips includes two parallel spaced apart interlocking profiles disposed between two bumper profiles, all of which extend from the same side of a backing flange. In addition, one of the closure strips has a central profile disposed between the two interlocking profiles.

In another instance, a bag has a slider attached to a seal assembly that has two pairs of interlocking profiles to easily occlude and de-occlude the seals. The slider has a top wall attached to two opposing sidewalls, such that the two opposing sidewalls occlude both pairs of interlocking profiles when the slider is slid in a closing direction along the seal assembly. The slider also has a separator finger, or plow, that extends downwardly between both pairs of interlocking profiles that de-occludes both pairs of interlocking profiles when the slider is slid in an opening direction along the seal assembly. However, extending the plow all the way through the opposing interlocking profiles can create a gap or opening around the plow even when the slider is all the way in a closed position on the seal assembly, which results in a non-continuous seal that may cause leaking of liquid, air, gas, or granular contents held inside the bag.

SUMMARY OF THE INVENTION

According to one aspect, our invention provides a storage bag with a first sidewall and a second sidewall connected to the first sidewall so as to form an interior of the bag with an opening to the interior. The storage bag includes a first zipper profile positioned adjacent to the opening of the bag and a second zipper profile positioned underneath the first zipper profile. The first zipper profile comprises a first closure element attached to the first sidewall and a second closure element attached to the second sidewall and extending substantially parallel to the first closure element. The first closure element and the second closure element both extend along the length of the first zipper profile between a first side of the first zipper profile and a second side of the first zipper profile. The first closure element is configured to interlock with the second closure element to form a seal for the opening of the bag. The second zipper profile comprises a third closure element attached to the first sidewall and a fourth closure element attached to the second sidewall and extending substantially parallel to the third closure element. The third closure element and the fourth closure element both extend along the length of the second zipper profile between a first side of the second zipper profile and a second side of the second zipper profile. The third closure element is configured to interlock with the fourth closure element to form a second seal for the opening of the bag. A first isolation section is positioned between the first closure element and the third closure element, and a second isolation section is positioned between the second closure element and the fourth closure element. A slider is positioned in a straddling relation with the first zipper profile and the second zipper profile. The slider comprises at least a first opening member that is disposed between the first isolation section and the second isolation section. The slider is configured to slide along the first and second zipper profiles to occlude the first and second closure elements of the first zipper profile and the third and fourth closure elements of the second zipper profile when the slider is slid in a first direction. The slider is further configured to de-occlude the first and second closure elements of the first zipper profile and the third and fourth closure elements of the second zipper profile when the slider is slid in a second direction. The de-occluding of the first and second closure elements of the first zipper profile, however, does not impact the de-occluding of the third and fourth closure elements of the second zipper profile due to the inclusion of the first isolation section and the second isolation section.

According to another aspect of our invention, a storage bag is provided with a first sidewall, a second sidewall connected to the first sidewall so as to form an interior of the bag with an opening to the interior, and a first film layer attached to the first sidewall. The storage bag includes a first zipper profile positioned adjacent to the opening of the bag and a second zipper profile positioned underneath the first zipper profile. The first zipper profile comprises a first closure element attached to the first film layer, and a second closure element attached to the second sidewall and extending substantially parallel to the first closure element. The first closure element and the second closure element both extend along the length of the first zipper profile between a first side of the first zipper profile and a second side of the first zipper profile. The first closure element is configured to interlock with the second closure element to form a seal for the opening of the bag. The second zipper profile comprises a third closure element attached to the first film layer and a fourth closure element attached to the second sidewall and extending substantially parallel to the third closure element. The third closure element and the fourth closure element both extend along the length of the second zipper profile between a first side of the second zipper profile and a second side of the second zipper profile. The third closure element is configured to interlock with the fourth closure element to form a second seal for the opening of the bag. At least one of the first zipper profile and the second zipper profile is attached to the first sidewall, and at least one of the first zipper profile and the second zipper profile is attached to the second sidewall. A first isolation section is positioned between the first closure element and the third closure element, and a second isolation section is positioned between the second closure element and the fourth closure element. De-occluding the first and second closure elements of the first zipper profile, however, does not impact de-occluding the third and fourth closure elements of the second zipper profile due to the inclusion of the first isolation section and the second isolation section.

According to yet another aspect of our invention, our invention provides a storage bag with a first sidewall and a second sidewall connected to the first sidewall so as to form an interior of the bag with an opening to the interior. The storage bag includes a first zipper profile positioned adjacent to the opening of the bag and a second zipper profile positioned underneath the first zipper profile. The first zipper profile comprises a first closure element attached to the first sidewall and a second closure element attached to the second sidewall and extending substantially parallel to the first closure element. The first closure element and the second closure element both extend along the length of the first zipper profile between a first side of the first zipper profile and a second side of the first zipper profile. The first closure element is configured to interlock with the second closure element to form a seal for the opening of the bag. The second zipper profile comprises a third closure element attached to the first sidewall and a fourth closure element attached to the second sidewall and extending substantially parallel to the third closure element. The third closure element and the fourth closure element both extend along the length of the second zipper profile between a first side of the second zipper profile and a second side of the second zipper profile. The third closure element is configured to interlock with the fourth closure element to form a second seal for the opening of the bag. A first isolation section is positioned between the first closure element and the third closure element, and a second isolation section is positioned between the second closure element and the fourth closure element. A slider is positioned in a straddling relation with the first zipper profile and the second zipper profile. The slider comprises a top wall and a pair of opposing sidewalls attached to the top wall. The slider further comprises a first zipper profile opening member and a support member that both extend from the top wall of the slider, the support member including a second zipper profile opening member that is disposed between the first isolation section and the second isolation section. The slider is configured to slide along the first and second zipper profiles to occlude the first and second closure elements of the first zipper profile and the third and fourth closure elements of the second zipper profile when the slider is slid in a first direction. The slider is further configured to de-occlude the first and second closure elements of the first zipper profile and the third and fourth closure elements of the second zipper profile when the slider is slid in a second direction. The de-occluding of the first and second closure elements of the first zipper profile, however, does not impact the de-occluding of the third and fourth closure elements of the second zipper profile due to the inclusion of the first isolation section and the second isolation section.

Other aspects and advantages of the present invention will become apparent upon consideration of the following detailed description.

BRIEF DESCRIPTION OF THE DRAWINGS

FIG. 3B1 is an enlarged partial cross-sectional view of the upper zipper profile of the elongate double zipper profile of FIG. 3A in an occluded position.

FIG. 3B2 is an enlarged partial cross-sectional view of the upper zipper profile of the elongate double zipper profile of FIG. 3A in an occluded position.

FIG. 3C1 is an enlarged partial cross-sectional view of the lower zipper profile of the elongate double zipper profile of FIG. 3A in an occluded position.

FIG. 3C2 is an enlarged partial cross-sectional view of the lower zipper profile of the elongate double zipper profile of FIG. 3A in an occluded position.

Figure 3A:
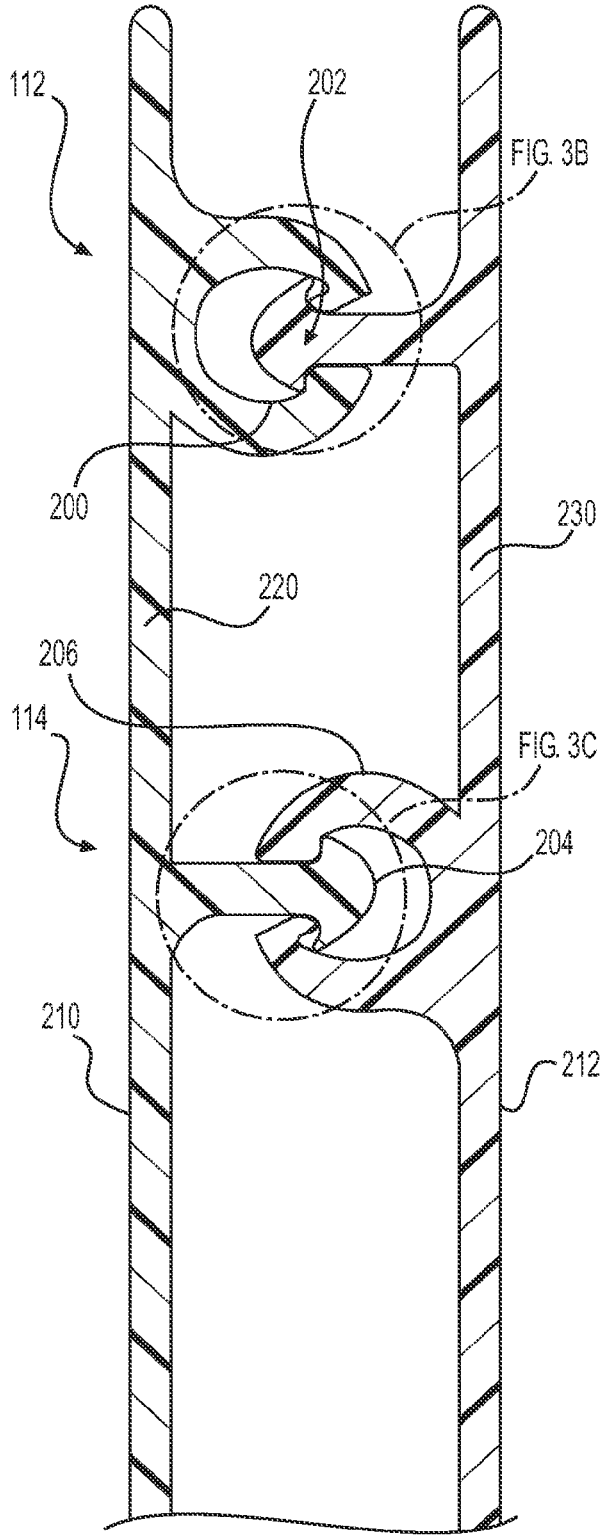
FIG. 3A is a partial cross-sectional view taken along line 3A-3A of FIG. 1 of an embodiment of an elongate double zipper profile in an occluded position with portions behind the plane of the cross section omitted for clarity.

5A with the downward bias de-occluding both the upper and lower zipper profiles shown in FIG. 3A.

Figure 1:
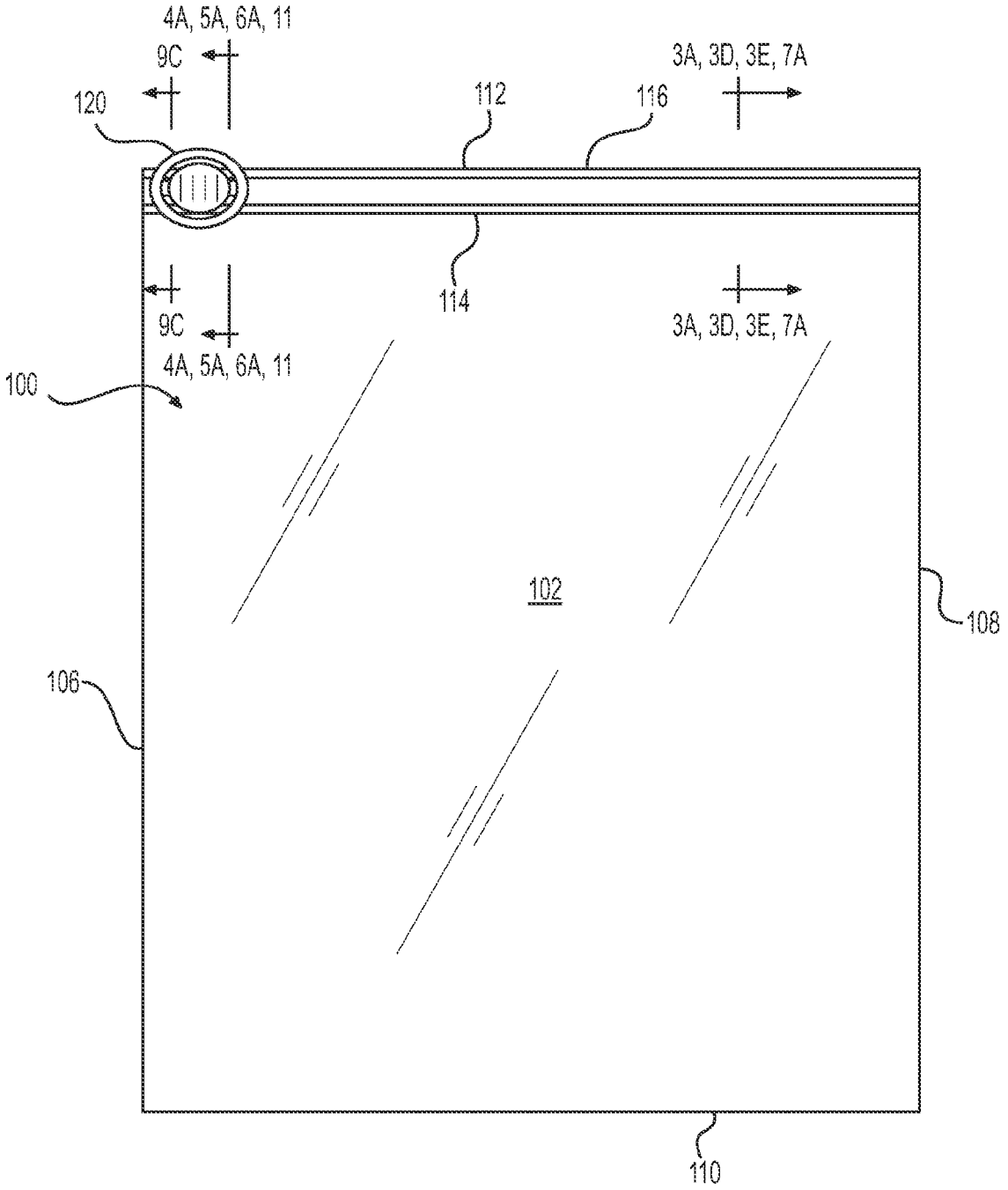
FIG. 1 is a side view of a closed bag according to an embodiment of the invention, with a slider positioned at the closed end of the bag (in this embodiment, the opening direction of the bag is from left to right, and the closing direction of the bag is from right to left).
Figure 4B:
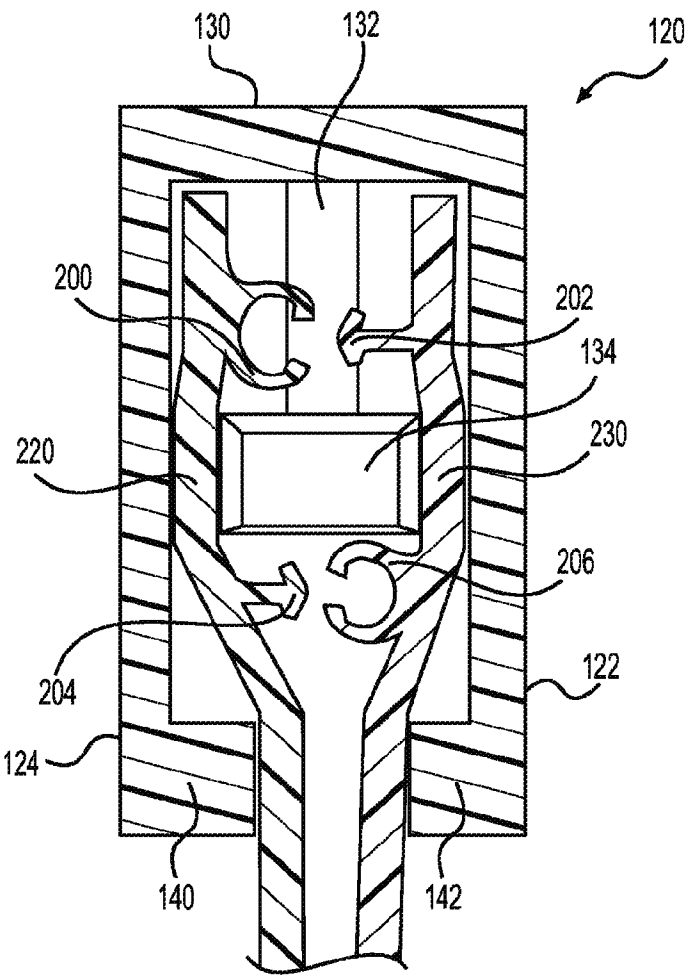
FIG. 4B is a partial cross-sectional view taken along line 4B-4B of FIG. 2 of the elongate double zipper profile of FIG. 3A showing an embodiment of a separator finger of the slider of FIG. 4A de-occluding the double zipper profile of FIG. 3A.
Figure 4A:
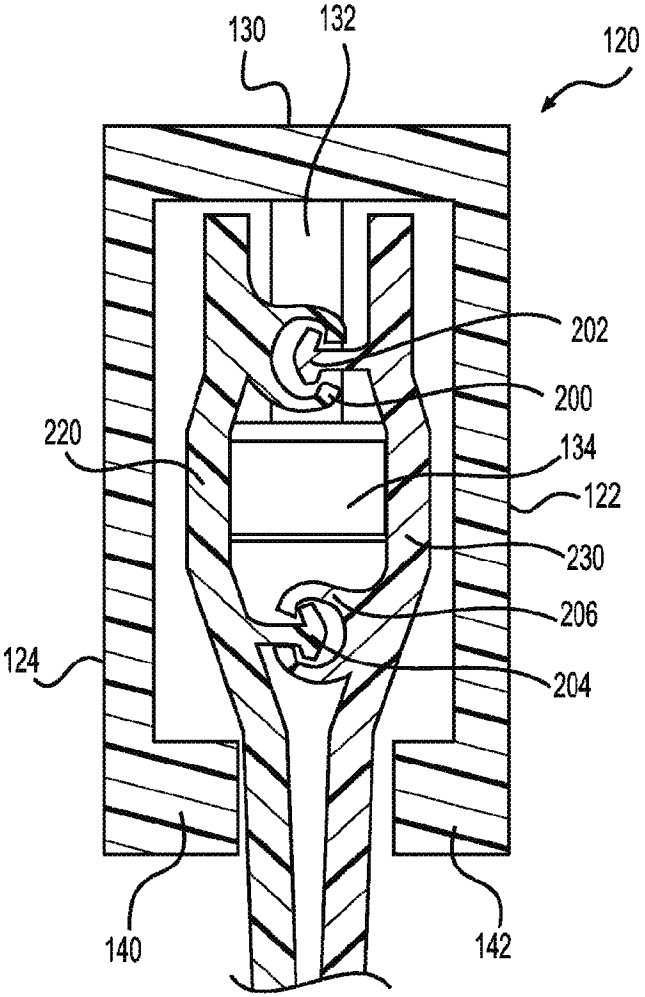
FIG. 4A is a partial cross-sectional view taken along line 4A-4A of FIG. 1 of the elongate double zipper profile of FIG. 3A showing a closing end of an embodiment of a slider when operatively engaged on the double zipper profile of FIG. 3A with portions behind the plane of the cross section omitted for clarity.
Figure 6C:
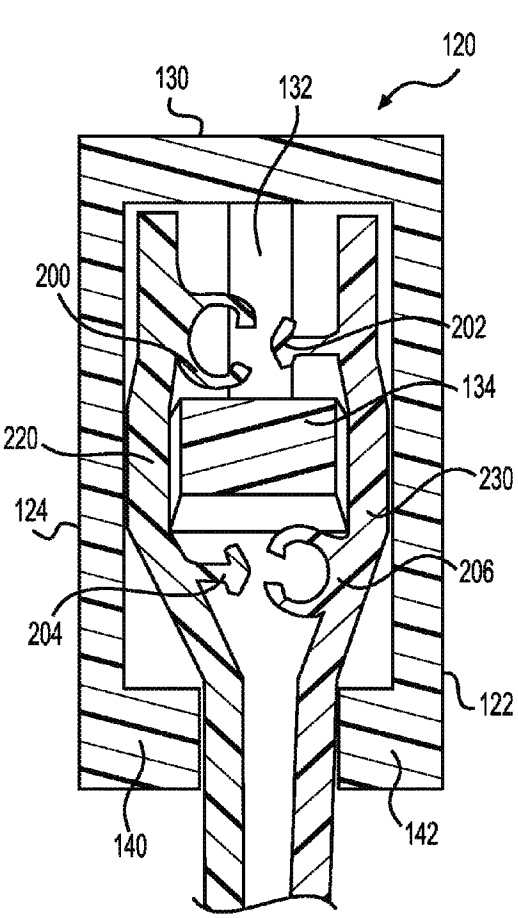
Figure 6B:
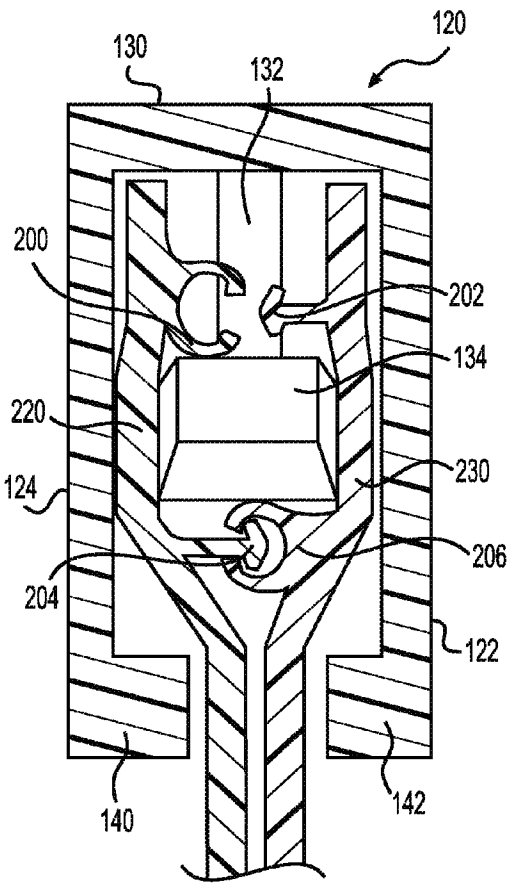
Figure 6A:
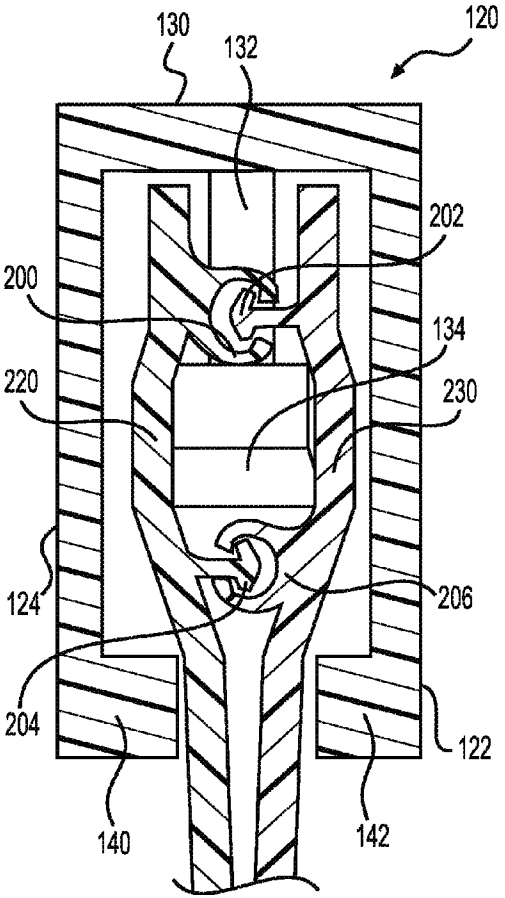

FIG. 6A is a partial cross-sectional view taken along line 6A-6A of FIG. 1 of the elongate double zipper profile of FIG. 3A showing an embodiment of a separator finger of the slider of FIG. 4A with an upward bias.

Figure 2:
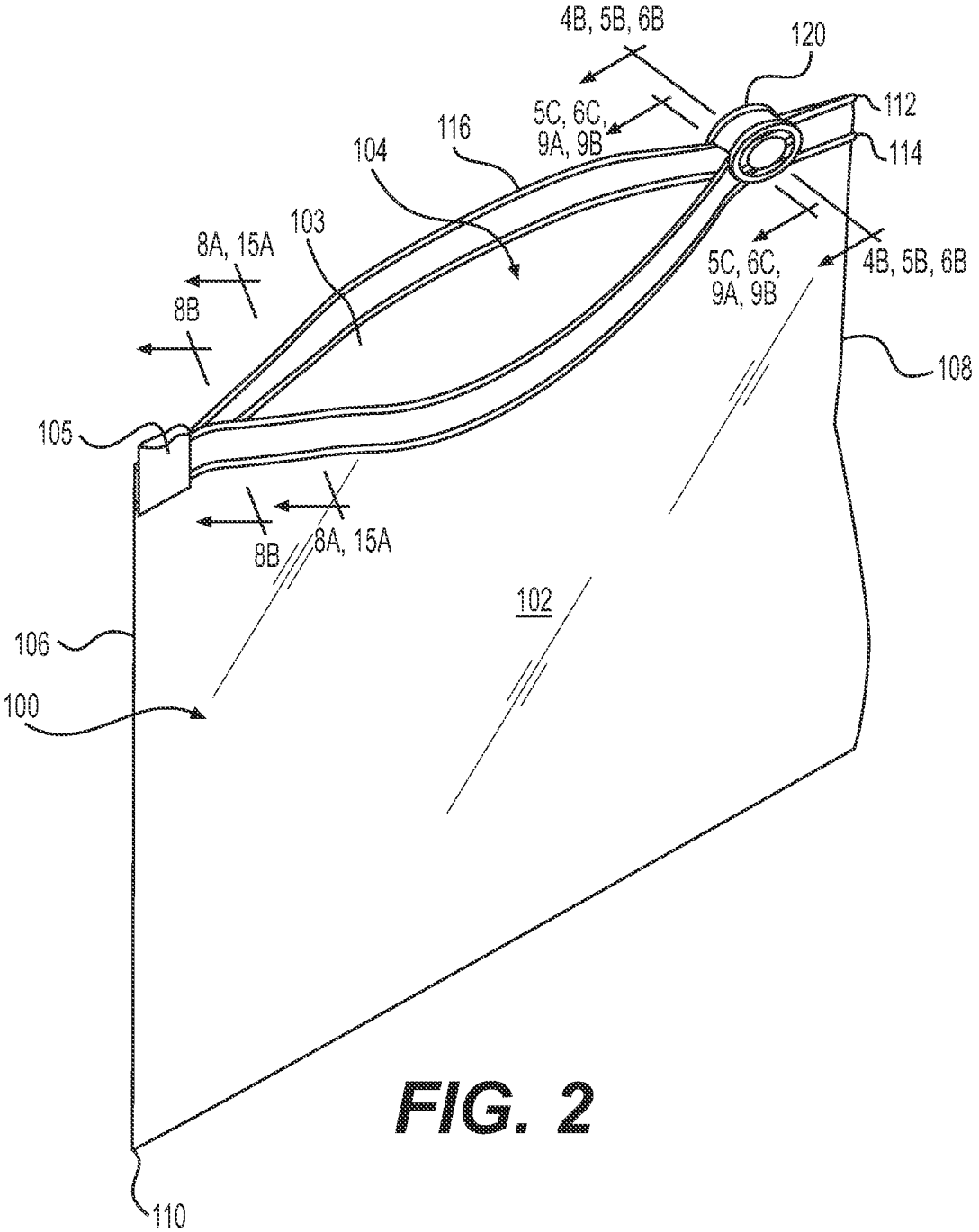
FIG. 2 is a top perspective view of the bag shown in FIG. 1, with the bag now open and the addition of an end stop.

FIG. 6B is a partial cross-sectional view taken along line 6B-6B of FIG. 2 of the elongate double zipper profile of FIG. 3A showing the separator finger of the slider of FIG. 6A with the upward bias, such that the upper zipper profile of the double zipper profile of FIG. 3A is de-occluded first.

FIG. 6C is a partial cross-sectional view taken along line 6C-6C of FIG. 2 of the elongate double zipper profile of FIG. 3A showing the separator finger of the slider of FIG. 6A with the upward bias de-occluding both the upper and lower zipper profiles shown in FIG. 3A.

Figure 7A:
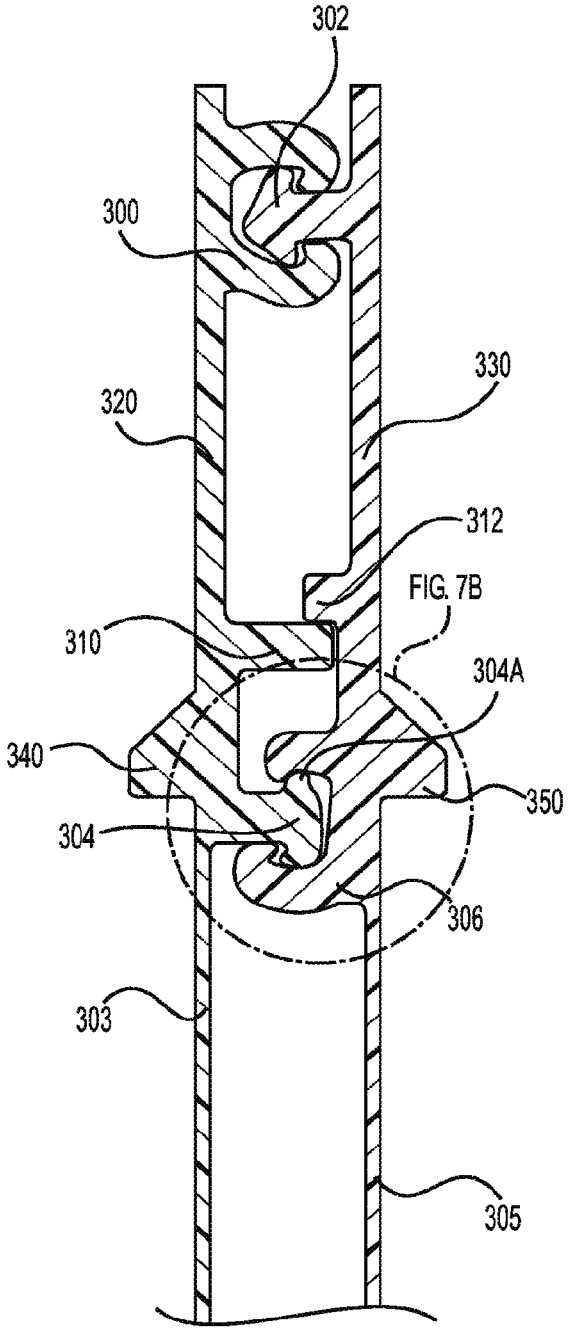

FIG. 7A is a partial cross-sectional view taken along line 7A-7A of FIG. 1 of another embodiment of an elongate double zipper profile in an occluded position with portions behind the plane of the cross section omitted for clarity.

Figure 7B:
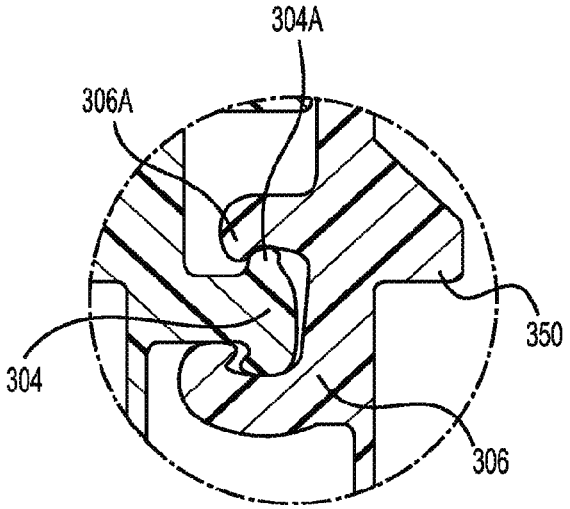

FIG. 7B is an enlarged partial cross-sectional view of the lower zipper profile of the elongate double zipper profile of FIG. 7A in an occluded position.

Figure 8A:
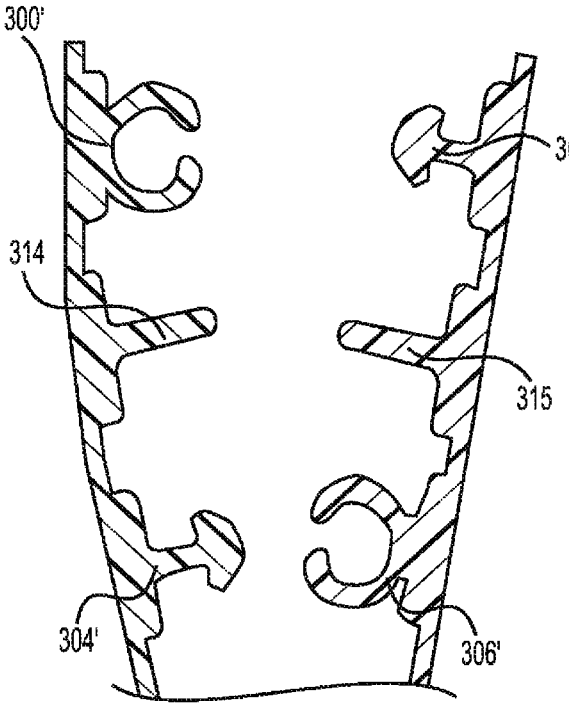

FIG. 8A is a partial cross-sectional view taken along line 8A-8A of FIG. 2 of another embodiment of an elongate double zipper profile with profile ribs in a de-occluded position.

Figure 8B:
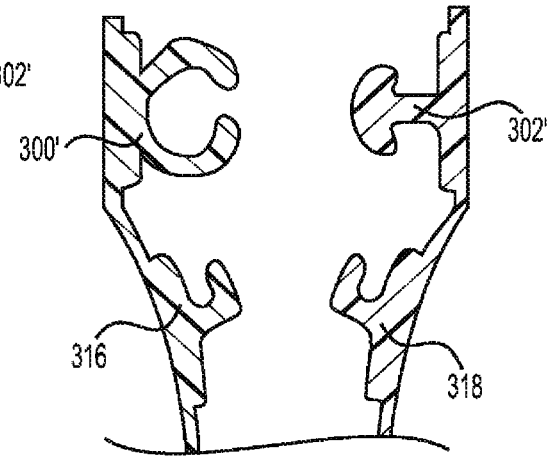

FIG. 8B is a partial cross-sectional view taken along line 8B-8B of FIG. 2 of the closing end of the elongate double zipper profile of FIG. 8A with deformed profile ribs.

Figure 9A:
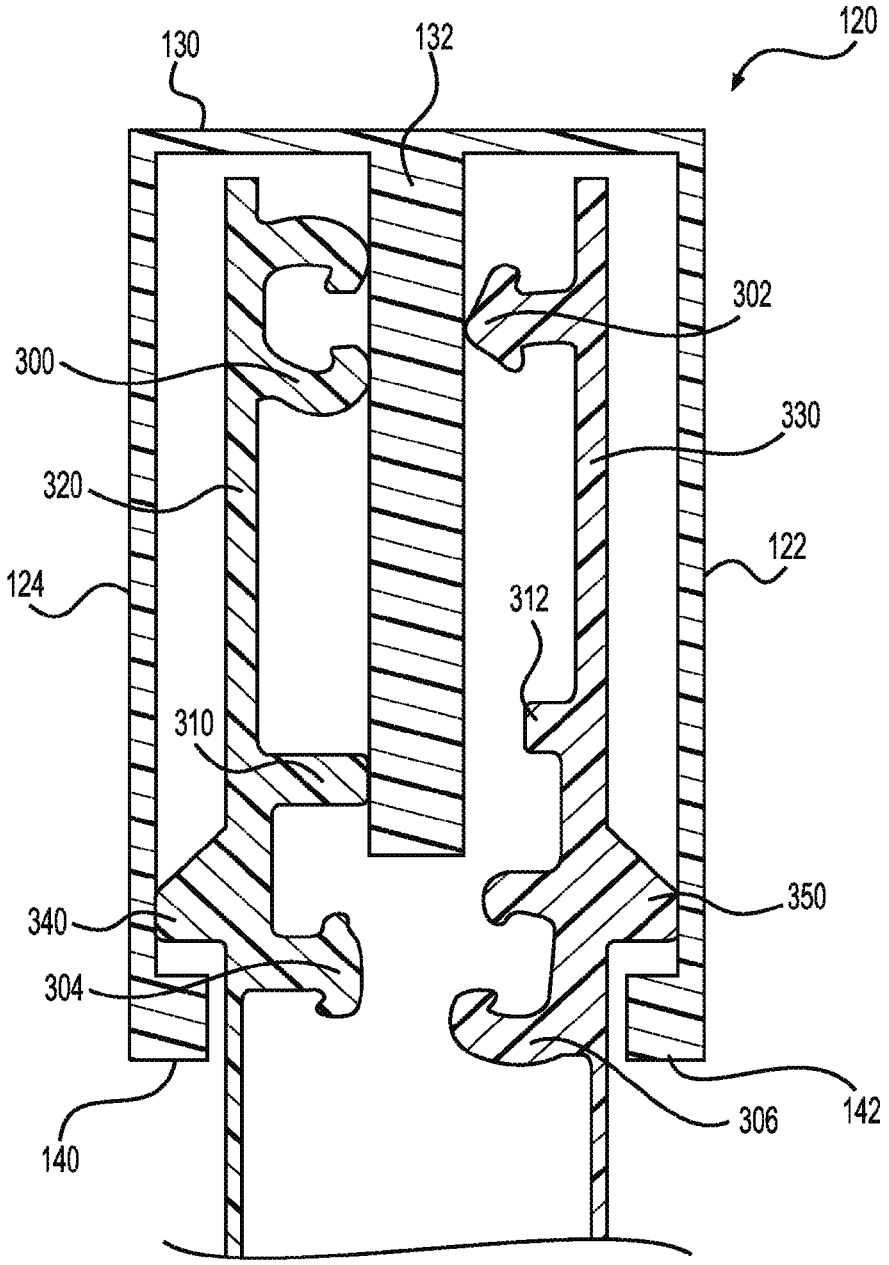

FIG. 9A is an enlarged partial cross-sectional view taken along line 9A-9A of FIG. 2 of the elongate double zipper profile of FIG. 7A showing an embodiment of a slider with a separator finger de-occluding the double zipper profile shown in FIG. 7A, with portions behind the plane of the cross section omitted for clarity.

Figure 9B:
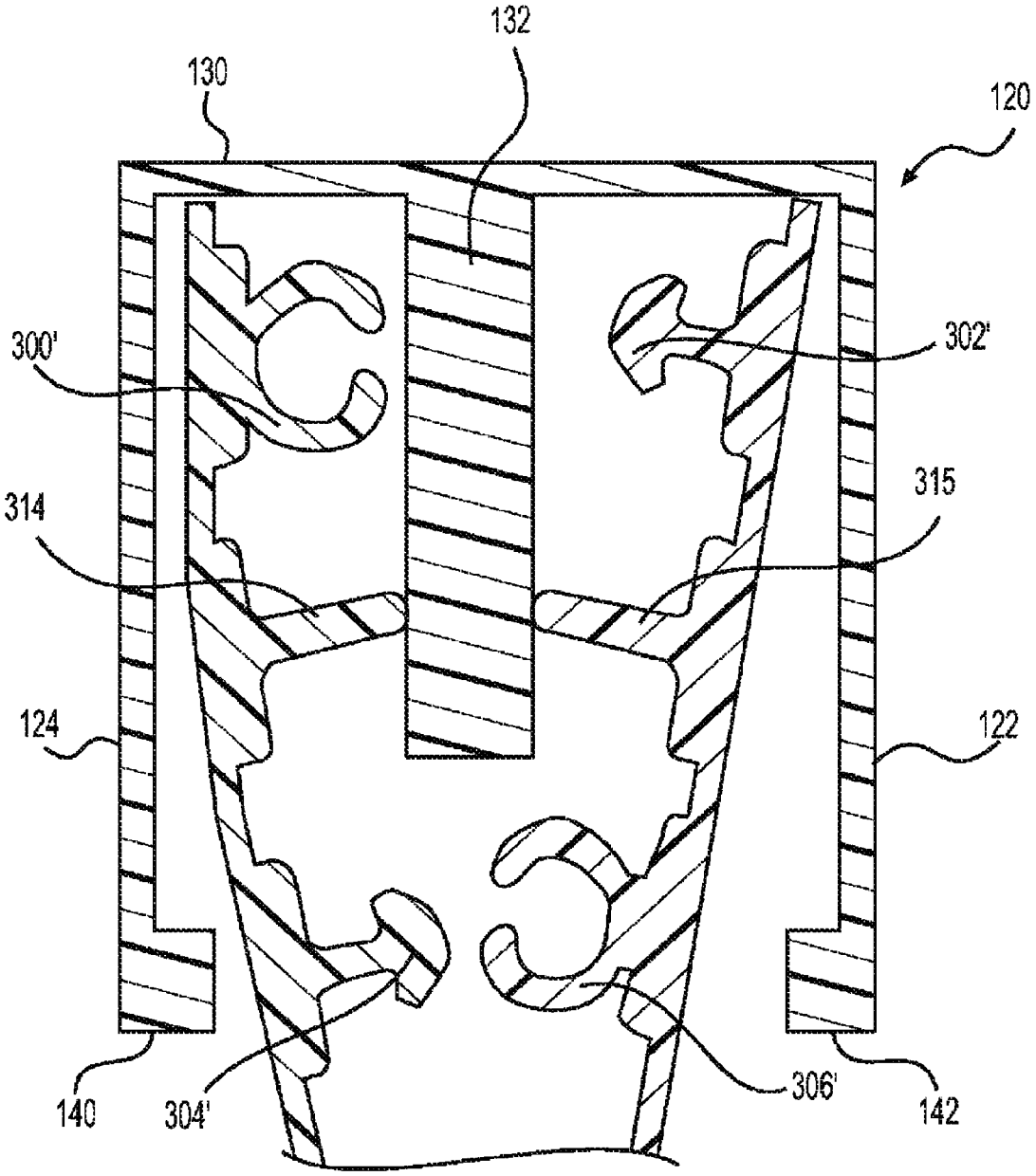

FIG. 9B is an enlarged partial cross-sectional view taken along line 9B-9B of FIG. 2 of the elongate double zipper profile of FIG. 8A showing an embodiment of the separator finger of the slider of FIG. 9A de-occluding the double zipper profile shown in FIG. 8A.

Figure 9C:
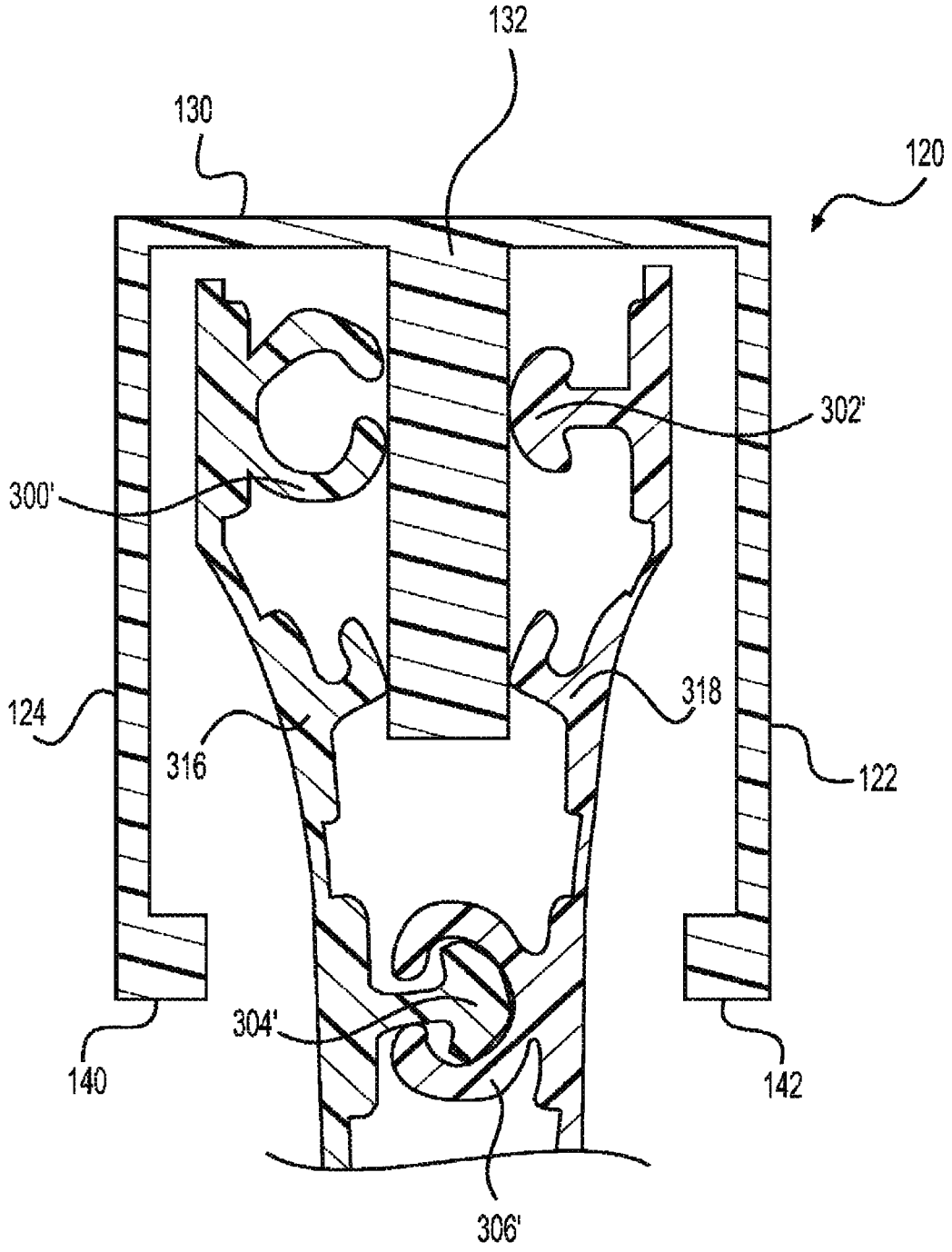

FIG. 9C is an enlarged partial cross-sectional view taken along line 9C-9C of FIG. 1 of the elongate double zipper profile of FIG. 8B showing an embodiment of the slider of FIG. 9A in a closed position on the double zipper profile of FIG. 8B.

Figure 10A:
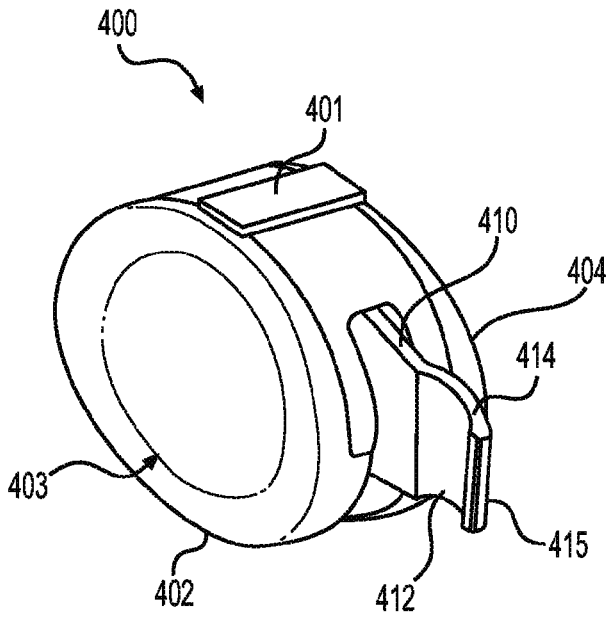

FIG. 10A is a top perspective view of one embodiment of a slider with a separator finger according to the present invention.

Figure 10B:
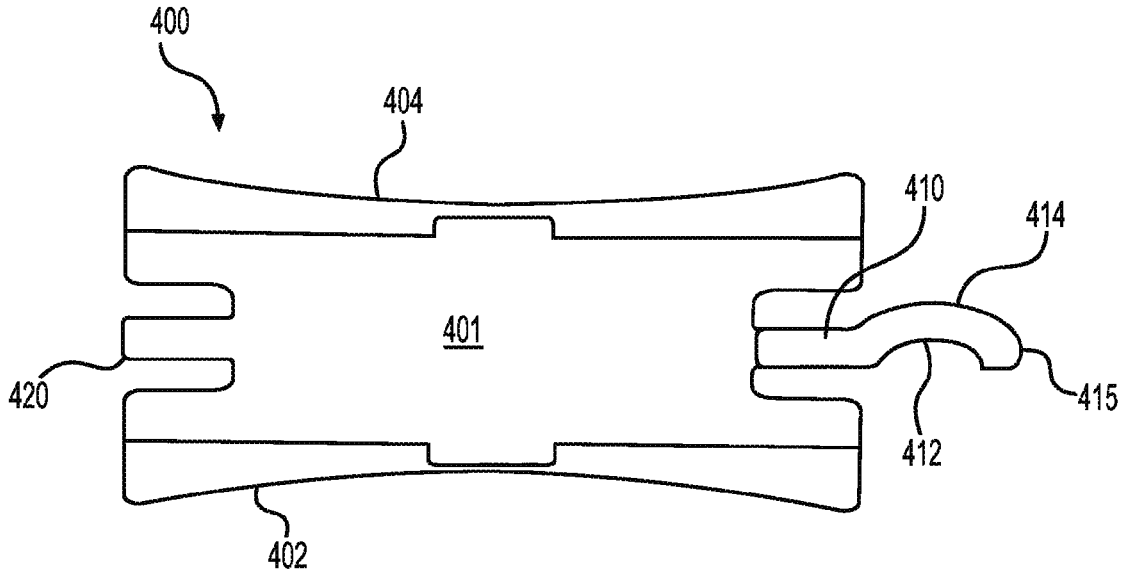

FIG. 10B is a top view of the slider illustrated in FIG. 10A.

Figure 10C:
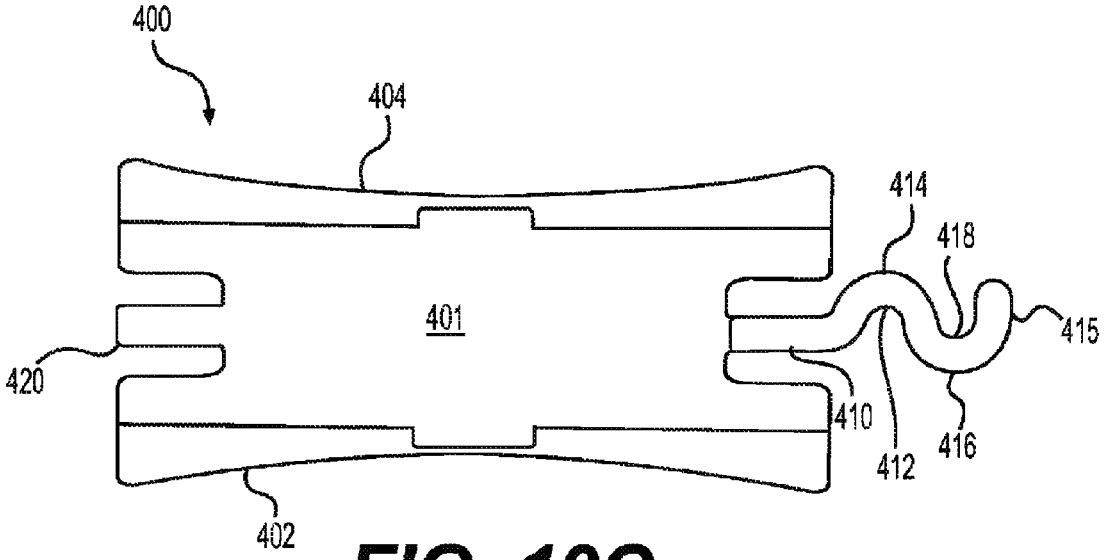

FIG. 10C is a top view of the slider illustrated in FIG. 10A with another embodiment of a separator finger.

Figure 10D:
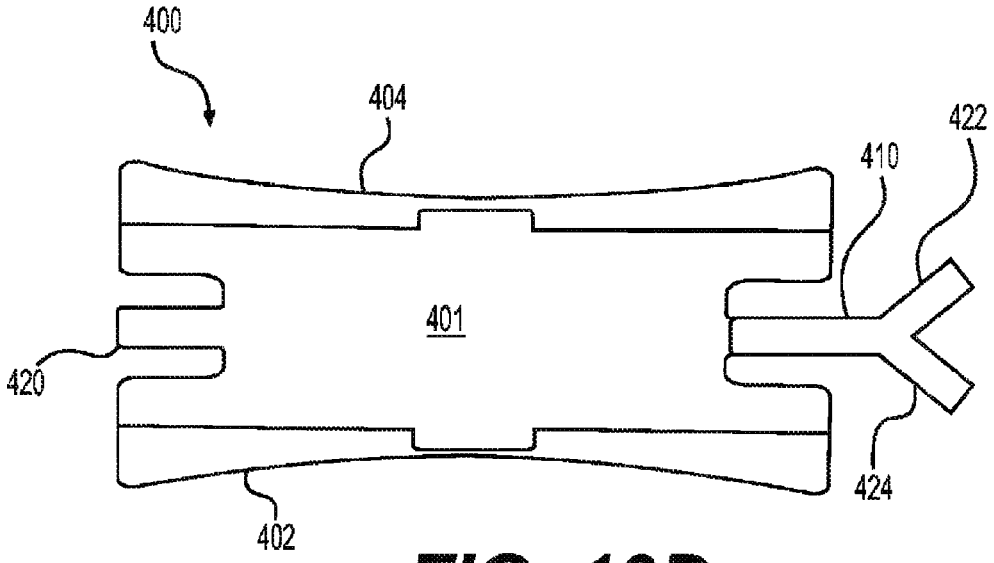

FIG. 10D is a top view of the slider illustrated in FIG. 10A with another embodiment of a separator finger.

Figure 10E:
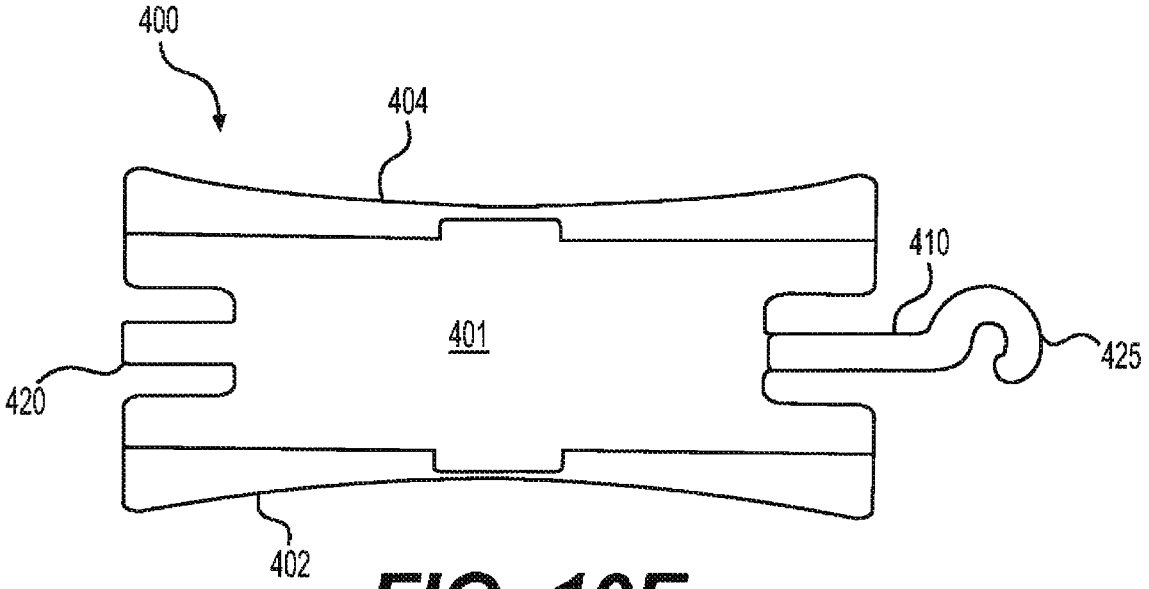

FIG. 10E is a top view of the slider illustrated in FIG. 10A with another embodiment of a separator finger.

Figure 11:
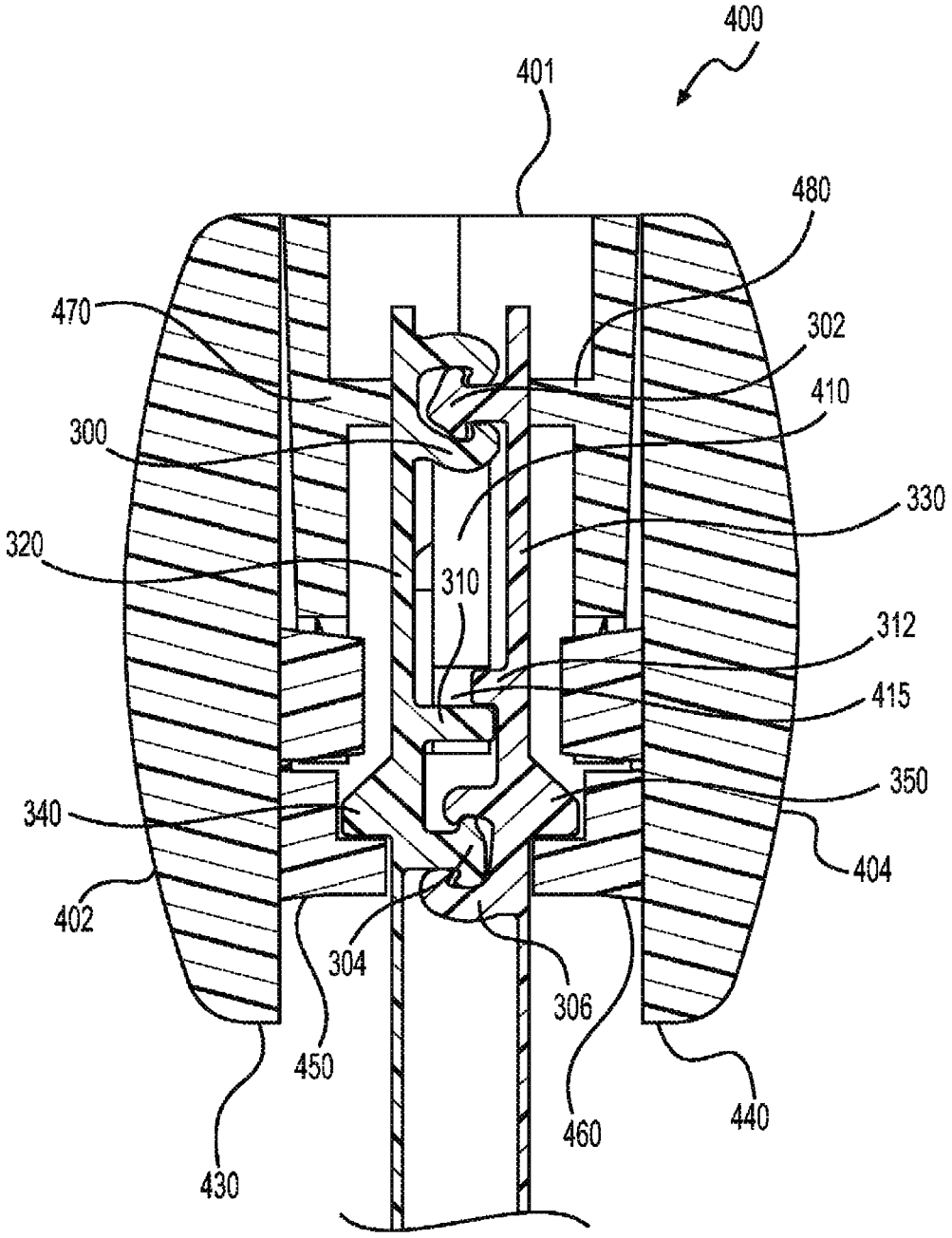

FIG. 11 is an enlarged partial cross-sectional view taken along line 11-11 of FIG. 1 of the elongate double zipper profile of FIG. 7A showing the slider of FIG. 10A operatively engaged on the double zipper profile of FIG. 7A with portions behind the plane of the cross section omitted for clarity.

Figure 12:
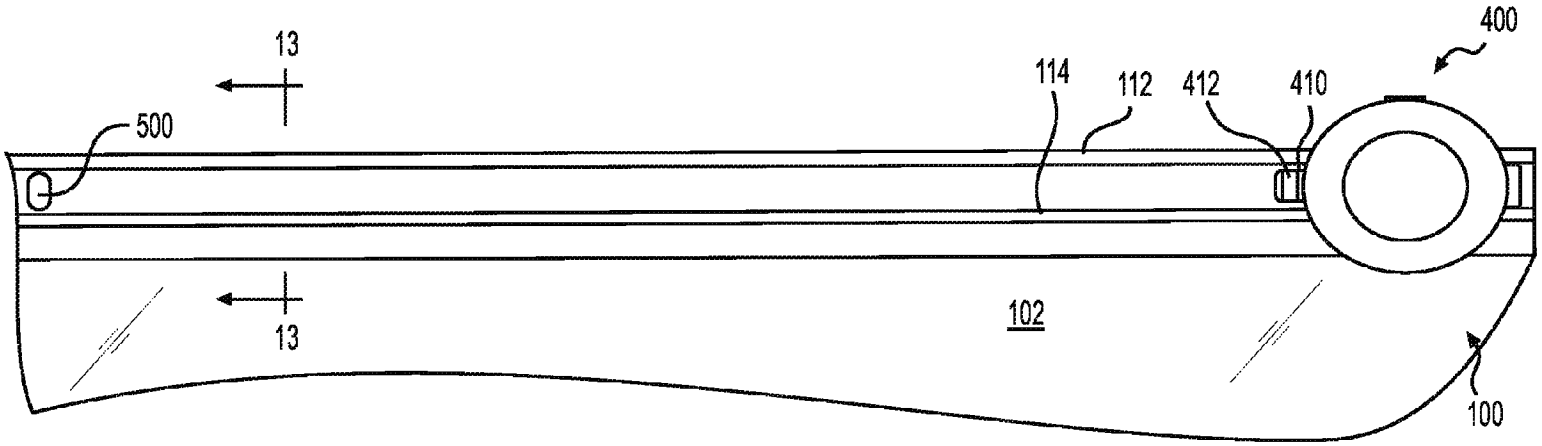

FIG. 12 is a partial side view of the bag of FIG. 1 including a detent at one end of the bag and the slider of FIG. 10A operatively engaged on the double zipper profile of the bag of FIG. 1.

Figure 13:
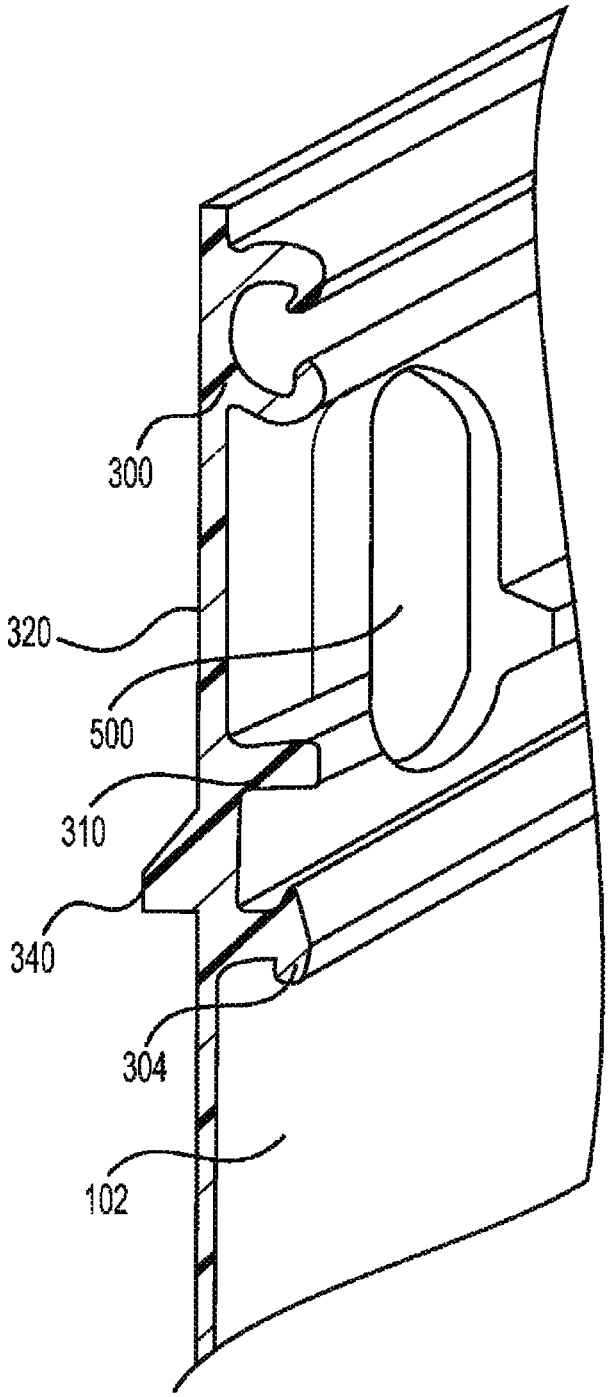

FIG. 13 is an enlarged partial cross-sectional view taken along line 13-13 of FIG. 12 of the detent included on the bag of FIG. 12 with portions behind the plane of the cross section omitted for clarity.

Figure 14:
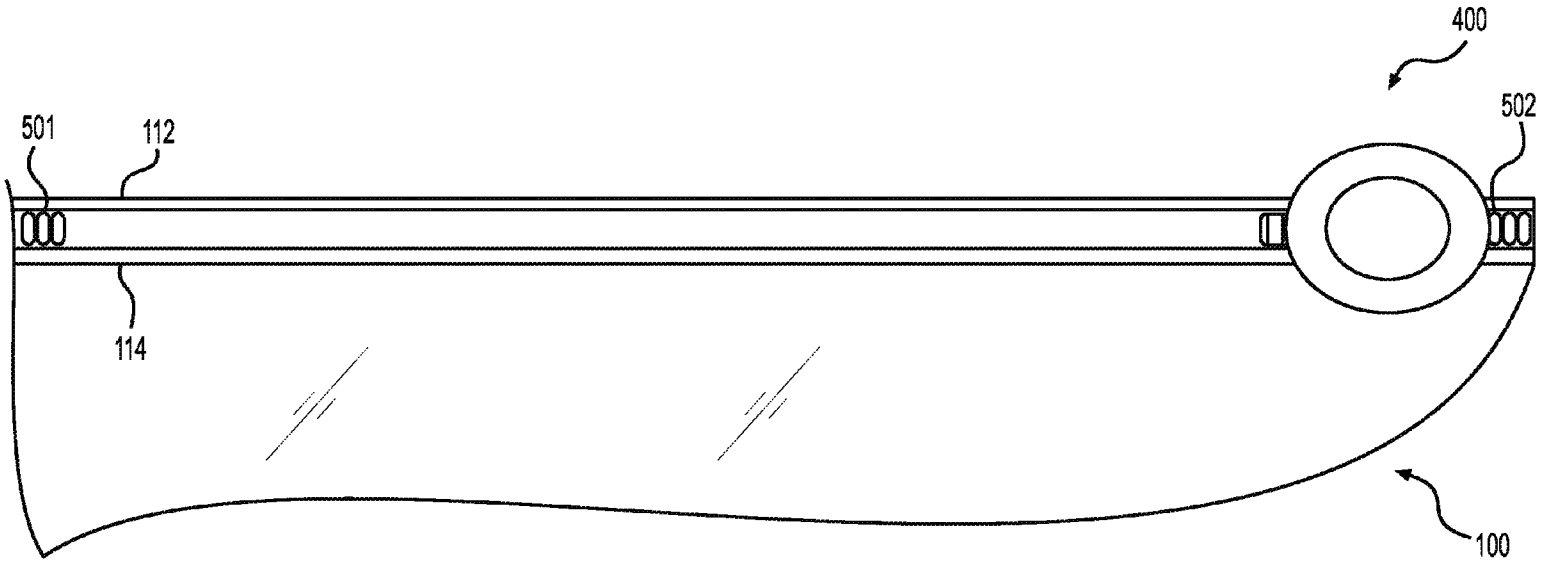

FIG. 14 is a partial side view of the bag of FIG. 1 including multiple detents at each end of the bag and the slider of FIG. 10A operatively engaged on the double zipper profile of the bag of FIG. 1.

Figure 15A:
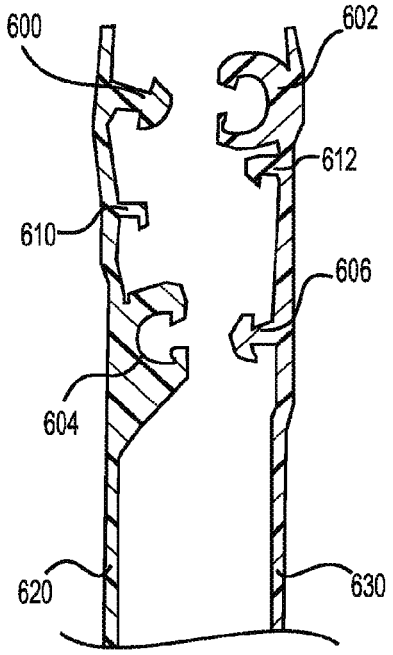

FIG. 15A is a partial cross-sectional view taken along line 15A-15A of FIG. 2 of another embodiment of an elongate double zipper profile in a de-occluded position with portions behind the plane of the cross section omitted for clarity.

Figure 15B:
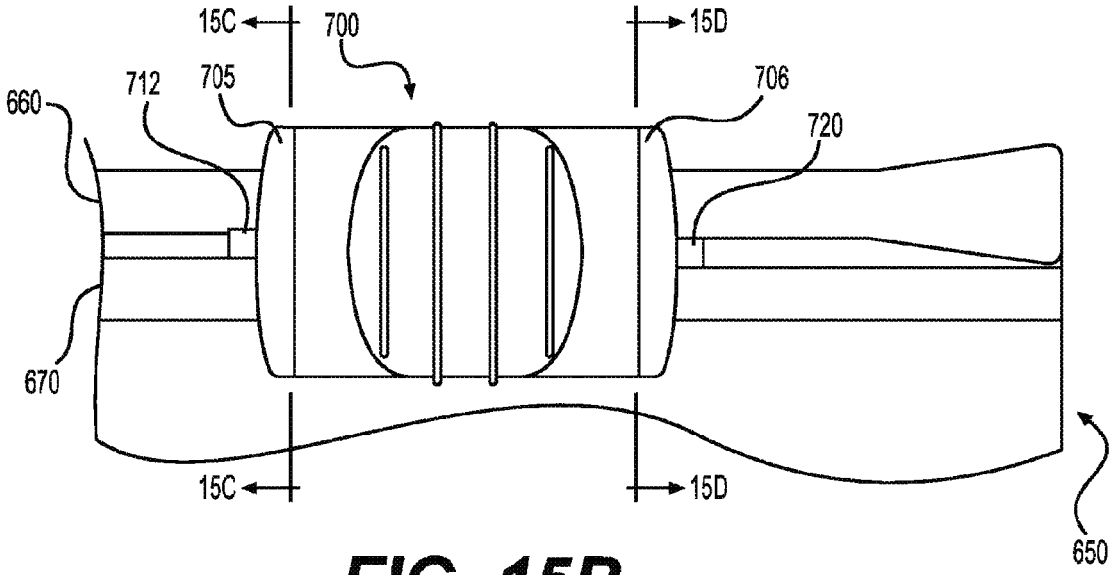

FIG. 15B is a partial side view of another embodiment of a bag with a double zipper profile, the bag including an embodiment of a slider comprising a separator finger and a tail operatively engaged on the double zipper profile of the bag (in this embodiment, the opening direction of the bag is from right to left, and the closing direction of the bag is from left to right).

Figure 15C:
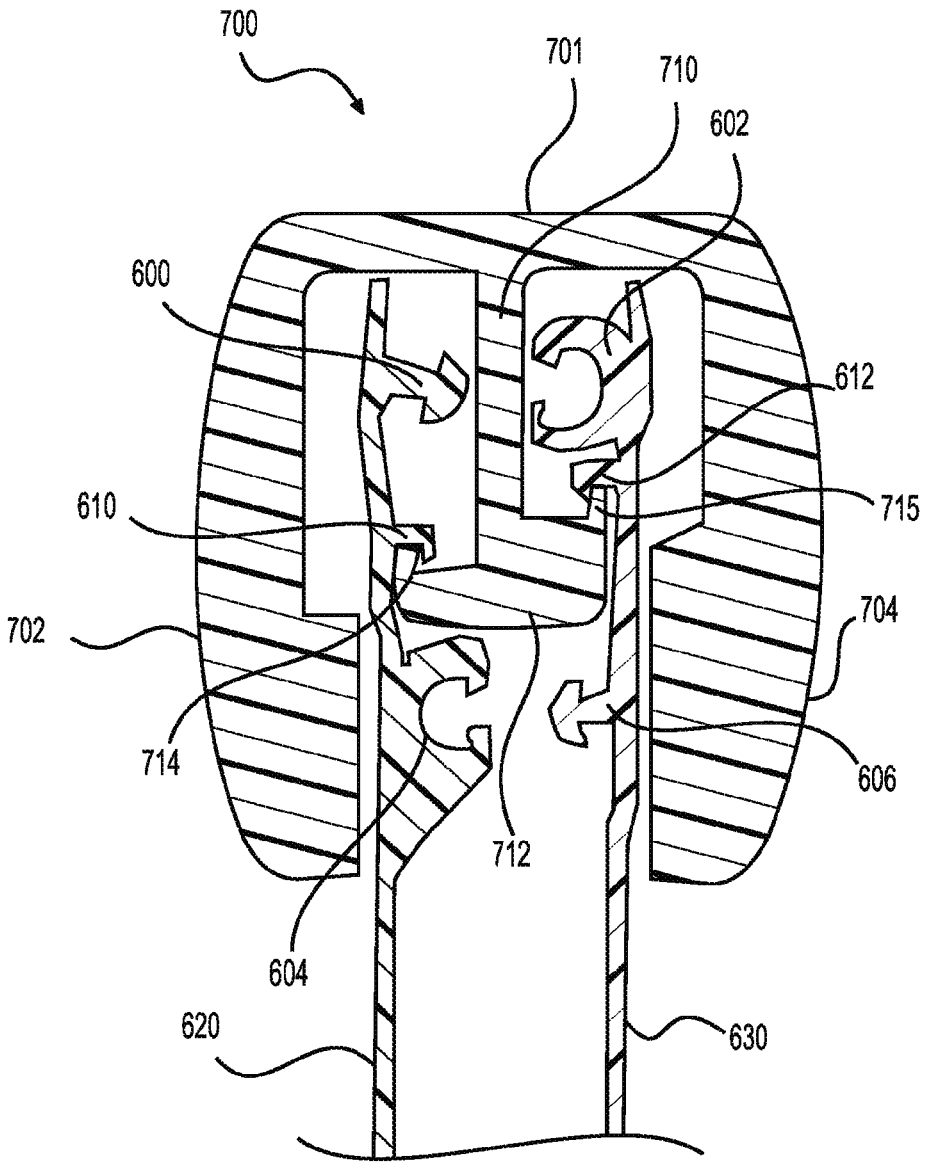

FIG. 15C is a partial cross-sectional view taken along line 15C-15C of FIG. 15B at the opening end of the slider with the elongate double zipper profile of FIG. 15A, showing an embodiment of the slider and the separator finger of FIG. 15B operatively engaged on the double zipper profile of FIG. 15A.

Figure 15D:
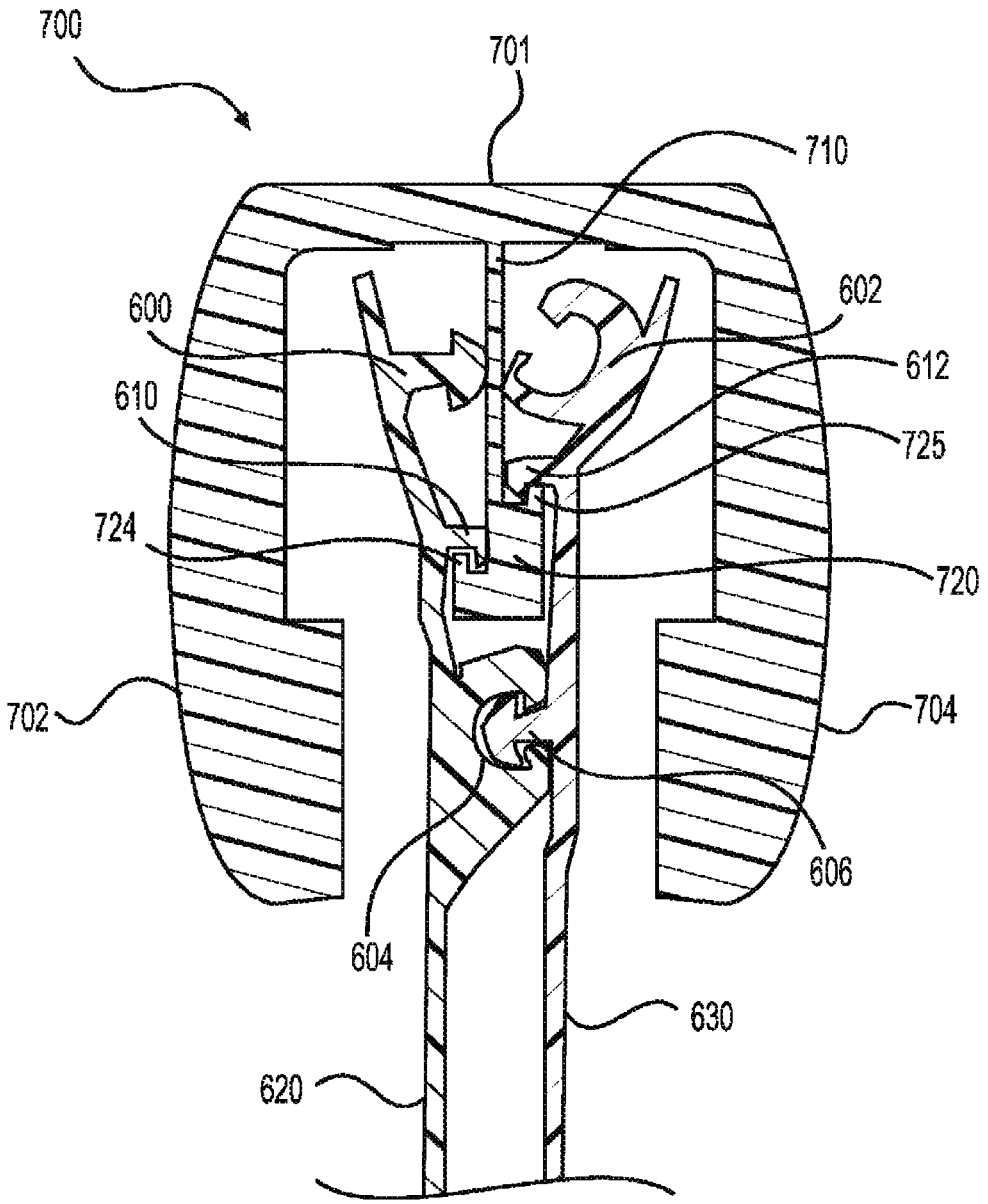

FIG. 15D is a partial cross-sectional view taken along line 15D-15D of FIG. 15B at the closing end of the slider with the elongate double zipper profile of FIG. 15A, showing an embodiment of the tail of the slider of FIG. 15B operatively engaged on the double zipper profile of FIG. 15A.

Figure 16:
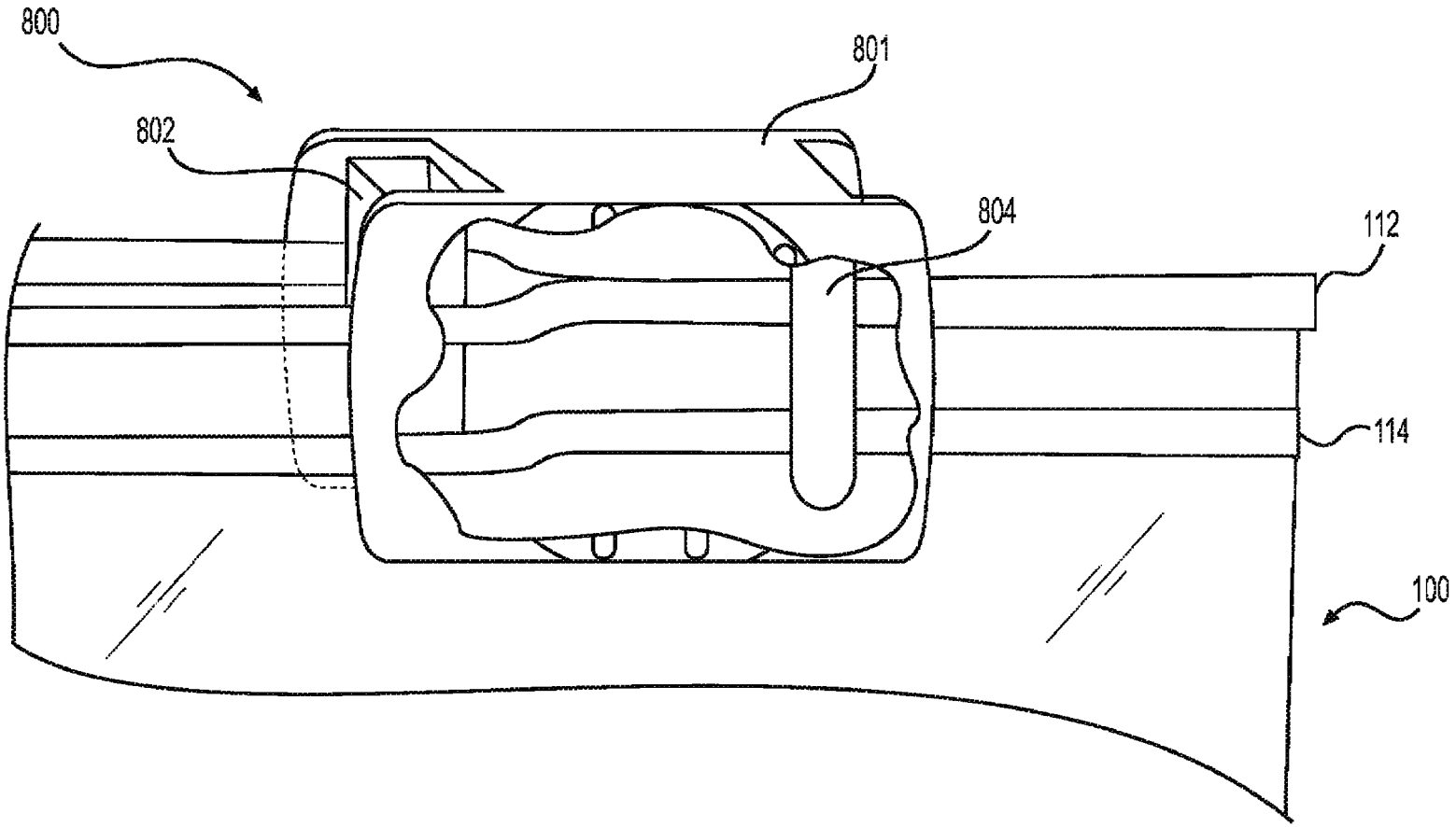

FIG. 16 is a partial side view of the bag of FIG. 1 including another embodiment of a slider operatively engaged on the double zipper profile of the bag of FIG. 1 and capable of simultaneous opening and closing of the double zipper profile in the same vertical plane.

Figure 17A:
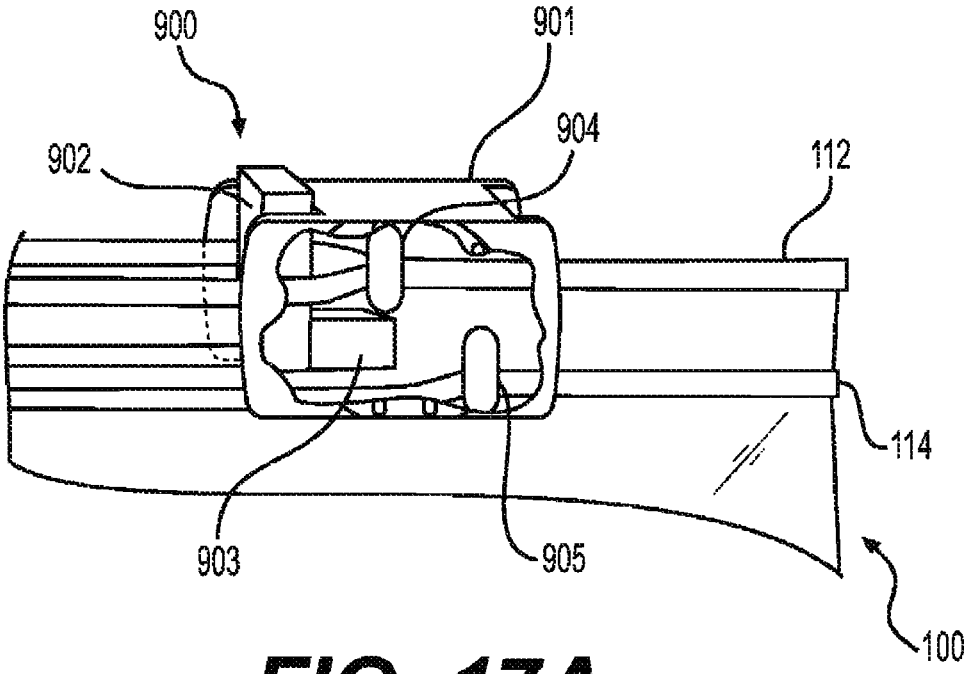

FIG. 17A is a partial side view of the bag of FIG. 1 including another embodiment of a slider operatively engaged on the double zipper profile of the bag of FIG. 1 and capable of offset opening and closing of the double zipper profile.

Figure 17B:
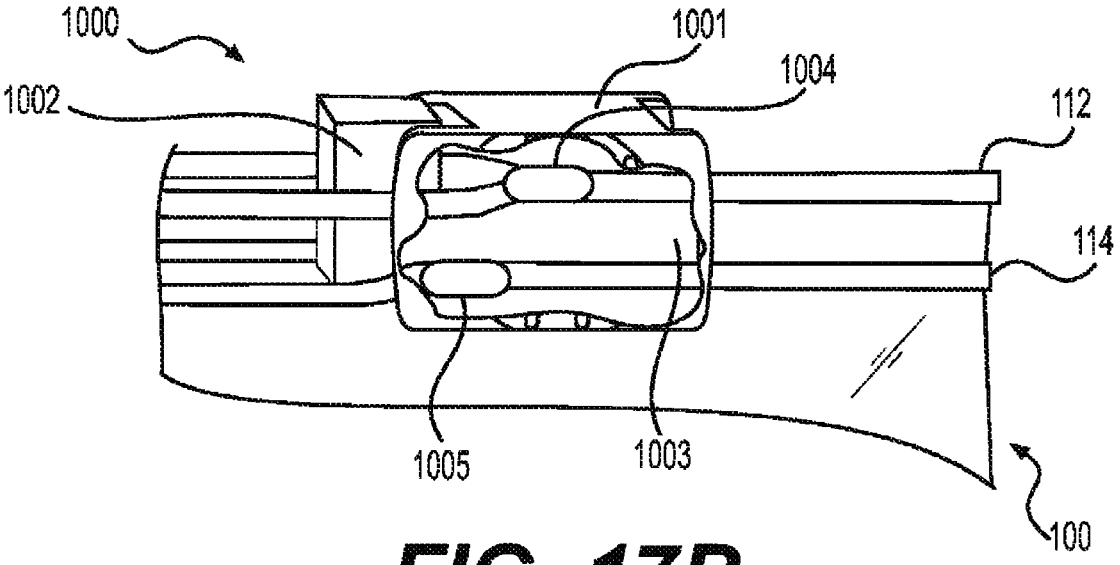

FIG. 17B is a partial side view of the bag of FIG. 1 including another embodiment of a slider operatively engaged on the double zipper profile of the bag of FIG. 1 and capable of offset opening and closing of the double zipper profile.

Figure 18A:
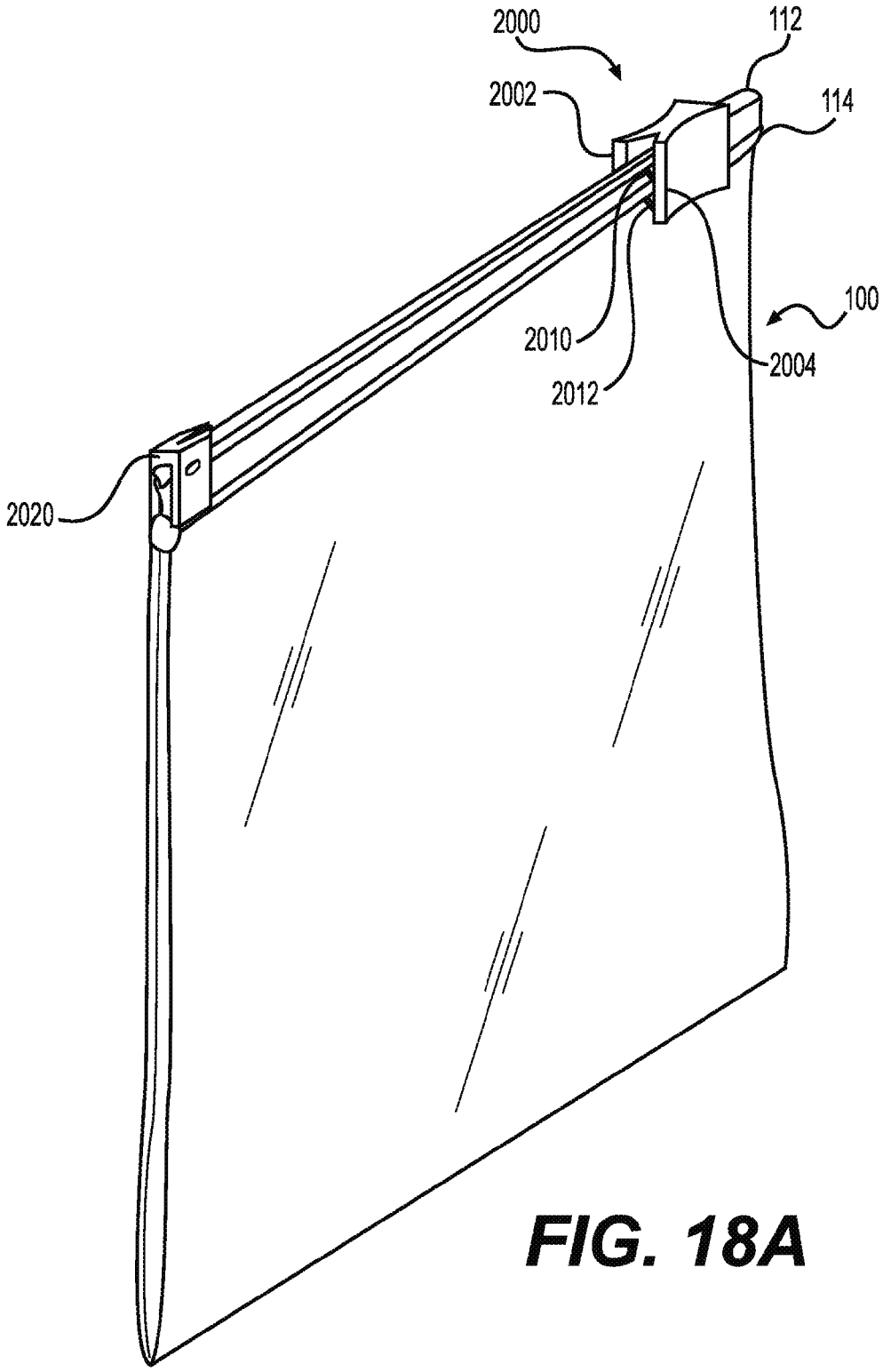

FIG. 18A is a top perspective view of the bag of FIG. 1 including another embodiment of a slider operatively engaged on the double zipper profile of the bag of FIG. 1 and capable of multi-level slider retention.

Figure 18B:
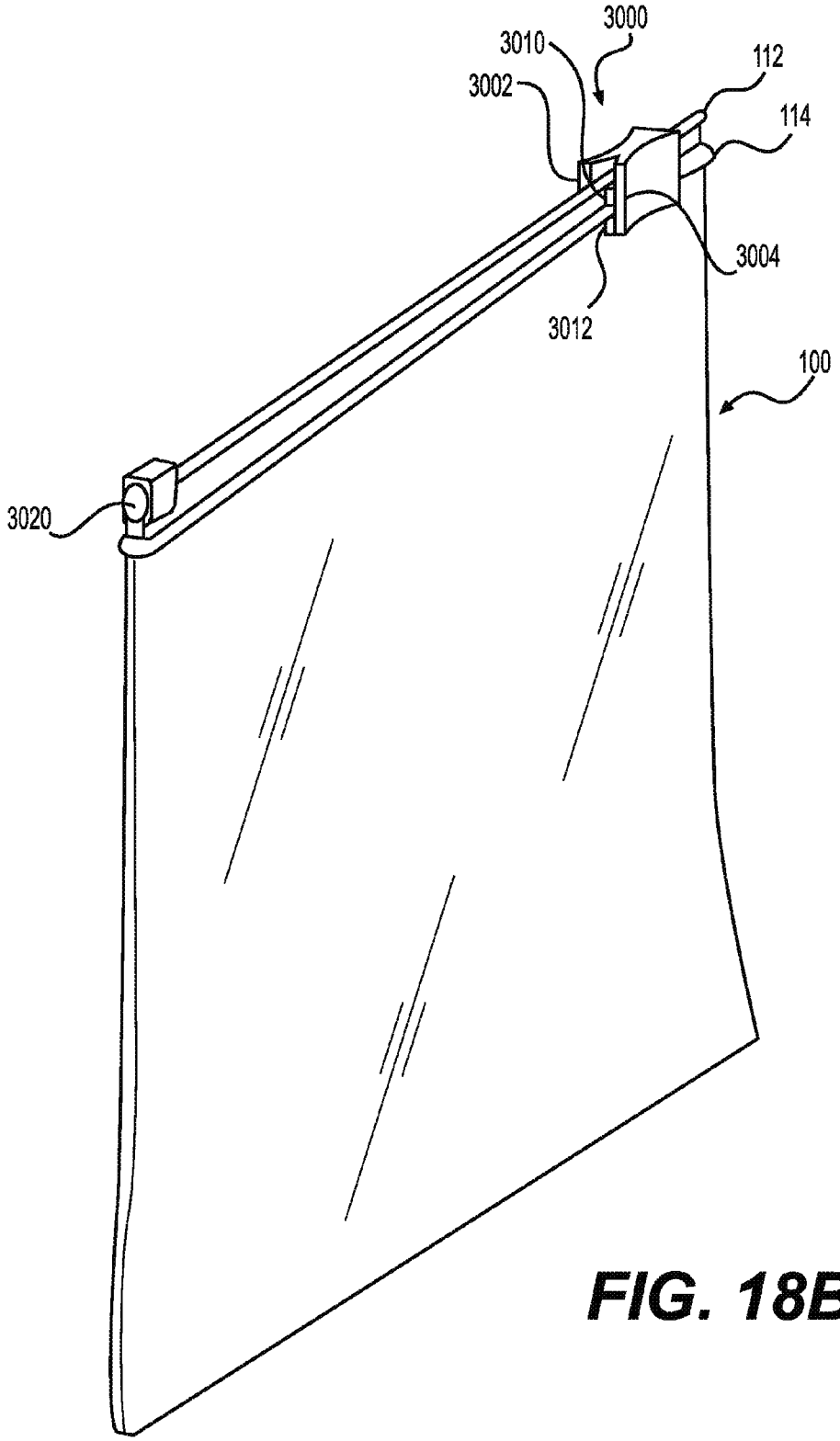

FIG. 18B is a top perspective view of the bag of FIG. 1 including another embodiment of a slider operatively engaged on the double zipper profile of the bag of FIG. 1, the slider having multiple levels of vertical slider retention.

Figure 19:
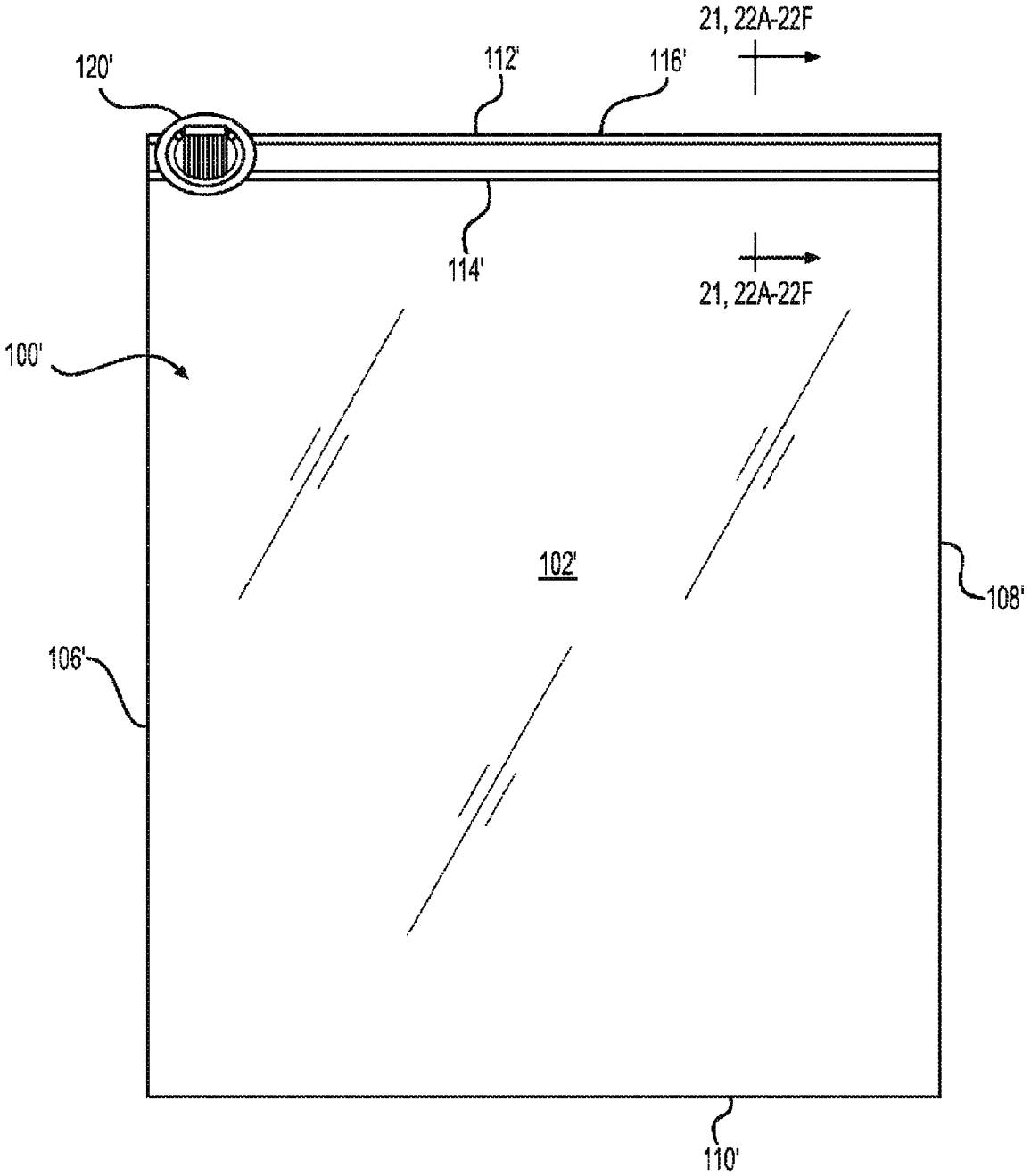

FIG. 19 is a side view of a closed bag according to another embodiment of the invention, with a slider positioned at the closed end of the bag (in this embodiment, the opening direction of the bag is from left to right, and the closing direction of the bag is from right to left).

Figure 20:
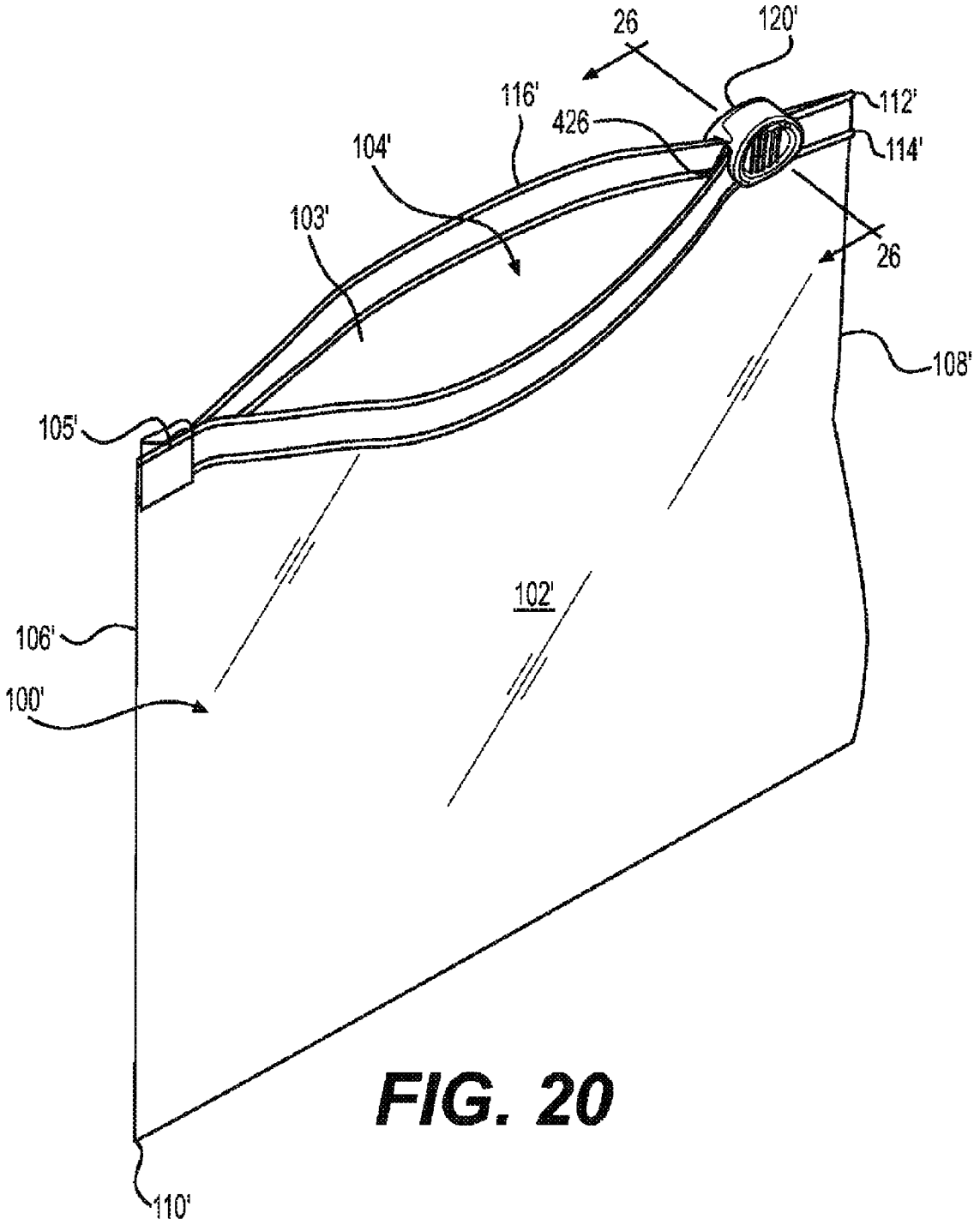

FIG. 20 is a top perspective view of the bag shown in FIG. 19, with the bag now open and the addition of an end stop.

Figure 21:
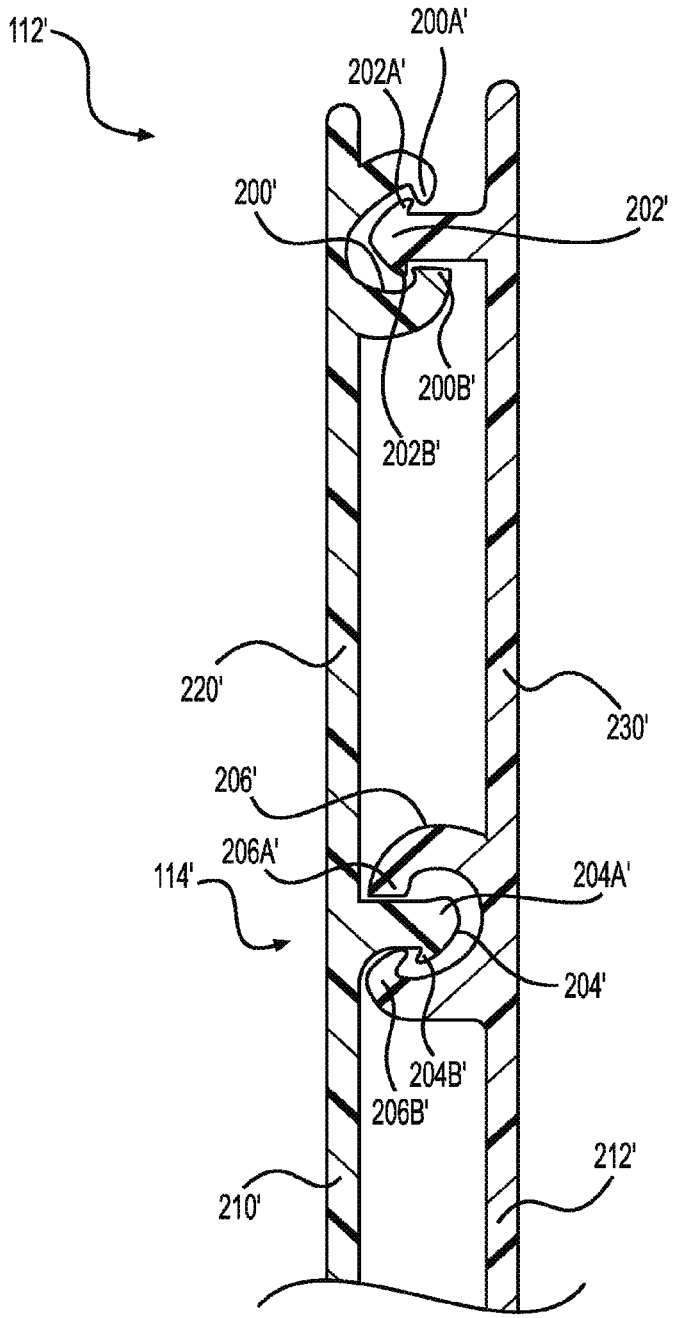

FIG. 21 is a partial cross-sectional view taken along line 21-21 of FIG. 19 of another embodiment of an elongate double zipper profile in an occluded position with portions behind the plane of the cross section omitted for clarity.

FIGS. 22A-22F are partial cross-sectional views taken along lines 22A-22A through 22F-22F of FIG. 19 of the elongate double zipper profile of FIG. 21 showing various embodiments for attaching the double zipper profile to the sidewalls of the bag of FIG. 19.

Figure 23:
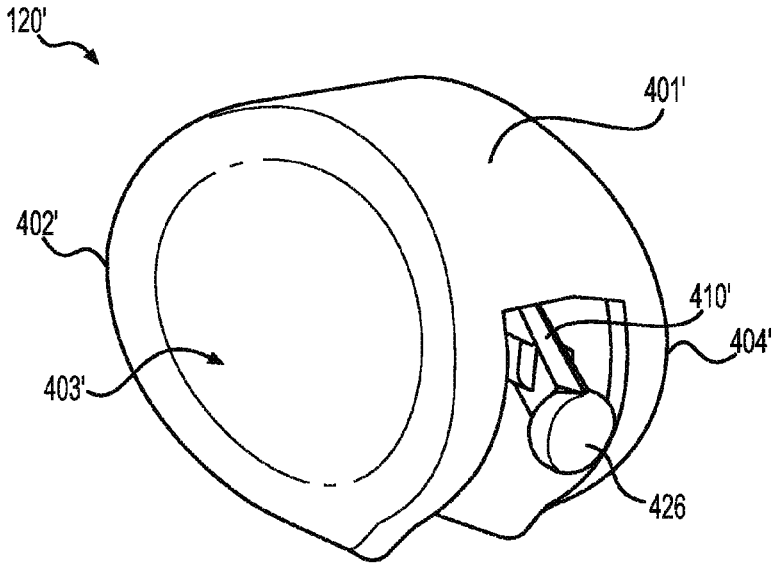

FIG. 23 is a top perspective view of another embodiment of a slider with a separating mechanism according to the present invention.

Figure 24:
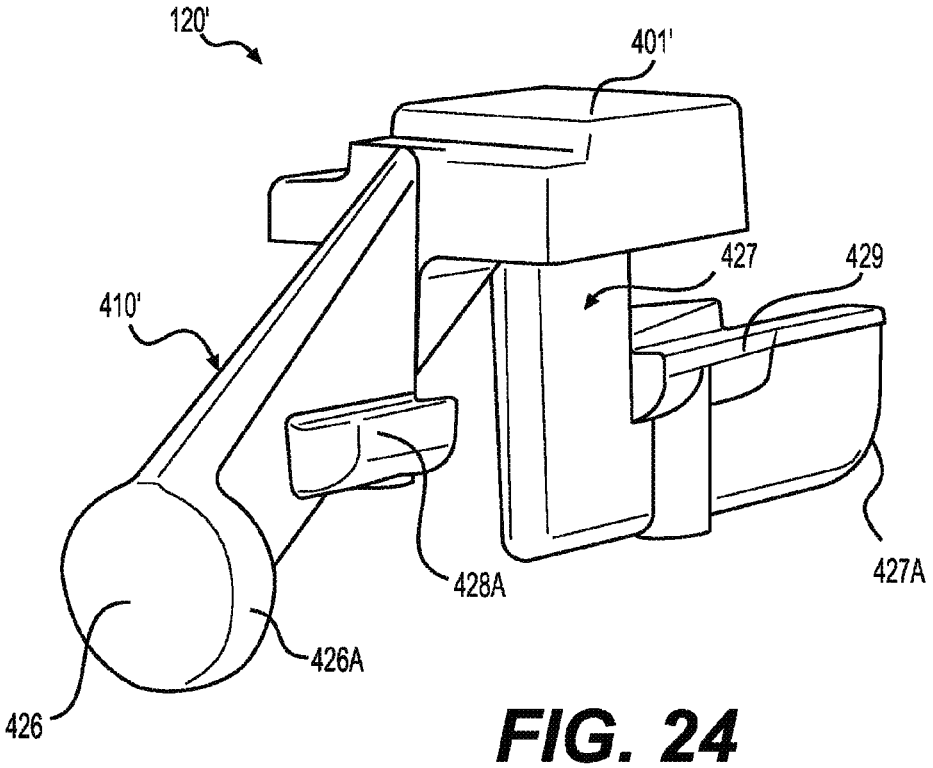

FIG. 24 is a side perspective view of the slider illustrated in FIG. 23, with portions of the slider removed to clarify features of the separating mechanism.

Figure 25:
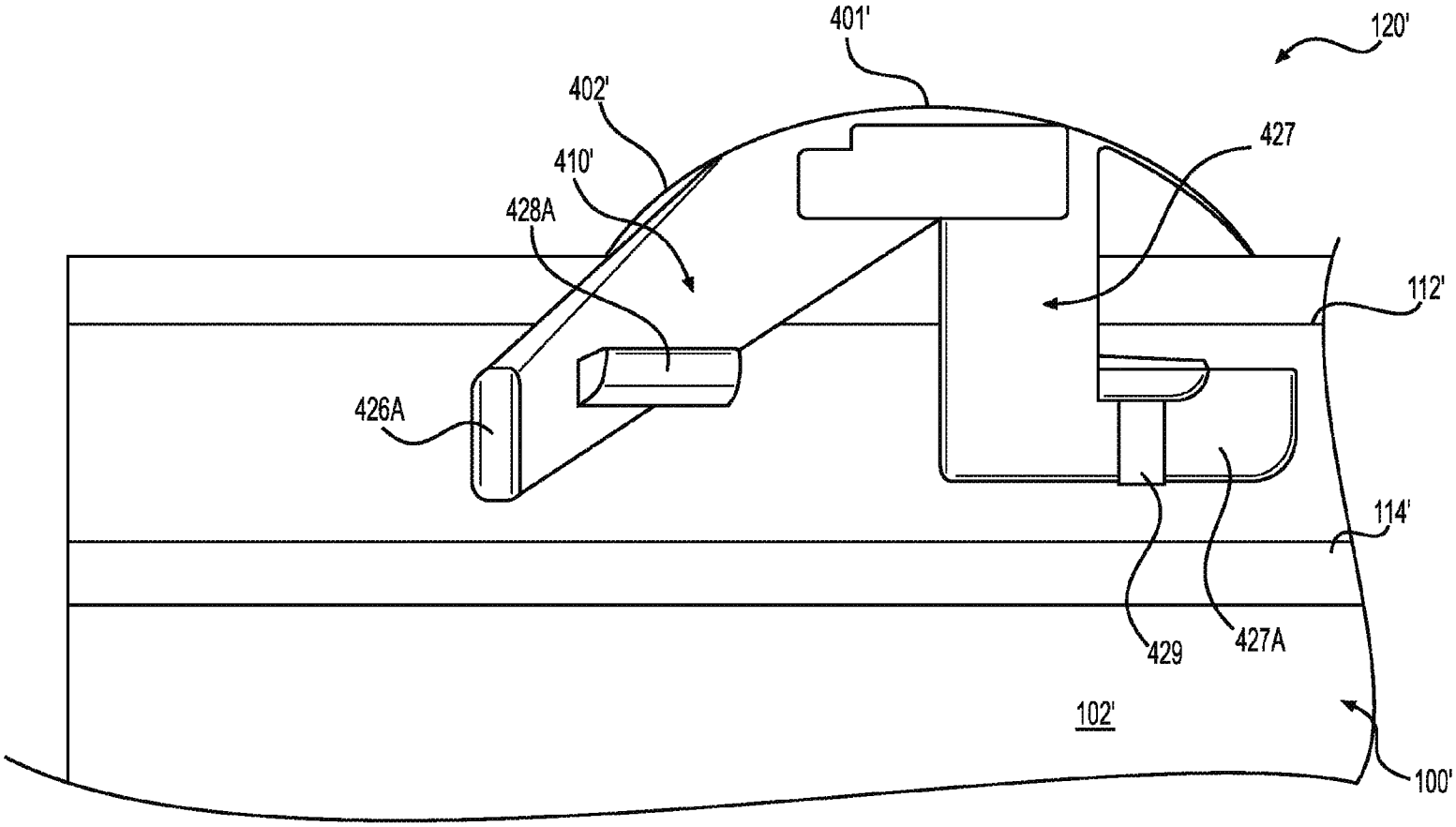

FIG. 25 is a partial side view of the bag of FIG. 19 including the slider and separating mechanism of FIGS. 23 and 24 operatively engaged on the double zipper profile of the bag of FIG. 19 with portions of the slider removed for clarity.

Figure 26:
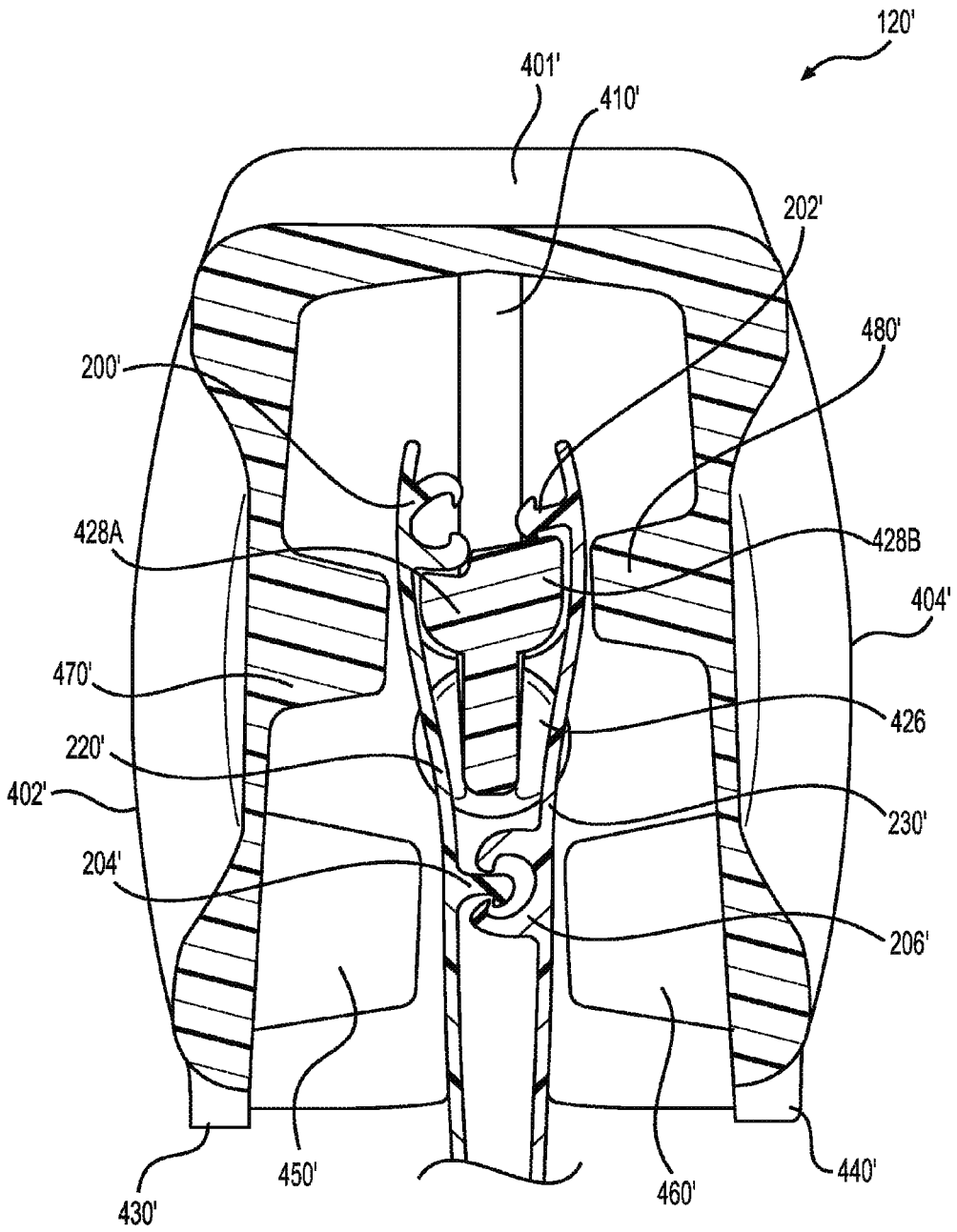

FIG. 26 is an enlarged partial cross-sectional view taken along line 26-26 of FIG. 20 of the elongate double zipper profile of FIG. 21 showing the slider of FIGS. 23 and 24 operatively engaged on the double zipper profile of FIG. 21 with portions behind the plane of the cross section omitted for clarity.

Figure 27:
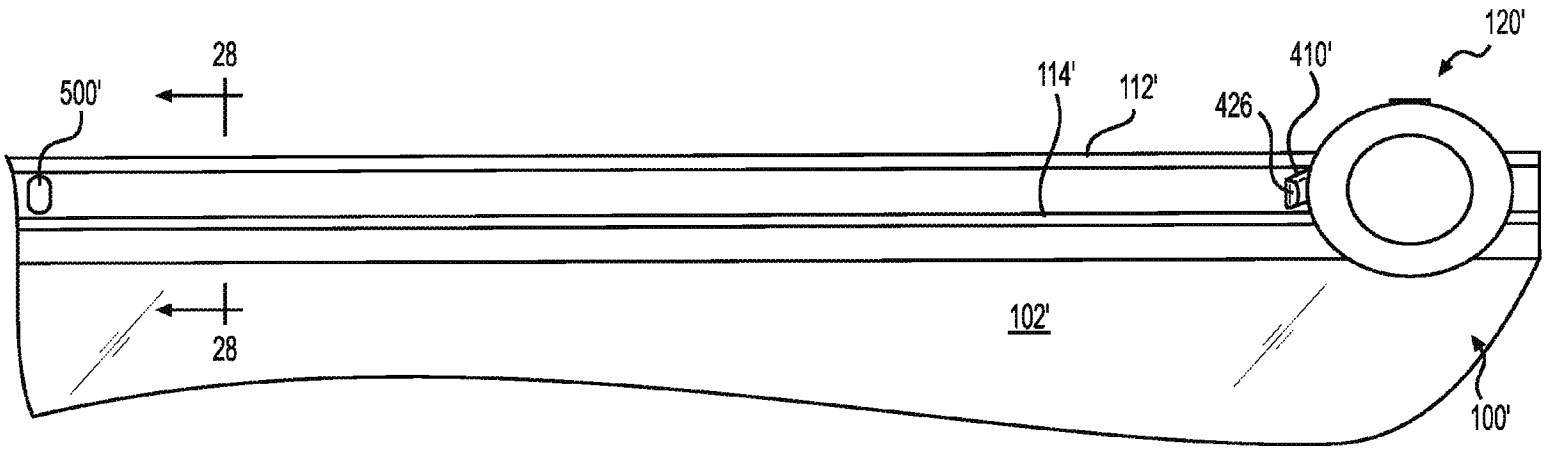

FIG. 27 is a partial side view of the bag of FIG. 19 including a detent at one end of the bag and the slider of FIG. 23 operatively engaged on the double zipper profile of the bag of FIG. 19.

Figure 28:
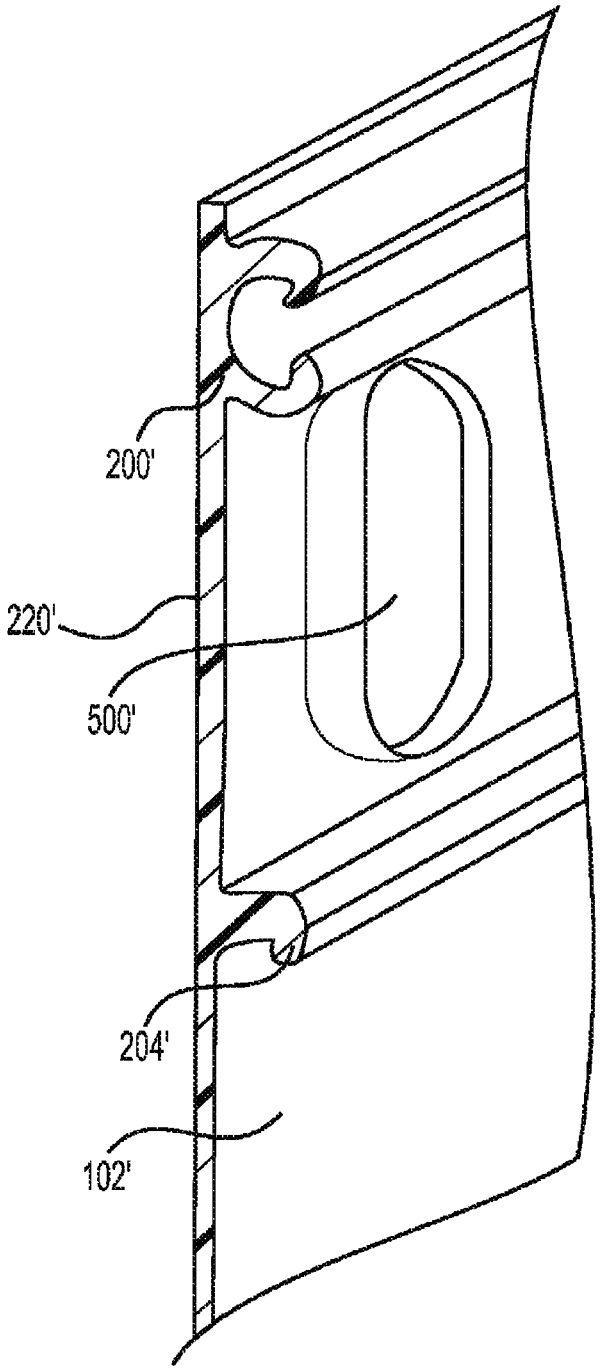

FIG. 28 is an enlarged partial cross-sectional view taken along line 28-28 of FIG. 27 of the detent included on the bag of FIG. 27 with portions behind the plane of the cross section omitted for clarity.

Figure 29:
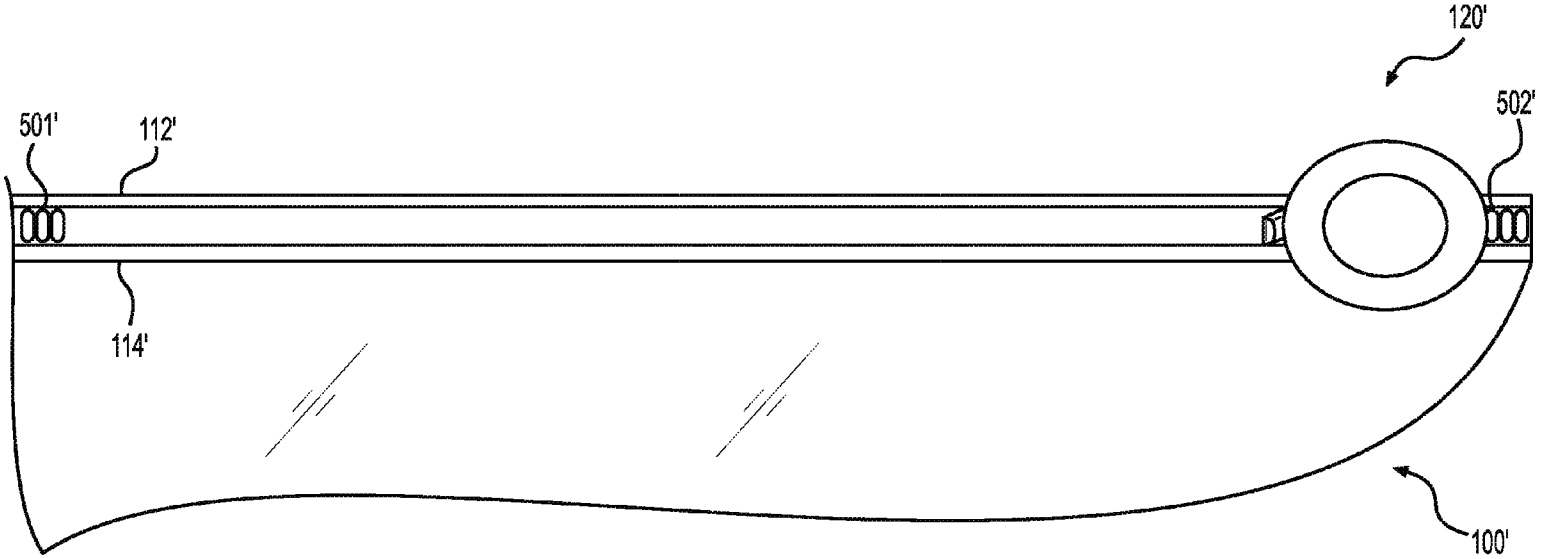

FIG. 29 is a partial side view of the bag of FIG. 19 including multiple detents at each end of the bag and the slider of FIG. 23 operatively engaged on the double zipper profile of the bag of FIG. 19.

Figure 30:
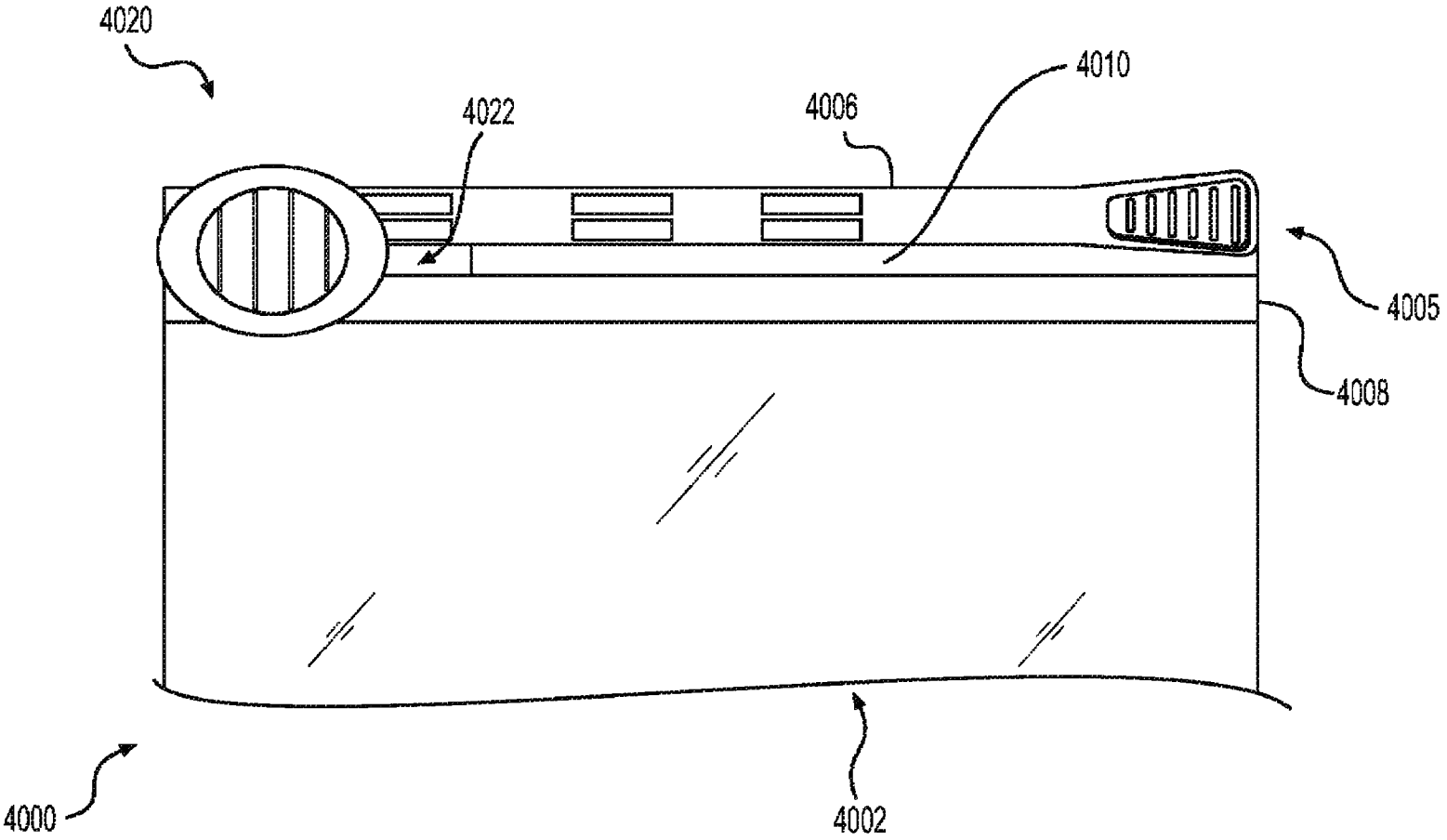

FIG. 30 is a partial side view of another embodiment of a bag including a slider operatively engaged on a double zipper profile of the bag, at least one of the zipper profiles being capable of audio/haptic feedback.

Figure 31A:
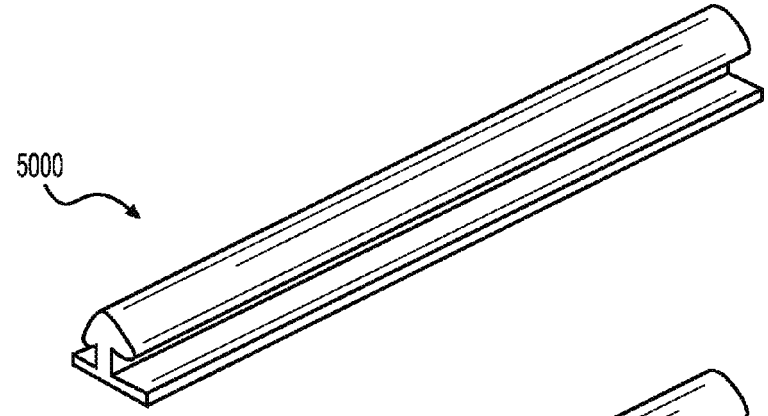

FIG. 31A is a top perspective view of an embodiment of a closure element of one of the zipper profiles that has been unaltered.

Figure 31B:
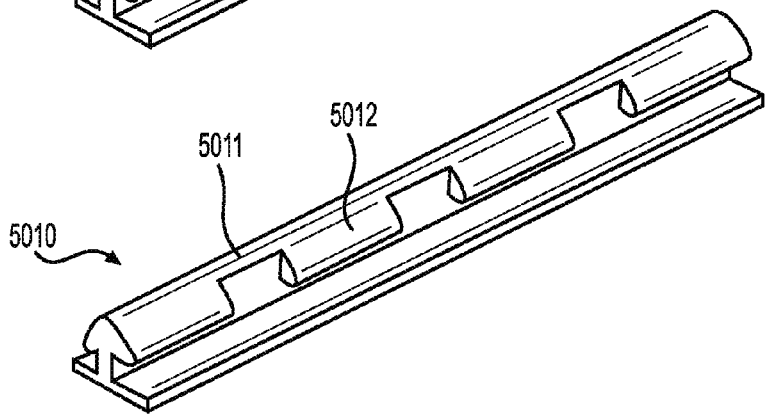

FIG. 31B is a top perspective view of an embodiment of a closure element of one of the zipper profiles with one-sided deformations.

Figure 31C:
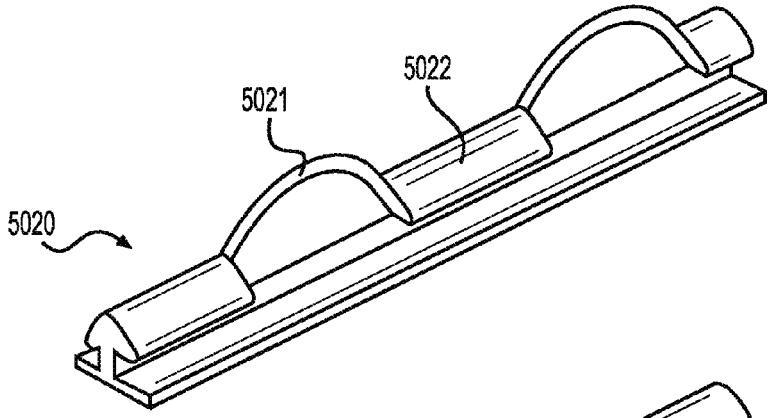

FIG. 31C is a top perspective view of another embodiment of a closure element of one of the zipper profiles with one-sided deformations.

Figure 31D:
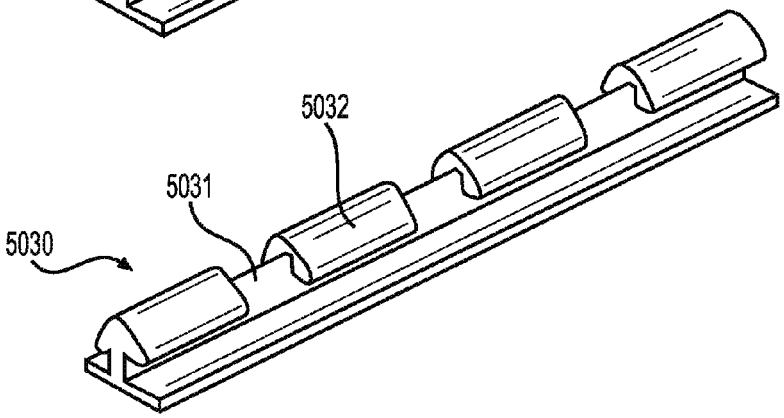

FIG. 31D is a top perspective view of an embodiment of a closure element of one of the zipper profiles with two-sided deformations.

Figure 32:
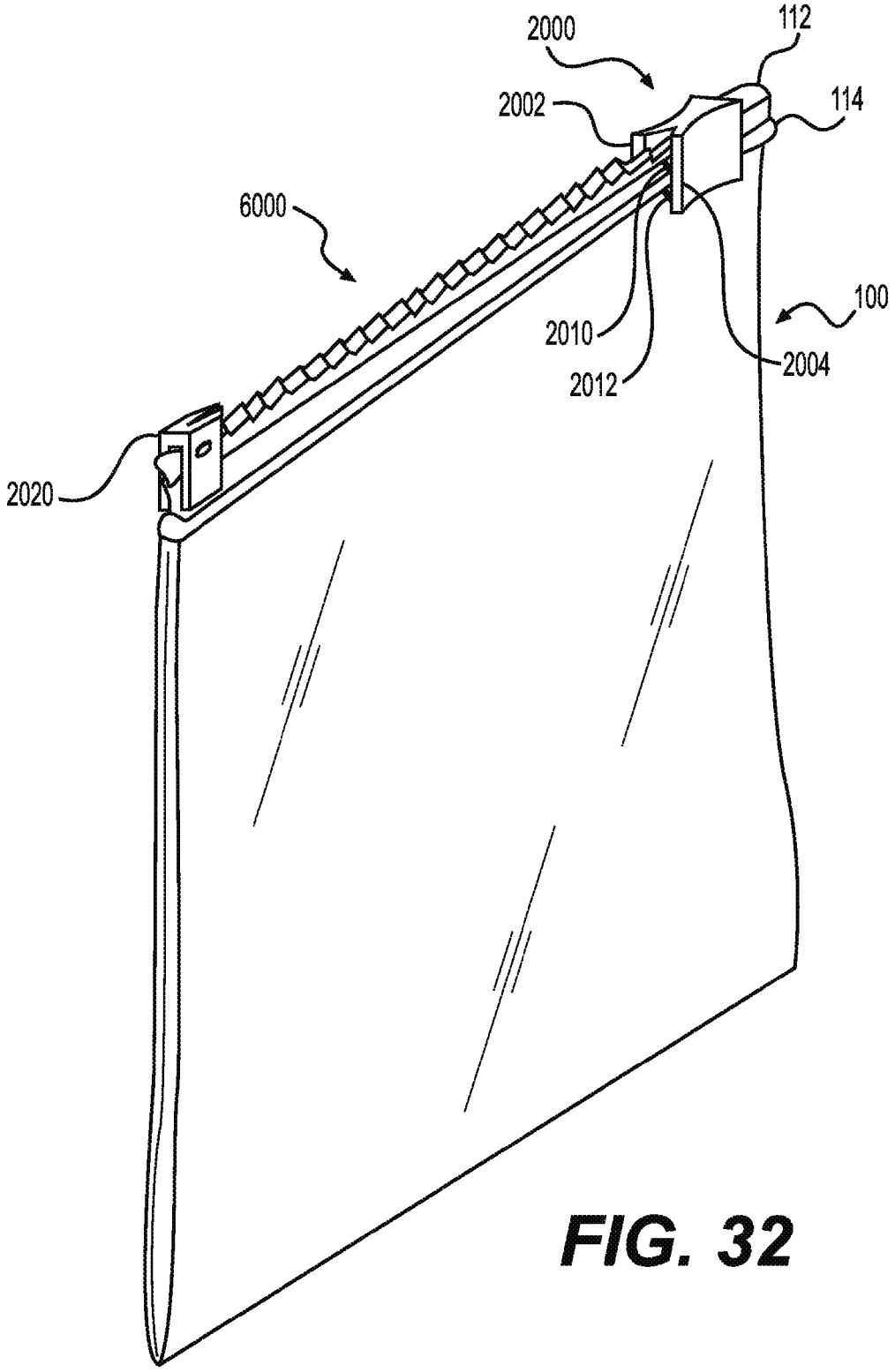

FIG. 32 is a top perspective view of the bag of FIG. 1 including the slider of FIG. 18B operatively engaged on the double zipper profile of the bag of FIG. 1, the upper profile of the double zipper profile being capable of audible and tactile feedback.

Figure 33:
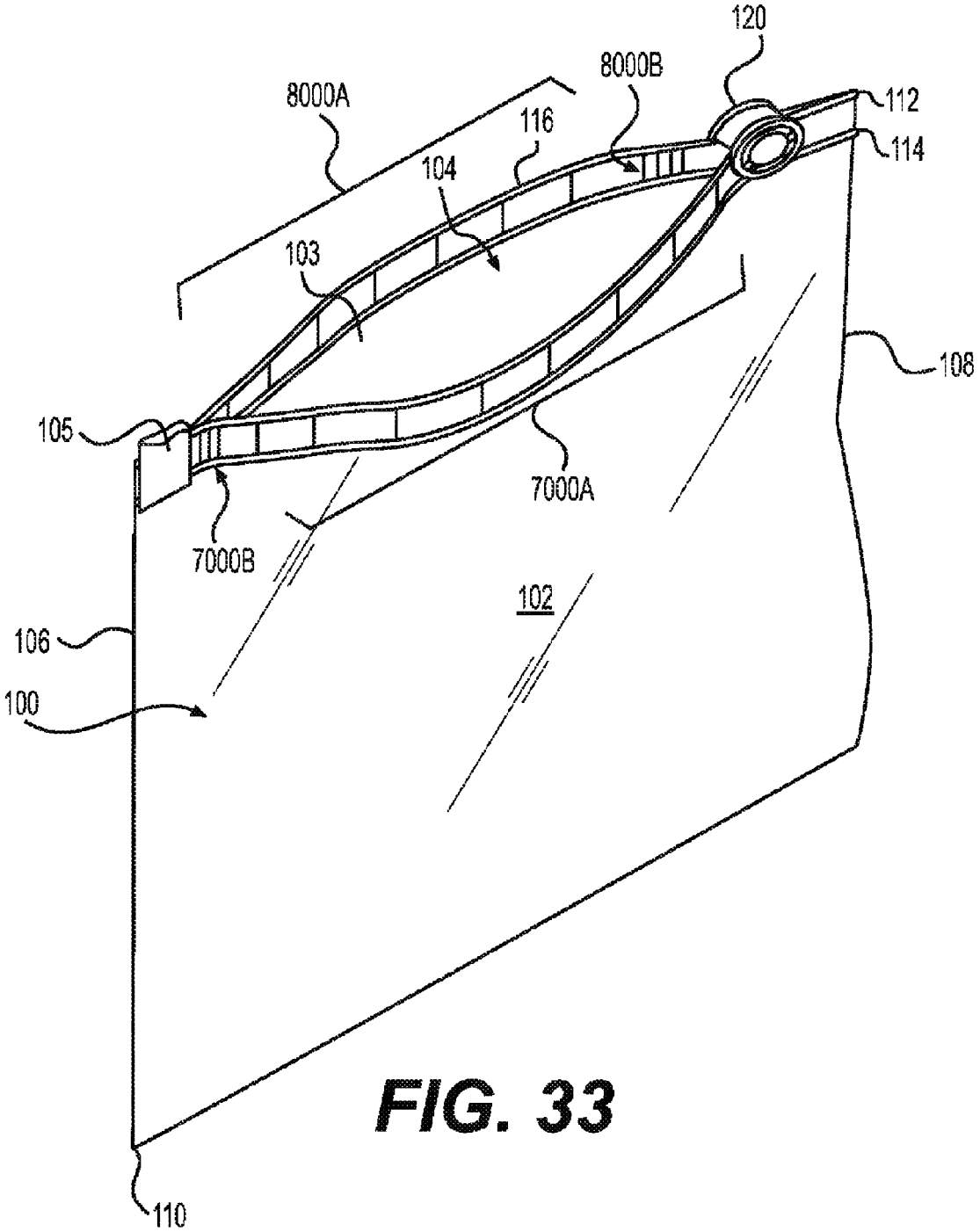

FIG. 33 is a top perspective view of the bag shown in FIG. 1 including the slider of FIG. 1 operatively engaged on the double zipper profile of the bag of FIG. 1, with a plurality of indentations provided on both an exterior surface and an interior surface of the zipper profiles.

DETAILED DESCRIPTION OF THE INVENTION

Our invention relates to closure assemblies comprising at least two pairs of interlocking profiles, as well as a slider for opening and closing the interlocking profiles. Our invention also relates to a storage bag that includes closure assemblies comprising at least two pairs of interlocking profiles and a slider for opening and closing the interlocking profiles. The features of our invention thereby provide for leak resistance, high external opening force, high internal burst strength, increased slider retaining force including improved vertical slider retention, and audible/haptic feedback, as well as controlling the sequence for opening and closing the profiles using either parallel or offset multi-level opening and closing.

As will be apparent from the description herein, the term "bag" encompasses a broad range of structures designed to contain items, such as pouches, envelopes, packets, and the like. In general, the term bag, as used herein, simply means a somewhat flexible container with an opening, with the bag being capable of carrying any number of items.

Turning now to the drawings, FIGS. 1 and 2 are views of a bag 100 according to an embodiment of the invention. The bag 100 includes a first sidewall 102 and a second sidewall 104. The first and second sidewalls 102 and 104 are connected along edges 106 and 108, and the first and second sidewalls 102 and 104 are also connected at a bottom edge 110 of the bag 100. An opening 103 to the interior of the bag 100 is formed adjacent to an edge 116 that is defined by zipper profiles 112 and 114, as will be described below. The first and second sidewalls 102 and 104 may be made from a substantially transparent plastic, such as the plastics discussed below, thereby allowing the contents of the interior of the bag to be easily determined. Alternatively, the first and second sidewalls 102 and 104 can be made substantially opaque, or of a completely opaque material.

As also shown in FIGS. 1 and 2, a slider 120 is operatively engaged to the zipper profiles 112 and 114, so as to open and to close the opening 103 to the bag 100. When the slider 120 is slid towards a closing end (e.g., left side of the bag 100 of FIG. 1), the opening 103 is closed by urging the opposing sidewalls 102, 104 together and occluding the zipper profiles 112, 114. When the slider 120 is slid towards an opening end (e.g., right side of the bag 100 of FIG. 1), the opening 103 is opened by urging the opposing sidewalls 102, 104 apart and de-occluding the zipper profiles 112, 114. As shown in FIG. 2, at least one end-stop 105 can be included at one or both of the closing and opening ends of the bag 100, in order to prevent the slider 120 from coming off of the ends of the zipper profiles 112, 114.

As shown in FIG. 3A, the upper zipper profile 112 includes a first closure element 200 and a second closure element 202, and the lower zipper profile 114 includes a third closure element 204 and a fourth closure element 206. The first closure element 200 and the third closure element 204 are provided on a first backing member 210, while the second closure element 202 and the fourth closure element 206 are provided on an opposing second backing member 212. Such an arrangement of an upper zipper profile with a pair of closure elements and a lower zipper profile with a second pair of closure elements is often referred to as a double zipper. In one embodiment, the backing members 210, 212 are connected to top edges of the sidewalls 102, 104, respectively, and in another embodiment, the backing members 210, 212 are simply extensions or part of the sidewalls 102, 104. In the embodiment shown in FIG. 3A, the first and fourth closure elements 200, 206 have female C-shaped interlocking profiles, and the second and third closure elements 202, 204 have male double hook arrow interlocking profiles. However, the specific shape and configuration of the individual closure elements 200, 202, 204, and 206 can be altered without departing from the spirit of the invention. In another embodiment, for example, the zipper profiles 112, 114 may include additional closure elements in order to create a more secure and leak resistant seal and/or may contain both female elements on one sidewall and corresponding male elements on the opposing sidewall.

As also shown in FIG. 3A, a first isolation section 220 extends between the first closure element 200 and the third closure element 204 on the first backing member 210, and a second isolation section 230 extends between the second closure element 202 and the fourth closure element 206 on the second backing member 212. The first and second isolation sections 220, 230 comprise portions of the first and second backing members 210, 212, respectively, that do not include any type of closure elements and/or interlocking or non-interlocking elements. The first and second isolation sections 220, 230 can be thinner than the zipper profiles 112, 114. By providing first and second isolation sections 220, 230 with a thinner cross section than those of the closure elements of the zipper profiles 112, 114, the first and second isolation sections 220, 230 provide flexibility to the backbone of the double zipper profile. In particular, if desired, the first and second isolation sections 220, 230 can have a cross-sectional area such that the bending stiffness in these sections is inadequate to de-occlude the lower profile 114 when a slider with a separator finger is placed in the area between the upper and lower zipper profiles 112, 114. We have found that a thickness of the first and second isolation sections 220, 230 of less than 20 mils at a center-to-center spacing of 200 mils between the closure elements of the upper and lower zipper profiles 112, 114 provides enough isolation and flexibility that any leverage applied by a separator finger to the first and second closure elements 200, 202 of the upper zipper profile 112 is insufficient to open the third and fourth closure elements 204, 206 of the lower zipper profile 114. In particular, the first and second isolation sections 220, 230 may have a thickness of between about 1 mils and 15 mils, or more preferably about 5 mils and 10 mils. In addition, the first isolation section 220 may have a thickness that differs from that of the second isolation section 230. For example, the first isolation section 220 may have a thickness of about 15 mils, while the second isolation section 230 has a thickness of about 5 mils, or vice versa. One having ordinary skill in this art will recognize, however, that the specific thickness and/or tolerances of the first and second isolation sections 220, 230 can be altered without departing from the spirit of the invention. Accordingly, the first and second isolation sections 220, 230 are provided such that the opening of the upper zipper profile 112 via a slider does not impact the opening of the lower zipper profile 114 via a slider, or vice versa. Specifically, forces imparted by a slider to the upper zipper profile 112 will be isolated from forces imparted by the slider to the lower zipper profile 114, due to the inclusion of the first and second isolation sections 220, 230. Thus, a slider may open or de-occlude the upper zipper profile 112, while the lower zipper profile 114 remains occluded, such that the bag will be fully sealed when the slider is in a closed position. The independent opening and manipulation of one zipper profile versus the other zipper profile allows for leak resistance, a high external opening force, a high internal burst strength, and an increased slider retaining force.

FIGS. 3B1 and 3B2 are enlarged partial cross-sectional views of the closure elements of the upper zipper profile 112 shown in FIG. 3A. In particular, the first closure element 200 includes an upper hook 200A and a lower hook 200B, while the second closure element 202 also includes an upper hook 202A and a lower hook 202B. As shown in FIGS. 3B1 and 3B2, the upper hooks 200A, 202A are configured to have aggressive hooking angles to provide for a high external opening force. An aggressive hooking angle means that the hooks are formed at sharp angles, such that the hooks are, for example, at an acute angle with respect to the portion of the closure element to which the hook is attached. In particular, the upper hook 200A of the first closure element 200 is at a defined angle ($\theta_A$) with respect to the portion of the first closure element 200 to which the upper hook 200A is attached (see, e.g., FIG. 3B1), while the upper hook 202A of the second closure element 202 is at a defined angle ($\theta_B$) with respect to the portion of the second closure element 202 to which the upper hook 202A is attached (see, e.g., FIG. 3B2). The upper hook 200A is preferably at an angle of 50 degrees to 90 degrees, or more preferably, at an angle of 60 degrees to 85 degrees, or most preferably, at an angle of 70 degrees to 80 degrees, with respect to the portion of the closure element to which the upper hook 200A is attached. The upper hook 202A is preferably at an angle of 45 degrees to 90 degrees, or more preferably, at an angle of 50 degrees to 80 degrees, or most preferably, at an angle of 57 degrees to 73 degrees, with respect to the portion of the closure element to which the upper hook 202A is attached. By providing upper hooks 200A, 202A at sharp angles, the upper hook 200A of the first closure element 200 aggressively mates or engages with the upper hook 202A of the second closure element 202. The aggressive mating of the upper hooks 200A, 202A to each other causes the upper hooks 200A, 202A to stick together when an external opening force is applied to the upper hooks 200A, 202A, i.e., when a user tries to pull open the opening 103 of the bag 100 along the top edge 116. The lower hooks 200B, 202B, however, are configured to have less aggressive or sharp hooking angles to provide for easier internal opening (e.g., opening between the zipper profiles) of the closure elements 200, 202 via a slider, since a lower internal opening force between the zipper profiles will be needed to open these hooks 200B, 202B. In particular, the lower hook 200B of the first closure element 200 is at a defined angle ($\theta_C$) with respect to the portion of the first closure element 200 to which the lower hook 200B is attached (see, e.g., FIG. 3B1), while the lower hook 202B of the second closure element 202 is at a defined angle ($\theta_D$) with respect to the portion of the second closure element 202 to which the lower hook 202B is attached (see, e.g., FIG. 3B2). For example, the lower hook 200B is preferably at an angle of 50 degrees to 90 degrees, or more preferably, at an angle of 60 degrees to 85 degrees, or most preferably, at an angle of 70 degrees to 80 degrees, with respect to the portion of the closure element to which the lower hook 200B is attached. The lower hook 202B, however, is preferably at an angle of 50 degrees to 110 degrees, or more preferably, at an angle of 70 degrees to 110 degrees, or most preferably, at an angle of 80 degrees to 90 degrees, with respect to the portion of the closure element to which the lower hook 200B is attached. Thus, the lower hook 200B of the first closure element 200 weakly mates or engages with the lower hook 202B of the second closure element 202. Alternatively, if desired, the lower hook 202B of the second closure element 202 and/or the lower hook 200B of the first closure element 200 could be partially or completely removed.

FIGS. 3C1 and 3C2 are enlarged partial cross-sectional views of the closure elements of the lower zipper profile 114 shown in FIG. 3A. In particular, the third closure element 204 includes an upper hook 204A and a lower hook 204B, while the fourth closure element 206 also includes an upper hook 206A and a lower hook 206B. In contrast to the closure elements of the upper zipper profile 112, the upper hooks 204A, 206A shown in FIGS. 3C1 and 3C2 are configured to have less aggressive or sharp hooking angles to provide for an easier opening via a slider. In particular, the upper hook 204A of the third closure element 204 is at a defined angle ($\theta_E$) with respect to the portion of the third closure element 204 to which the upper hook 204A is attached (see, e.g., FIG. 3C1), while the upper hook 206A of the fourth closure element 206 is at a defined angle ($\theta_F$) with respect to the portion of the fourth closure element 206 to which the upper hook 206A is attached (see, e.g., FIG. 3C2). For example, the upper hook 204A is preferably at an angle of 90 degrees to 180 degrees, or more preferably, at an angle of 135 degrees to 180 degrees, or most preferably, at an angle of 160 degrees to 180 degrees, with respect to the portion of the closure element to which the upper hook 204A is attached. The upper hook 206A is preferably at an angle of 50 degrees to 90 degrees, or more preferably, at an angle of 60 degrees to 85 degrees, or most preferably, at an angle of 70 degrees to 80 degrees, with respect to the portion of the closure element to which the upper hook 206A is attached. Thus, the upper hook 204A of the third closure element 204 weakly mates or engages with the upper hook 206A of the fourth closure element 206. Alternatively, if desired, the upper hook 204A of the third closure element 204 and/or the upper hook 206A of the fourth closure element 206 could be partially or completely removed. The lower hooks 204B, 206B, however, are configured to have aggressive hooking angles in order to provide for a high internal burst strength. As discussed above, an aggressive hooking angle means that the hooks are formed at sharp angles, such that the hooks are, for example, at an acute angle with respect to the portion of the closure element to which the hook is attached. In particular, the lower hook 204B of the third closure element 204 is at a defined angle ($\theta_G$) with respect to the portion of the third closure element 204 to which the lower hook 204B is attached (see, e.g., FIG. 3C1), while the lower hook 206B of the fourth closure element 206 is at a defined angle ($\theta_H$) with respect to the portion of the fourth closure element 206 to which the lower hook 206B is attached (see, e.g., FIG. 3C2). The lower hook 204B is preferably at an angle of 37 degrees to 87 degrees, or more preferably, at an angle of 50 degrees to 80 degrees, or most preferably, at an angle of 57 degrees to 73 degrees, with respect to the portion of the closure element to which the lower hook 204B is attached. The lower hook 206B is preferably at an angle of 50 degrees to 90 degrees, or more preferably, at an angle of 60 degrees to 85 degrees, or most preferably, at an angle of 70 degrees to 80 degrees, with respect to the portion of the closure element to which the lower hook 206B is attached. By providing lower hooks 204B, 206B at sharp angles, the lower hook 204B of the third closure element 204 aggressively mates or engages with the lower hook 206B of the fourth closure element 206. The aggressive mating of the lower hooks 204B, 206B to each other causes the lower hooks 204B, 206B to stick together when an opening force is applied to the lower hooks 204B, 206B, i.e., when contents in the bag 100 pull down on or push apart the sidewalls 102, 104 of the bag 100, and thus, apply an opening force to the lower hooks 204B, 206B.

By configuring the upper hooks 200A, 202A of the upper zipper profile 112 and the lower hooks 204B, 206B of the lower zipper profile 114 to aggressively mate, a higher external opening force is necessary to pull open the hooks along the opening 103 of the bag 100, i.e., 200A and 202A, or to pull open the hooks along the interior of the bag 100, i.e., 204B, 206B. A lower internal opening force, however, is needed to open the hooks between the upper zipper profile 112 and lower zipper profile 114, i.e., 200B, 202B, 204A, and 206A, since these hooks are configured to weakly mate. Thus, the upper and lower zipper profiles 112, 114 illustrated in FIGS. 3A-3C2 will open from the inside-out, meaning, the interior hooks 200B, 202B, 204A, and 206A of the zipper profiles will de-occlude before the exterior hooks 200A, 202A, 204B, and 206B of the zipper profiles will de-occlude.

In view of the foregoing arrangement, the upper hooks 200A, 202A of the upper zipper profile 112 and the lower hooks 204B, 206B of the lower zipper profile 114 aggressively mate. This, then, requires a higher external opening force or burst strength to open these hooks, thereby providing for a stronger and more leakproof seal along the opening of the bag, as well as along the interior of the bag. Accordingly, a user would be unable to pull apart the opening 103 of the bag 100 without a significant force, and the contents in the bag would be unable to pull apart the lower hooks 204B, 206B along the interior of the bag without a high burst strength. In contrast, the hooks between the upper zipper profile 112 and lower zipper profile 114, i.e., 200B, 202B, 204A, and 206A, are configured to weakly mate. Thus, a lower internal opening force or burst strength is needed to open these hooks, thereby allowing for a slider with a separator finger to easily de-occlude the interior hooks via the separator finger when a user slides the slider in an opening direction, as well as occlude the interior hooks when a user slides the slider in a closing direction, as will be discussed in more detail below.

Figure 3D:
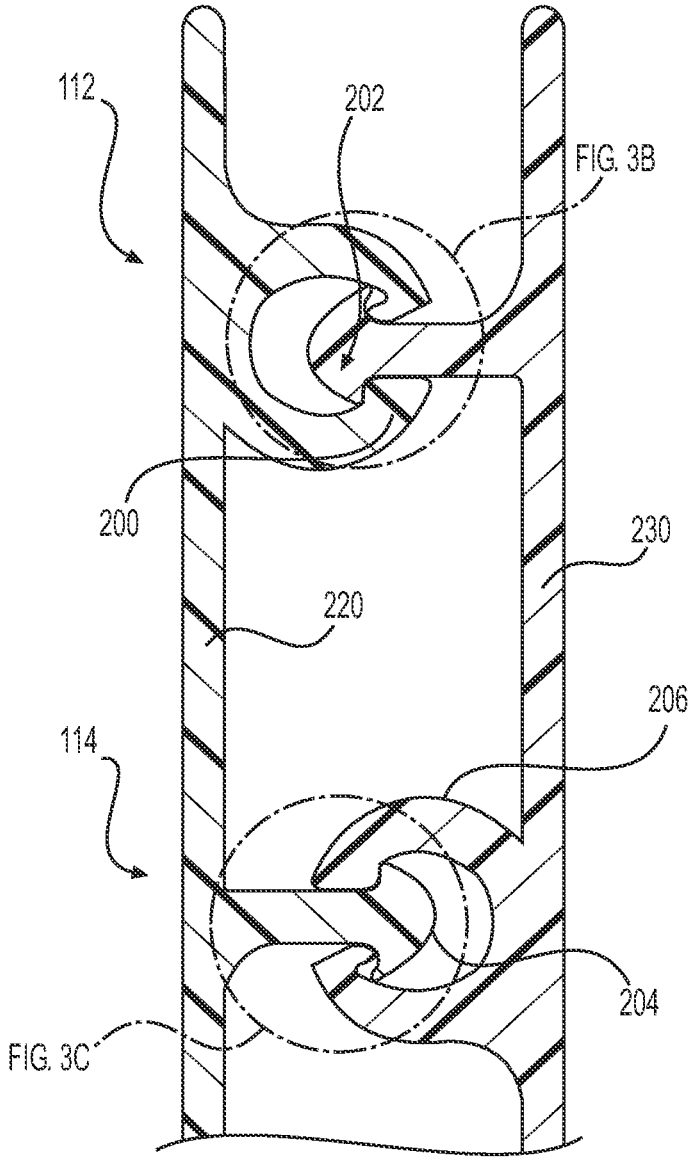
FIG. 3D is a partial cross-sectional view taken along line 3D-3D of FIG. 1 of another embodiment of an elongate double zipper profile in an occluded position with portions behind the plane of the cross section omitted for clarity.
Figure 3E:
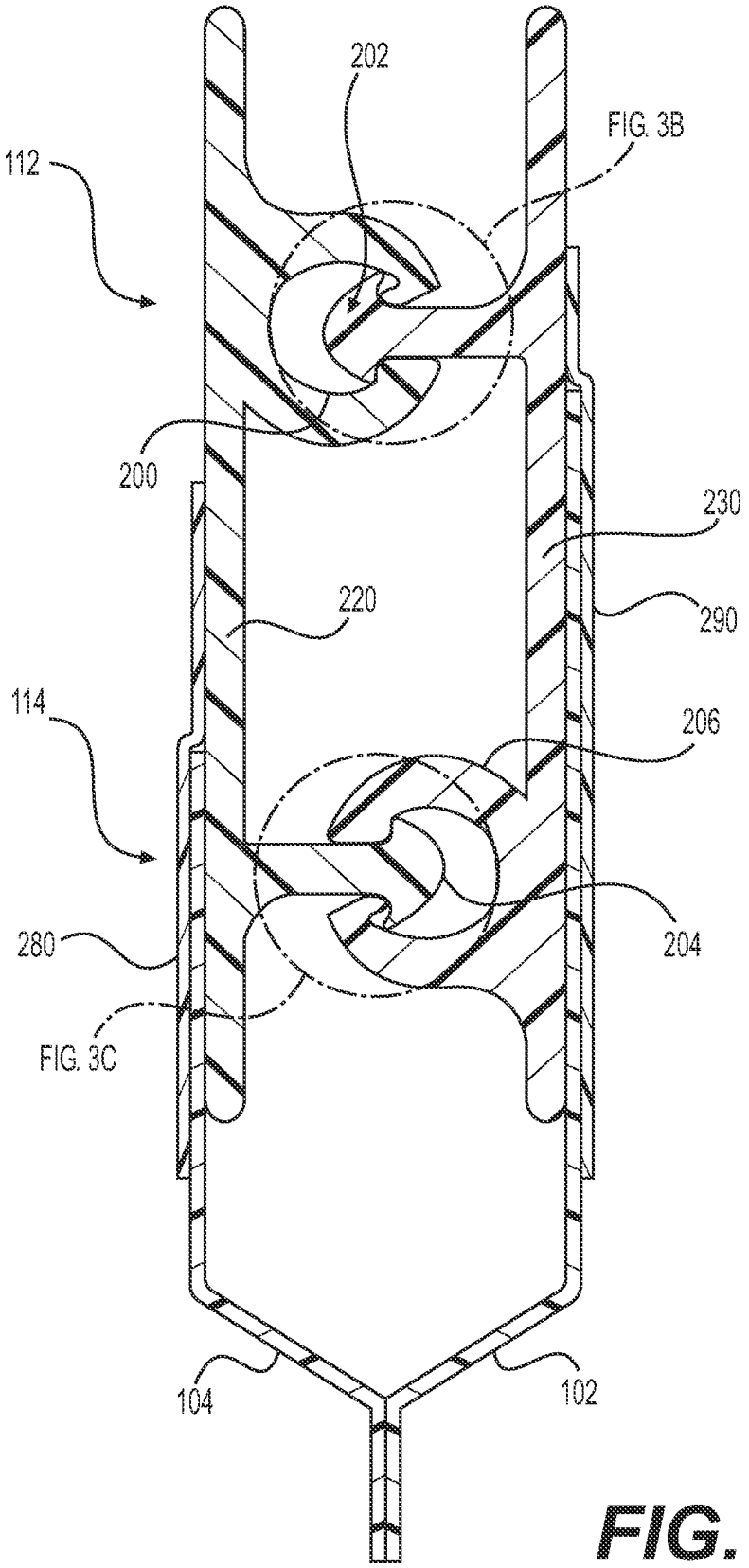
FIG. 3E is a partial cross-sectional view taken along line 3E-3E of FIG. 1 of the elongate double zipper profile of FIG. 3D showing an embodiment for attaching the double zipper profile to the sidewalls of the bag of FIG. 1.

FIG. 3D illustrates an alternative embodiment of the double zipper profile shown in FIG. 3A. In particular, the double zipper profile depicted in FIG. 3D includes the first and second closure elements 200, 202 of the upper zipper profile 112 shown in FIG. 3A, as well as the third and fourth closure elements 204, 206 of the lower zipper profile 114 shown in FIG. 3A. The double zipper profile depicted in FIG. 3D also includes the first and second isolation sections 220, 230 shown in FIG. 3A. The double zipper profile displayed in FIG. 3D, however, removes the first and second backing members 210, 212 below the lower zipper profile 114. Thus, the double zipper profile displayed in FIG. 3D can be an extension or part of the sidewalls 102, 104 of the bag 100, or can be connected to top edges of the sidewalls 102, 104, respectively. In this regard, FIG. 3E illustrates an embodiment for connecting the double zipper profile shown in FIG. 3D to the sidewalls 102, 104 of the bag 100. Specifically, the sidewall 104 of the bag 100 is connected to at least a portion of the lower zipper profile 114 via a first connection mechanism 280 (e.g., hot melt glue strip, contact adhesive, or thermal welding) that overlays the sidewall 104 and at least a portion of the lower zipper profile 114. The sidewall 102 of the bag 100 is connected to the lower zipper profile 114 and at least a portion of the upper zipper profile 112 via a second connection mechanism 290 (e.g., hot melt glue strip, contact adhesive, or thermal welding) that overlays the sidewall 102 and at least a portion of the upper zipper profile 112 and a portion of the lower zipper profile 114. However, the specific shape and configuration of the first and second connection mechanisms 280, 290 can be altered without departing from the spirit of the invention and can include any other type of connection mechanism feasible to connect the zipper profile(s) to the sidewalls, including, for example, a hot melt glue strip, contact adhesive, thermal welding, etc. In another embodiment, for example, the first and second connection mechanisms 280, 290 may be positioned between the double zipper profile shown in FIG. 3D and the sidewalls 102, 104, respectively.

One embodiment of a slider 120, which is illustrated in FIGS. 4A through 6C, includes first and second opposing sidewalls 122, 124 extending from a top wall 130 defining a channel therebetween in which a double zipper, such as the closure elements 200-206 of the zipper profiles 112, 114 of FIG. 3A, can be operatively accepted. The slider 120 depicted in FIGS. 4A through 6C further includes shoulders 140, 142 at the end of the respective sidewalls 122, 124 that lie underneath the third and fourth closure elements 204, 206, respectively, of the lower zipper profile 114. The slider 120 also includes a separator finger 132 that extends from the top wall 130 of the slider 120 to a bulge 134. The bulge 134 of the separator finger 132 engages with the isolation sections 220, 230 in order to de-occlude the closure elements of the zipper profiles 112, 114.

As illustrated in FIGS. 4A and 4B, as the slider 120 moves from a closing end to an opening end of the zipper profiles 112, 114 (e.g., from left to right in FIG. 1), the bulge engages with the closure elements 200-206 of the zipper profiles 112, 114. As shown in FIG. 4A, the aggressive hooking angles of the closure elements 200-206 of the upper and lower zipper profiles 112, 114, as discussed above, initially keep the closure elements 200-206 together despite the internal wedging action of the bulge 134 of the separator finger 132. As shown in FIG. 4B, however, as the bulge 134 moves into the area of the first and second isolation sections 220, 230, such that the peak width of the bulge 134 is between the first and second closure elements 200, 202 and the third and fourth closure elements 204, 206, the internal wedging action of the bulge has increased to a point that the less aggressive hooks of the closure elements fail and allow the zipper profiles 112, 114 to separate. Accordingly, at its peak width, the bulge 134 of the separator finger 132 forces the zipper profiles 112, 114 apart and thus, completely opens and separates both of the zipper profiles 112, 114.

Figure 5C:
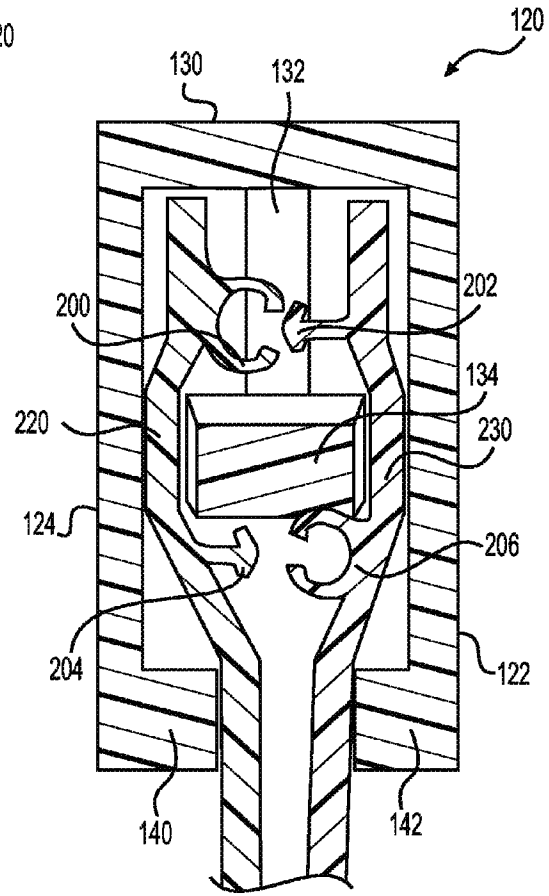
FIG. 5C is a partial cross-sectional view taken along line 5C-5C of FIG. 2 of the elongate double zipper profile of FIG. 3A showing the separator finger of the slider of FIG.
Figure 5B:
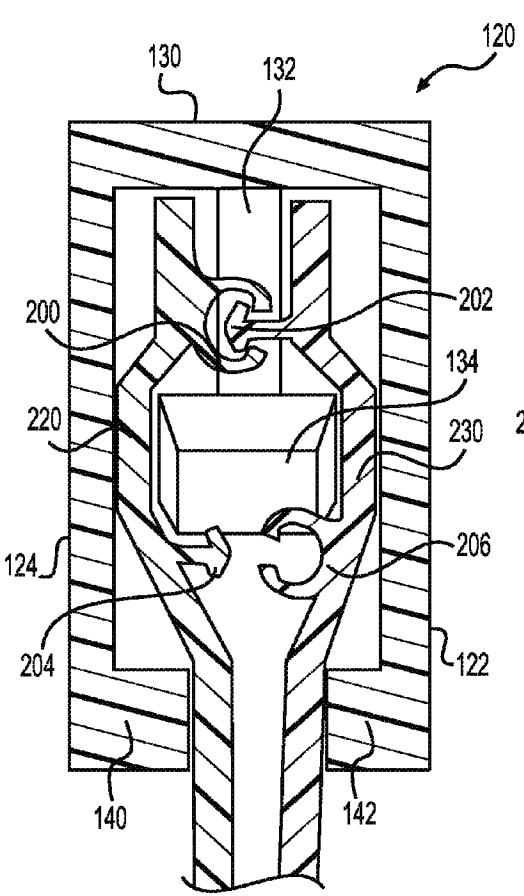
FIG. 5B is a partial cross-sectional view taken along line 5B-5B of FIG. 2 of the elongate double zipper profile of FIG. 3A showing the separator finger of the slider of FIG. 5A with the downward bias, such that the lower zipper profile of the double zipper profile of FIG. 3A is de-occluded first.
Figure 5A:
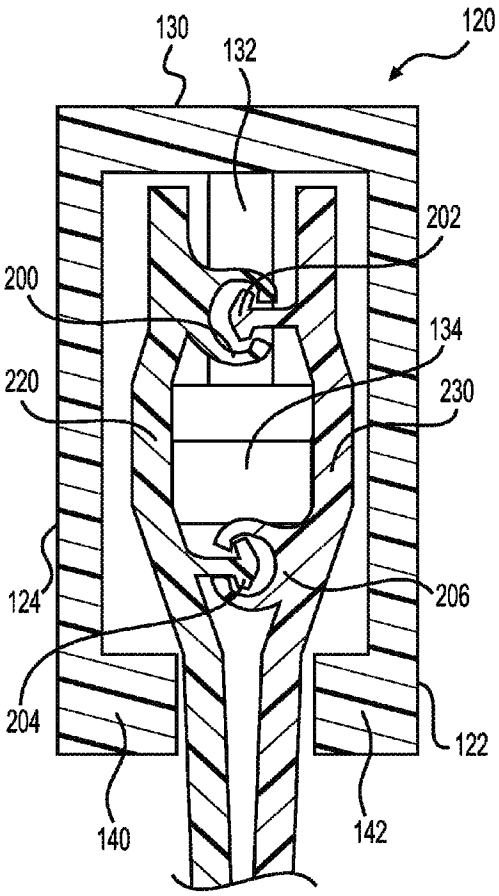
FIG. 5A is a partial cross-sectional view taken along line 5A-5A of FIG. 1 of the elongate double zipper profile of FIG. 3A showing an embodiment of a separator finger of the slider of FIG. 4A with a downward bias.

The embodiment depicted in FIGS. 4A and 4B addresses the opening of the closure elements 200-206 via the bulge 134 of the separator finger 132 at about the same time. In this regard, the bulge 134 of the separator finger 132 depicted in FIGS. 4A and 4B is positioned in the area between the first and second closure elements 200, 202 and the third and fourth closure elements 204, 206 (e.g., between the first and second isolation sections 220, 230), such that the bulge 134 is substantially parallel to the first and second closure elements 200, 202 and the third and fourth closure elements 204, 206. FIGS. 5A-5C, however, illustrate an embodiment for opening the third and fourth closure elements 204, 206 prior to opening the first and second closure elements 200, 202, while FIGS. 6A-6C illustrate an embodiment for opening the first and second closure elements 200, 202 prior to opening the third and fourth closure elements 204, 206. In particular, the bulge 134 at the end of the separator finger 132 is slightly biased downwardly toward the third and fourth closure elements 204, 206 in FIGS. 5A-5C, such that, as the separator finger 132 moves from a closing end to an opening end of the zipper profiles 112, 114, the third and fourth closure elements 204, 206 will be de-occluded via the bulge 134 prior to the de-occlusion of the first and second closure elements 200, 202. FIG. 5A illustrates the downwardly biased bulge 134 of the separator finger 132 of this embodiment, prior to any de-occlusion of the closure elements 100-106. FIG. 5B illustrates the downwardly biased bulge 134 of the separator finger 132 initially opening the third and fourth closure elements 204, 206 of the lower zipper profile 114, while the first and second closure elements 200, 202 of the upper zipper profile 112 remain occluded. At some point, however, such as, for example, once the peak width of the bulge 134 enters the area between the zipper profiles 112, 114, as shown in FIG. 5C, the less aggressive hooks of the first and second closure elements 200, 202 will fail and allow the first and second closure elements 200, 202 to separate.

The bulge 134 at the end of the separator finger 132 can be slightly biased upwardly, as shown in FIGS. 6A-6C, such that, as the separator finger 132 moves from a closing end to an opening end of the zipper profiles 112, 114, the first and second closure elements 200, 202 will be de-occluded via the bulge 134 prior to the de-occlusion of the third and fourth closure elements 204, 206. FIG. 6A illustrates the upwardly biased bulge 134 of the separator finger 132 of this embodiment, prior to any de-occlusion of the closure elements 100-106. FIG. 6B illustrates the upwardly biased bulge 134 of the separator finger 132 initially opening the first and second closure elements 200, 202 of the upper zipper profile 112, while the third and fourth closure elements 204, 206 of the lower zipper profile 114 remain occluded. At some point, however, such as, for example, once the peak width of the bulge 134 enters the area between the zipper profiles 112, 114, as shown in FIG. 6C, the less aggressive hooks of the third and fourth closure elements 204, 206 will fail and allow the third and fourth closure elements 204, 206 to separate. Accordingly, varying the direction or bias and/or the width of the bulge 134 of the separator finger 132 can impact when the zipper profiles are opened, as well as how the zipper profiles are opened.

FIG. 7A shows another embodiment of a double zipper profile. In this embodiment, an upper zipper profile includes a first closure element 300 and a second closure element 302, and a lower zipper profile includes a third closure element 304 and a fourth closure element 306. The first closure element 300 and the third closure element 304 are provided on a first backing member 303, while the second closure element 302 and the fourth closure element 306 are provided on an opposing second backing member 305. In one embodiment, the backing members 303, 305 are connected to top edges of the sidewalls 102, 104, respectively, and in another embodiment, the backing members 303, 305 are simply extensions or part of the sidewalls 102, 104. In the embodiment shown in FIG. 7A, the first and fourth closure elements 300, 306 have female C-shaped interlocking profiles, and the second and third closure elements 302, 304 have male double hook arrow interlocking profiles. However, the specific shape and configuration of the individual closure elements 300, 302, 304, and 306 can be altered without departing from the spirit of the invention.

In the embodiment shown in FIG. 7A, the zipper profiles further include a first rib member 310 and a second rib member 312. The first rib member 310 is a non-interlocking rib or ridge, which does not interlock with, for example, the second rib member 312 or a complementary interlocking member. The first rib member 310 is disposed on an interior surface of the first backing member 303 and between the first closure element 300 and the third closure element 304, while the second rib member 312 is disposed on an interior surface of the second backing member 305 and between the second closure element 302 and the fourth closure element 306. As also shown in FIG. 7A, a first isolation section 320 extends between the first closure element 300 and the first rib member 310 on the first backing member 303, and a second isolation section 330 extends between the second closure element 302 and the second rib member 312 on the second backing member 305.

FIG. 7B is an enlarged partial cross-sectional view of the closure elements of the lower zipper profile of FIG. 7A. In particular, the third closure element 304 includes an upper portion 304A, while the fourth closure element 306 also includes an upper portion 306A. In contrast to the closure elements of the lower zipper profile 114 shown in FIG. 3A, the upper portions 304A and 306A do not comprise hooks. Specifically, upper portions 304A and 306A lack the upper hooks 204A and 206A of the closure elements of the lower zipper profile 114 shown in FIGS. 3A and 3C. By removing the hooks from the upper portions 304A and 306A, the upper portions 304A and 306A will weakly mate and thus, a lower internal opening force will be needed, as discussed above, to open the upper portions 304A and 306A of the third and fourth closure elements 304, 306.

The zipper profiles can further include a means for maintaining a slider in straddling relation with the zipper profiles. In the embodiment shown in FIG. 7A, the means includes ridges 340, 350 provided on outer surfaces of the first and second backing members 303, 305, respectively. The ridges 340, 350 can engage with shoulders provided on a slider, such that the shoulders of the slider grasp the lower surfaces of the ridges 340, 350. The ridges 340, 350 can extend along the length of the outer surfaces of the first and second backing members 303, 305, at a point below the first and second rib members 310, 312. In addition, the ridges 340, 350 can be attached to the zipper profiles by any desired means, such as, for example, by extruding with the zipper profiles, heating, gluing, or snapping in place. The ridges 340, 350 can also result from differences in thicknesses between the zipper profiles on the bag.

FIG. 8A illustrates another embodiment of a double zipper profile according to the present invention, in which similar structures are designated with similar reference numbers. The double zipper profile shown in FIG. 8A includes a first rib member 314 disposed on an interior surface of a first backing member, and a second rib member 315 disposed on an interior surface of a second backing member. The zipper profiles also include a first closure element 300', a second closure element 302', a third closure element 304', and a fourth closure element 306', where the first and fourth closure elements 300', 306' have female C-shaped interlocking profiles, and the second and third closure elements 302', 304' have male double hook arrow interlocking profiles. However, the specific shape and configuration of the individual closure elements 300', 302', 304', and 306' can be altered without departing from the spirit of the invention. The first rib member 314 is a non-interlocking rib or ridge, which does not interlock with, for example, the second rib member 315 or a complementary interlocking member. The first rib member 314 is disposed between the first closure element 300' and the third closure element 304', and the second rib member 315 is disposed between the second closure element 302' and the fourth closure element 306'.

FIG. 8B depicts a partial cross-sectional view of the closing end of the double zipper profile shown in FIG. 8A. In particular, the first and second rib members 314, 315 depicted in FIG. 8A have been deformed at the closing end of the zipper profiles, such that a first deformed rib member 316 is disposed on the interior surface of the first backing member and between the first closure element 300' and the third closure element 304', and a second deformed rib member 318 is disposed on the interior surface of the second backing member and between the second closure element 302' and the fourth closure element 306'. The first deformed rib member 316 is a non-interlocking rib or ridge, which does not interlock with, for example, the second deformed rib member 318 or a complementary interlocking member. The first and second deformed rib members 316, 318 allow for a slider to sit at the closing end of the zipper profiles without de-occluding the lower zipper profile, as explained in more detail below.

The various rib members may be formed by extruding a desired shaped profile onto the respective backing members. The rib members in other embodiments may have different shapes, such as round, oval, square, or a non-geometric shape; and in yet other embodiments, the rib members may be offset rather than being in opposing relation.

FIG. 9A illustrates an embodiment of the slider 120, which is depicted in FIGS. 4A through 6C, including first and second opposing sidewalls 122, 124 extending from a top wall 130 defining a channel therebetween in which the double zipper profile shown in FIG. 7A can be operatively accepted. The slider 120 further includes shoulders 140, 142 at the end of the respective sidewalls 122, 124 that lie underneath the ridges 340, 350 of the respective backing members. The slider 120 also includes a separator finger 132 that extends from the top wall 130 of the slider 120. The separator finger 132 engages with the first rib member 310 of the zipper profiles in order to de-occlude the zipper profiles. Specifically, the first rib member 310 extends from the interior surface of the backing member to a point where the first rib member 310 intersects an opposing side of the separator finger 132. The height of the first rib member 310 needs to exceed an operational range of the zipper profiles, such that the first rib member 310 extends the effective width of the separator finger 132 allowing for the de-occluding of the zipper profiles by the separator finger 132. In this embodiment, the separator finger 132 can be configured with a narrow width, such that the separator finger 132 will have no outwardly pushing force on the closure elements. Accordingly, the interaction of the first rib member 310 with the separator finger 132 enables the separator finger 132 to reach the width needed to de-occlude the closure elements of the zipper profiles via a wedging action.

FIG. 9B illustrates an embodiment of the slider 120, which is depicted in FIGS. 4A through 6C, including first and second opposing sidewalls 122, 124 extending from a top wall 130 defining a channel therebetween in which the double zipper profile shown in FIG. 8A can be operatively accepted. The slider 120 also includes separator finger 132 that engages with the first and second rib members 314, 315 of the zipper profiles in order to de-occlude the zipper profiles. Specifically, the first and second rib members 314, 315 extend from the interior surfaces of the respective backing members to a point where the first and second rib members 314, 315 intersect opposing sides of the separator finger 132. The height of the first and second rib members 314, 315 needs to exceed an operational range of the zipper profiles, such that the first and second rib members 314, 315 extend the effective width of the separator finger 132 allowing for the de-occluding of the zipper profiles by the separator finger 132. In this embodiment, the separator finger 132 can again be configured with a narrow width, such that the separator finger 132 will have no outwardly pushing force on the closure elements. Thus, the interaction of the first and second rib members 314, 315 with the separator finger 132 enables the separator finger 132 to reach the width needed to de-occlude the closure elements of the zipper profiles via a wedging action.

FIG. 9C illustrates the closing end of the double zipper profile shown in FIGS. 8A and 8B. In particular, FIG. 9C depicts the interaction of the first and second deformed rib members 316 and 318 with the separator finger 132 of the slider 120. As shown in FIG. 9C, at the closing end of the zipper profiles, the first and second deformed rib members 316, 318 extend from the interior surfaces of the respective backing members to a point where the first and second deformed rib members 316, 318 intersect opposing sides of the separator finger 132. The height of the first and second deformed rib members 316, 318, however, does not exceed an operational range of the zipper profiles. Thus, the first and second deformed rib members 316, 318 do not extend the effective width of the separator finger 132 allowing for the de-occluding of the lower zipper profile by the separator finger 132. Since the separator finger 132 is unable to de-occlude the lower zipper profile via the interaction with the first and second deformed rib members 316, 318, the lower zipper profile remains occluded at the closing end of the zipper profiles, as illustrated in FIG. 9C. The disabling of the wedging action via the separator finger 132 at the closing end of the bag provides for reduced leakage by keeping the lower zipper profile occluded at the closing end of the zipper profiles.

FIGS. 10A-12 illustrate one embodiment of a slider 400 that includes first and second opposing faces 402, 404 extending from a top wall 401 defining a channel therebetween in which a double zipper, such as the zipper profiles of FIG. 7A, can be operatively accepted. The first opposing face 402 includes an arcuate portion 403 that is filled-in with a material forming the slider. The second opposing face 404 also includes a similar arcuate portion that is not shown in FIG. 10A. Although the arcuate portion 403 is filled-in in the embodiment shown in FIG. 10A, the arcuate portion 403 could alternatively be hollow or partially filled-in. In addition, the arcuate portion 403 can be an ellipse or have an oval shape, as shown in, for example, FIG. 10A. However, the arcuate portion 403 could be of a different shape, such as, for example, a circular, rectangular, or square shape or any other polygonal shape, etc., since the specific shape and configuration of the opposing faces and/or arcuate portions can be altered without departing from the spirit of the invention.

As shown in FIGS. 10A and 10B, the slider 400 includes a central protrusion, such as a separator finger 410, that extends from the top wall 401 into the channel spaced between the first and second opposing faces 402, 404. The separator finger 410 includes a first end 420 and a second end 415, as well as a C-shaped indentation 412 near the second end 415 of the separator finger 410. The C-shaped indentation 412 results in a bulge 414 on the side of the separator finger 410 opposing the C-shaped indentation 412. The bulge 414, which is also near the second end 415, gently separates the closure elements of the double zipper profile. In particular, in a preferred embodiment, the bulge 414 gently separates the closure elements of a lower zipper profile of the double zipper profile.

FIGS. 10C-10E illustrate alterative embodiments for the separator finger 410 of the slider 400. In particular, FIG. 10C depicts the separator finger 410 comprising a two C-shaped indentations. As shown in FIG. 10C, the separator finger 410 includes the C-shaped indentation 412 and opposing bulge 414 shown in FIG. 10B, along with a second C-shaped indentation 418 with an opposing bulge 416 near the second end 415. FIG. 10D illustrates the separator finger 410 comprising a Y-shaped protrusion with a first portion 422 and a second portion 424 extending from the separator finger 410 for separating the closure elements of the double zipper profile. FIG. 10E illustrates an additional embodiment for the separator finger 410. As shown in FIG. 10E, the separator finger 410 includes a curved protrusion 425 similar to a hook shape that is capable of separating the closure elements of the double zipper profile. In addition to the embodiments shown in FIGS. 10A-10E, the separator finger 410 could be of a different shape, since the specific shape and configuration of the separator finger 410 can be altered without departing from the spirit of the invention.

FIG. 11 illustrates an embodiment of the slider 400 shown in FIGS. 10A and 10B operatively engaged on the double zipper profile shown in FIG. 7A. As shown in FIG. 11, the first and second closure elements 300, 302 of the upper zipper profile are disposed underneath the top wall 401 of the slider 400. The separator finger 410 is disposed in the area between the first and second closure elements 300, 302 of the upper zipper profile and the third and fourth closure elements 304, 306 of the lower zipper profile. In particular, the second end 415 of the separator finger 410 is disposed adjacent to the first and second rib members 310, 312, such that the C-shaped indentation 412 and/or bulge 414 of the separator finger 410 will interact with the first and second rib members 310, 312. The separator finger 410, however, does not extend to a point between or below the third and fourth closure elements 304, 306 of the lower zipper profile. The slider 400 can further include L-shaped shoulders 450, 460 that extend underneath the ridges 340, 350, respectively, of the lower zipper profile, in order to maintain the slider 400 in straddling relation with the zipper profiles. The first opposing face 402 of the slider 400 extends from the top wall 401 to a first bottom portion 430, while the second opposing face 404 of the slider 400 extends from the top wall 401 to a second bottom portion 440. The L-shaped shoulders 450, 460 are attached to the first and second bottom portions 430, 440, respectively.

Referring to FIG. 11, when the slider 400 operatively moves, such as by being slid by a user, along the zipper profiles in an occluding direction, i.e., toward a closing end, a first closure bar 470 and a second closure bar 480 occlude the first and second closure elements 300, 302, respectively. The L-shaped shoulders 450, 460 assist in occluding the third and fourth closure elements 304, 306. When the slider 400 operatively moves in a de-occluding direction, i.e., toward an opening end, the first end 420 of the separator finger 410 de-occludes the first and second closure elements 300, 302 by extending therebetween and the second end 415 forces apart the third and fourth closure elements 304, 306 by pressing outwardly against the first rib member 310. As discussed above, the interaction of the first rib member 310 with the separator finger 410 enables the separator finger 410 to reach the width necessary to de-occlude the third and fourth closure elements 304, 306 via a wedging action.

FIG. 12 shows an embodiment of the slider 400 shown in FIGS. 10A and 10B being operatively engaged on the bag 100 shown in FIG. 1. As illustrated in FIG. 12, the slider 400 maintains a straddling relation with the upper and lower zipper profiles 112, 114, such that the separator finger 410 and the C-shaped indentation 412 of the separator finger 410 are disposed in the area (e.g., isolation section) between the upper zipper profile 112 and the lower zipper profile 114. In the embodiment shown in FIG. 12, a detent 500 is included at one end of the bag in the isolation section 320 (see, e.g., FIG. 13) between the upper and lower zipper profiles 112, 114. The detent 500 comprises an indentation that is capable of engaging with the C-shaped indentation 412 of the separator finger 410. The engagement of the C-shaped indentation 412 of the separator finger 410 with the detent 500 ensures that the C-shaped indentation 412 of the separator finger 410 is not positioned in the isolation section between the upper and lower zipper profiles 112, 114, in such a manner that the separator finger 410 de-occludes the lower zipper profile 114 at the end of the bag 100. Accordingly, the engagement of the C-shaped indentation 412 of the separator finger 410 with the detent 500 can provide an end seal that prevents leakage, by ensuring that at least the lower zipper profile is completely occluded along the length of the bag. The detent 500 must therefore, be positioned a predetermined distance from at least the lower zipper profile 114 to ensure an accurate engagement with the C-shaped indentation 412 of the separator finger 410. In one embodiment, the detent 500 is disposed in a position that is between at least about 60 mils and about 187.5 mils from the lower zipper profile 114. Moreover, in another embodiment, the detent 500 must be within 400 mils of the edge (e.g., 106) of the bag 100 to ensure proper occlusion of at least the lower zipper profile 114 at the end of the bag 100. The engagement of the C-shaped indentation 412 of the separator finger 410 with the detent 500 can further provide a tactile sensation to a user and/or an audible click, thus assuring the user that the bag is sealed closed. By further tapering the structure of the C-shaped indentation 412, such that the C-shaped indentation 412 is thinner near the bottom of the indentation and thicker at the top of the indention, the structural integrity of the separator finger 410 is maintained, while providing a maximum audio/haptic experience to a user via the engagement of the C-shaped indentation 412 with the detent 500. Although this embodiment has a detent 500 on only one end of the bag, the invention also encompasses detents on either one or both ends of the bag.

FIG. 13 is an enlarged partial cross-sectional view of the detent 500 included on the bag shown in FIG. 12. As shown in FIG. 13, the detent 500 is disposed on the first isolation section 320 between the first closure element 300 of the upper zipper profile and the third closure element 304 of the lower zipper profile, such that the detent 500 partially deforms the first rib member 310 of the double zipper profile illustrated in FIG. 7A. By way of example, the detent 500 can be formed into the first isolation section 320 of the double zipper profile using a punch and die assembly. Alternatively, the detent 500 can be formed by cutting, cold stomping, ultrasonic stomping, molding, or any other method for deforming thermoplastic material.

FIG. 14 shows another embodiment of the slider 400 shown in FIGS. 10A and 10B being operatively engaged on the bag 100 shown in FIG. 1. As illustrated in FIG. 14, a plurality of detents 501, 502 is included on both ends of the bag 100 in the area (e.g., isolation section) between the upper and lower zipper profiles 112, 114. The detents 501, 502 comprise indentations that are capable of engaging with the C-shaped indentation 412 of the separator finger 410. In addition, the detents 501, 502 can provide a holding spot for a user when the user is sliding the slider 400 in either direction on the zipper profiles of the bag 100. In particular, the detents 501, 502 can be provided with various convexities, such that one of the detents in the plurality of detents 501 is of a convexity that engages with the C-shaped indentation 412 of the separator finger 410. The other detents of the plurality of detents 501, 502, however, can be of the opposite convexity, such that these detents do not engage with the C-shaped indentation 412 of the separator finger 410, but do provide a holding spot for a user when sliding the slider 400 on the bag 100. As discussed above, the engagement of the C-shaped indentation 412 of the separator finger 410 with one of the detents in the plurality of detents 501 can provide an effective end seal, as well as a tactile sensation to a user and/or an audible click, thus assuring the user that the bag is sealed closed. Although this embodiment has three detents 501, 502 on both ends of the bag, the invention also encompasses any number of detents on either one or both ends of the bag. As discussed above, the detents 501, 502 can be formed using a punch and die assembly. Alternatively, the detents 501, 502 can be formed by cutting, ultrasonic stomping, molding, or any other method for deforming thermoplastic material.

FIG. 15A shows another embodiment of a double zipper profile. In this embodiment, an upper zipper profile includes a first closure element 600 and a second closure element 602, and a lower zipper profile includes a third closure element 604 and a fourth closure element 606. The first closure element 600 and the third closure element 604 are provided on a first backing member 620, while the second closure element 602 and the fourth closure element 606 are provided on an opposing second backing member 630. In one embodiment, the backing members 620, 630 are connected to top edges of the sidewalls 102, 104, respectively, and in another embodiment, the backing members 620, 630 are simply extensions or part of the sidewalls 102, 104. In the embodiment shown in FIG. 15A, the first and fourth closure elements 600, 606 have male double hook arrow interlocking profiles, and the second and third closure elements 602, 604 have female C-shaped interlocking profiles. However, the specific shape and configuration of the individual closure elements 600, 602, 604, and 606 can be altered without departing from the spirit of the invention.

In the embodiment shown in FIG. 15A, the zipper profiles further include a first retention member 610 and a second retention member 612. The first retention member 610 is disposed on an interior surface of the first backing member 620 and between the first closure element 600 and the third closure element 604, while the second retention member 612 is disposed on an interior surface of the second backing member 630 and between the second closure element 602 and the fourth closure element 606. The first and second retention members 610, 612 are configured to retain a slider operatively engaged on the double zipper profile by engagement with a separator finger provided with the slider, as shown, for example, in FIG. 15C.

FIG. 15B shows an embodiment of a slider 700 being operatively engaged on another embodiment of a bag 650. The bag 650 of this embodiment also includes an upper zipper profile 660 and a lower zipper profile 670. As illustrated in FIG. 15B, the slider 700 includes a separator finger 710 (as shown in FIGS. 15C and 15D) with a bulge 712 at an opening end 705 of the slider 700 and a tail 720 at a closing end 706 of the slider 700. The slider 700 maintains a straddling relation with the upper and lower zipper profiles 660, 670, such that the bulge 712 and the tail 720 of the separator finger 710 are disposed between the upper zipper profile 660 and the lower zipper profile 670.

FIG. 15C illustrates a cross-sectional view of the slider 700 on the double zipper profile of FIG. 15A at the opening end 705 of the slider 700. The slider 700 includes first and second opposing sidewalls 702, 704 extending from a top wall 701 defining a channel therebetween in which the double zipper profile shown in FIG. 15A can be operatively accepted. The slider 700 also includes separator finger 710 that extends from the top wall 701 of the slider 700 to the bulge 712. The bulge 712 of the separator finger 710 includes a first hook member 714 and a second hook member 715. The first and second hook members 714, 715 of the bulge 712 interact with the first and second retention members 610, 612 of the double zipper profile in order to provide for vertical retention of the slider.

FIG. 15D illustrates a cross-sectional view of the slider 700 on the double zipper profile shown in FIG. 15A at the closing end 706 of the slider 700. The separator finger 710 of the slider includes the tail 720 at the closing end 706 of the slider 700. The tail 720 of the separator finger 710 includes a first hook member 724 and a second hook member 725. The first and second hook members 724, 725 of the tail 720 also interact with the first and second retention members 610, 612 of the double zipper profile in order to provide for vertical retention of the slider. By providing a set of hooks at both the opening end 705 and the closing end 706 of the slider 700 that engage with first and second retention members 610, 612 provided on the double zipper profile, the force required to remove the slider 700 from the bag can be increased.

FIG. 16 shows another embodiment of a slider 800 being operatively engaged on the bag 100 shown in FIG. 1. As illustrated in FIG. 16, the slider 800 maintains a straddling relation with the upper and lower zipper profiles 112, 114 of the bag 100. The slider 800 in this embodiment is designed to open and to close the upper and lower zipper profiles 112, 114 simultaneously in the same vertical plane. In particular, the slider 800 includes a separator finger 802 and a closing bar 804 that both extend vertically from a top wall 801 of the slider 800. The separator finger 802 is vertically placed, such that the separator finger 802 will open the upper and lower zipper profiles 112, 114 at the same time in the same vertical plane. The closing bar 804 is also vertically positioned, such that the closing bar 804 will close the upper and lower zipper profiles 112, 114 at the same time in the same vertical plane. The vertical orientation of both the separator finger 802 and the closing bar 804 allows for simplifying the molding process. In addition, both the separator finger 802 and the closing bar 804 extend vertically from the top wall 801 of the slider 800 to the bottom of the slider 800, which ensures opening and closing functionality, respectively, even with any positional variation of the upper and lower zipper profiles 112, 114 within the slider. The horizontal distance between the separator finger 802 and the closing bar 804 can also be expanded to achieve a more gradual spreading action to minimize deformation caused by creep.

FIGS. 17A and 17B illustrate further embodiments of sliders 900 and 1000 being operatively engaged on the bag 100 shown in FIG. 1, respectively. As illustrated in FIGS. 17A and 17B, the sliders 900 and 1000 maintain a straddling relation with the upper and lower zipper profiles 112, 114 of the bag 100. The sliders 900 and 1000 in these embodiments are designed for offset opening and closing of the upper and lower zipper profiles 112, 114. Offset opening and closing of the zipper profiles indicates that the opening and closing of the upper and lower zipper profiles 112, 114 occur at different times along the same vertical plane, or occur at the same time in different vertical planes. By utilizing a slider configured for offset opening and closing of a double zipper profile, vertical slider retention can be improved, bag leakage can be reduced, slider stability can be increased, and the sequence in which the upper and lower zipper profiles open and close can be controlled.

The slider 900 of FIG. 17A is configured to sequentially open and close the upper and lower zipper profiles 112, 114. In particular, the slider 900 includes a vertical separator finger 902 that extends vertically from a top wall 901 of the slider 900 to a horizontal separator finger 903 that is attached to a bottom end of the vertical separator finger 902. The vertical separator finger 902 and the horizontal separator finger 903 form an L-shaped configuration that allows for the lower zipper profile 114 to be opened before the upper zipper profile 112 via the horizontal separator finger 903. In particular, as the slider 900 moves towards an opening end or right side of the bag 100, the horizontal separator finger 903 de-occludes the closure elements of the lower zipper profile 114 before the vertical separator finger 902 de-occludes the closure elements of the upper zipper profile 112. The horizontal separator finger 903 can be configured to penetrate only the upper zipper profile 112 and thus, be disposed between the upper zipper profile 112 and the lower zipper profile 114. In such a configuration, the horizontal separator finger 903 can include a bulge or C-shaped indentation (as shown in FIGS. 10A and 10B) in order to open the lower zipper profile 114. Alternatively, a first and/or second rib member (as shown in FIGS. 7A and 8A) can be included between the upper zipper profile 112 and the lower zipper profile 114 to interact with the horizontal separator finger 903 and assist in de-occluding the lower zipper profile 114.

The slider 900 of FIG. 17A further includes an upper closing bar 904 and a lower closing bar 905. The upper closing bar 904 is disposed over the upper zipper profile 112 in order to close the upper zipper profile 112, while the lower closing bar 905 is disposed over the lower zipper profile 114 in order to close the lower zipper profile 114. As shown in FIG. 17A, the upper closing bar 904 is horizontally spaced from the lower closing bar 905 in order to allow for offset closing of the upper and lower zipper profiles 112, 114. In particular, as the slider 900 moves towards a closing end or left side of the bag 100, the upper closing bar 904 occludes the closure elements of the upper zipper profile 112 before the lower closing bar 905 occludes the closure elements of the lower zipper profile 114.

The slider 1000 of FIG. 17B is also configured to sequentially open and close the upper and lower zipper profiles 112, 114. In particular, the slider 1000 includes a vertical separator finger 1002 that extends vertically from a top wall 1001 of the slider 1000 to a horizontal separator finger 1003 that is attached to a bottom end of the vertical separator finger 1002. Similarly to the slider 900, the vertical separator finger 1002 and the horizontal separator finger 1003 of the slider 1000 form an L-shaped configuration. The horizontal separator finger 1003 of the slider 1000, however, is disposed between the upper zipper profile 112 and the lower zipper profile 114. In addition, the vertical separator finger 1002 is of a shape that is wider along the portion that is disposed adjacent to the upper zipper profile 112 and is narrower along the portion that is disposed adjacent to the lower zipper profile 114. The configuration of the vertical separator finger 1002 allows for the upper zipper profile 112 to be opened before the lower zipper profile 114 via the vertical separator finger 1002. In particular, as the slider 1000 moves towards an opening end or right side of the bag 100, the vertical separator finger 1002 de-occludes the closure elements of the upper zipper profile 112 before the horizontal separator finger 1003 de-occludes the closure elements of the lower zipper profile 113.

The slider 1000 of FIG. 17B further includes an upper closing bar 1004 and a lower closing bar 1005. The upper closing bar 1004 is disposed over the upper zipper profile 112 in order to close the upper zipper profile 112, while the lower closing bar 1005 is disposed over the lower zipper profile 114 in order to close the lower zipper profile 114. As shown in FIG. 17B, the upper closing bar 1004 is horizontally spaced from the lower closing bar 1005 in order to allow for offset closing of the upper and lower zipper profiles 112, 114. In particular, as the slider 1000 moves towards a closing end or left side of the bag 100, the lower closing bar 1005 occludes the closure elements of the lower zipper profile 114 before the upper closing bar 904 occludes the closure elements of the upper zipper profile 112. While the closing bars of the sliders 900 and 1000 of FIGS. 17A and 17B are depicted as two individual pieces of material disposed over the respective zipper profile, the closing bars could alternatively be a single triangularly shaped closing bar that is disposed in a position to close either the upper zipper profile 112 first, or the lower zipper profile 114 first. In addition, the specific shape and/or configuration of the separator fingers and closing bars can be altered in order to provide for the desired sequential opening and closing of the closure elements of the double zipper profile without departing from the spirit of the invention.

FIGS. 18A and 18B illustrate further embodiments of sliders 2000 and 3000 being operatively engaged on the bag 100 shown in FIG. 1, respectively. As illustrated in FIGS. 18A and 18B, the sliders 2000 and 3000 maintain a straddling relation with the upper and lower zipper profiles 112, 114 of the bag 100. The sliders 2000 and 3000 in these embodiments are designed for multi-level slider retention on a bag 100 with a double zipper profile. Specifically, the slider 2000 of FIG. 18A includes first and second opposing sidewalls 2002, 2004 extending from a top wall defining a channel therebetween in which a double zipper, such as the zipper profiles 112, 114, can be operatively accepted. The slider 2000 depicted in FIG. 18A further includes an upper retention member 2010 and a lower retention member 2012 on an interior surface of the second opposing sidewall 2004 that lie underneath the upper zipper profile 112 and the lower zipper profile 114, respectively. The first opposing sidewall 2002 also includes similar upper and lower retention members that are not shown in FIG. 18A. The upper and lower retention members 2010, 2012 provide for two levels of slider retention, which thus increases the vertical retention of the slider 2000 on the bag 100 and prevents the slider 2000 from being pulled off of the zipper profiles and rendering the bag 100 inoperable. The slider 2000 can further include an end-stop 2020 at one or both ends of the zipper profiles that engages with the slider 2000, such as, for example, by including a detent feature that clips to a separator finger of the slider 2000, and prevents the slider 2000 from falling off of the ends of the zipper profiles.

The slider 3000 of FIG. 18B also includes first and second opposing sidewalls 3002, 3004 extending from a top wall defining a channel therebetween in which a double zipper, such as the zipper profiles 112, 114, can be operatively accepted. The slider 3000 depicted in FIG. 18B further includes an upper retaining foot 3010 and a lower retaining foot 3012 on an interior surface of the second opposing sidewall 3004 that lie underneath the upper zipper profile 112 and the lower zipper profile 114, respectively. The first opposing sidewall 3002 also includes similar upper and lower retaining feet that are not shown in FIG. 18B. The upper and lower retaining feet 3010, 3012 provide for two levels of slider retention, which thus increases the vertical retention of the slider 3000 on the bag 100 and prevents the slider 3000 from being pulled off of the zipper profiles and rendering the bag 100 inoperable. The upper and lower retaining feet 3010, 3012 can each comprise multiple retaining feet positioned along the interior surface of the respective opposing sidewall. Alternatively, the upper and lower retaining feet 3010, 3012 can each comprise a single retaining foot that extends along a portion of or the entire length of the interior surface of the respective opposing sidewall of the slider 3000. The slider 3000 can further include an end-stop 3020 at one or both ends of the upper zipper profile 112 that engages with the slider 3000, such as, for example, by including a detent feature that clips to a separator finger of the slider 3000, and prevents the slider 3000 from falling off of the ends of the zipper profiles.

FIGS. 19 and 20 are views of a bag 100' according to another embodiment of the invention. The bag 100' includes a first sidewall 102' and a second sidewall 104'. The first and second sidewalls 102' and 104' are connected along edges 106' and 108', and the first and second sidewalls 102' and 104' are also connected at a bottom edge 110' of the bag 100'. An opening 103' to the interior of the bag 100' is formed adjacent to an edge 116' that is defined by zipper profiles 112' and 114', as will be described below. The first and second sidewalls 102' and 104' may be made from a substantially transparent plastic, such as the plastics discussed below, thereby allowing the contents of the interior of the bag to be easily determined. Alternatively, the first and second sidewalls 102' and 104' can be made substantially opaque, or of a completely opaque material.

As also shown in FIGS. 19 and 20, a slider 120' is operatively engaged to the zipper profiles 112' and 114', so as to open and to close the opening 103' to the bag 100'. When the slider 120' is slid towards a closing end (e.g., left side of the bag 100' of FIG. 19), the opening 103' is closed by urging the opposing sidewalls 102', 104' together and occluding the zipper profiles 112', 114'. When the slider 120' is slid towards an opening end (e.g., right side of the bag 100' of FIG. 19), the opening 103' is opened by urging the opposing sidewalls 102', 104' apart and de-occluding the zipper profiles 112', 114'. As shown in FIG. 20, at least one end-stop 105' or sideweld can be included at one or both of the closing and opening ends of the bag 100', in order to prevent the slider 120' from coming off of the ends of the zipper profiles 112', 114'.

As shown in FIG. 21, an embodiment of a double zipper profile that can be included with the bag of FIG. 19, includes an upper zipper profile 112' with a first closure element 200' and a second closure element 202', and a lower zipper profile 114' with a third closure element 204' and a fourth closure element 206'. The first closure element 200' and the third closure element 204' are provided on a first backing member 210', while the second closure element 202' and the fourth closure element 206' are provided on an opposing second backing member 212'. The backing members 210' and 212' are substantially the same as those of the embodiment of the double zipper profile of FIG. 3A. In the embodiment shown in FIG. 21, the first and fourth closure elements 200', 206' have female C-shaped interlocking profiles, the second closure element 202' has a male double hook arrow interlocking profile, and the third closure element 204' has a male single hook arrow interlocking profile. In one embodiment, the distance that each of the first, second, third, and fourth closure elements 200', 202', 204', and 206' extends from their respective backing strip 210', 212' to a distal end of the respective closure element is in a range of about 25 mils to about 40 mils, with a preferred distance of about 28 mils for the first closure element 200' and the second closure element 202' of the upper zipper profile 112', and a preferred distance of about 32 mils for the third closure element 204' and the fourth closure element 206' of the lower zipper profile 114'. In addition, the portion of the backing strip 210', 212' behind each of the closure elements preferably has a thickness of about 5 mils to about 15 mils, or, more preferably, about 10 mils. Thus, in an occluded position, the preferred range for the overall thickness of both the occluded closure elements and the portions of the backing strip 210', 212' behind the respective occluded closure elements is about 45 mils to about 75 mils, or, more preferably, about 50 mils to about 58 mils for each of the occluded upper zipper profile 112' and the occluded lower zipper profile 114'. In other words, in the occluded position, the distance from a back side of the backing strip 210' to an opposing back side of the backing strip 212', between the occluded closure elements, is about 45 mils to about 55 mils, or, more preferably, about 50 mils for the occluded upper zipper profile 112', and about 52 mils for the occluded lower zipper profile 114'.

The double zipper profile depicted in FIG. 21 also includes first and second isolation sections 220', 230' that are substantially the same as those of the embodiment of the double zipper profile of FIG. 3A. Accordingly, as in the embodiment of FIG. 3A, the first and second isolation sections 220', 230' of FIG. 21 are provided such that the opening of the upper zipper profile 112' via a slider does not impact the opening of the lower zipper profile 114' via a slider, or vice versa. Moreover, as in the embodiment of FIG. 3A, the first and second isolation sections 220', 230' can be thinner than the zipper profiles 112', 114'. By providing first and second isolation sections 220', 230' with a thinner cross section than those of the closure elements of the zipper profiles 112', 114', the first and second isolation sections 220', 230' provide flexibility to the backbone of the double zipper profile. Thus, as in the embodiment of FIG. 3A, a thickness of the first and second isolation sections 220', 230' of less than 20 mils at a center-to-center spacing of about 200 mils between the closure elements of the upper and lower zipper profiles 112', 114' provides enough isolation and flexibility that any leverage applied by a separator finger to the first and second closure elements 200', 202' of the upper zipper profile 112' is insufficient to open the third and fourth closure elements 204', 206' of the lower zipper profile 114'. In particular, the first and second isolation sections 220', 230' may have a thickness of between about 1 mils and 15 mils, or more preferably about 5 mils and 10 mils. In addition, the first isolation section 220' may have a thickness that differs from that of the second isolation section 230'. For example, the first isolation section 220' may have a thickness of about 15 mils, while the second isolation section 230' has a thickness of about 5 mils, or vice versa. One having ordinary skill in this art will recognize, however, that the specific thickness and/or tolerances of the first and second isolation sections 220', 230' can be altered without departing from the spirit of the invention.

In the embodiment of FIG. 21, the length of the isolation sections 220', 230', which in turn relates to a center-to-center spacing or distance between the upper zipper profile 112' and the lower zipper profile 114', is preferably, from about 190 to about 210 mils, or more preferably, about 200 mils. However, the length of the isolation sections 220', 230' or the center-to-center spacing between the upper zipper profile 112' and the lower zipper profile 114' can be greater than 200 mils, e.g., up to about 350 mils or between about 280 mils and about 300 mils. In this regard, a distance of about 190 mils to about 210 mils between the upper zipper profile 112' and the lower zipper profile 114' allows for an effective positioning of a slider 120' with a separating mechanism, as discussed in more detail below, relative to the profiles 112', 114'. Moreover, the slider 120' is designed to function with the various profile dimensions discussed above, such that the position and function of the slider is set by the design and dimensions of the profiles 112', 114'.

In the embodiment of the double zipper profile of FIG. 21, the first closure element 200' is configured to have upper and lower hooks 200A', 200B' that are substantially the same as those of the embodiment shown in FIG. 3B, and the second closure element 202' includes upper and lower hooks 202A', 202B' that are substantially the same as those of the embodiment shown in FIG. 3B. Thus, as in the embodiment of FIG. 3B, the upper hooks 200A', 202A' are configured to have aggressive hooking angles (e.g., $\theta_A$, $\theta_B$, respectively, of FIG. 3B) to provide for a high external opening force. The upper hooks 200A', 202A' of the embodiment of FIG. 21 are preferably at an angle of 30 degrees to 90 degrees, or more preferably, at an angle of 40 degrees to 90 degrees, 50 degrees to 90 degrees, or 50 degrees to 85 degrees, or most preferably, at an angle of 60 degrees to 80 degrees, with respect to the portion of the closure element to which the hooks are attached. By again providing upper hooks 200A', 202A' at sharp angles, the upper hook 200A' of the first closure element 200' aggressively mates or engages with the upper hook 202A' of the second closure element 202'. The aggressive mating of the upper hooks 200A', 202A' to each other causes the upper hooks 200A', 202A' to stick together when an external opening force is applied to the upper hooks 200A', 202A', i.e., when a user tries to pull open the opening 103' of the bag 100' along the top edge 116'. As in the embodiment of FIG. 3B, the lower hooks 200B', 202B' of FIG. 21 are configured to have less aggressive or sharp hooking angles (e.g., $\theta_C$, $\theta_D$, respectively, of FIG. 3B) to provide for easier internal opening (e.g., opening between the zipper profiles) of the closure elements 200', 202' via a slider, since a lower internal opening force between the zipper profiles will be needed to open these hooks 200B', 202B'. For example, the lower hooks 200B', 202B' are preferably at an angle of 90 degrees to 180 degrees, or more preferably, at an angle of 100 degrees to 180 degrees, or most preferably, at an angle of 110 degrees to 180 degrees, with respect to the portion of the closure element to which the hooks are attached. Thus, the lower hook 200B' of the first closure element 200' weakly mates or engages with the lower hook 202B' of the second closure element 202'. Alternatively, if desired, the lower hook 202B' of the second closure element 202' and/or the lower hook 200B' of the first closure element 200' could be partially or completely removed.

With respect to the closure elements of the lower zipper profile 114' of FIG. 21, the third closure element 204' includes a lower hook 204B' that is substantially the same as the lower hook 204B of the embodiment shown in FIG. 3C, along with a non-hook portion 204A', while the fourth closure element 206' includes both an upper hook 206A' and a lower hook 206B' that are substantially the same as those of the embodiment shown in FIG. 3C. In contrast to the closure elements of the upper zipper profile 112', the non-hook portion 204A' of the third closure element 204', and the upper hook 206A' of the fourth closure element 206' are configured to have less aggressive or sharp hooking angles to provide for an easier opening via a slider (e.g., $\theta_E$, $\theta_F$, respectively, of FIG. 3C). For example, the non-hook portion 204A' is formed without hook or a hook has been completely removed, while the upper hook 206A' is preferably at an angle of 90 degrees to 180 degrees, or more preferably, at an angle of 100 degrees to 180 degrees, or most preferably, at an angle of 110 degrees to 180 degrees, with respect to the portion of the closure element to which the hook is attached. Thus, the non-hook portion 204A' of the third closure element 204' weakly mates or engages with the upper hook 206A' of the fourth closure element 206'. Alternatively, if desired, the upper hook 206A' of the fourth closure element 206' could be partially or completely removed. The lower hooks 204B', 206B', however, of the lower closure element 114' of FIG. 21 are configured to have aggressive hooking angles (e.g., $\theta_G$, $\theta_H$, respectively, of FIG. 3C) in order to provide for a high internal burst strength, as in the embodiment of FIG. 3C. As discussed above, an aggressive hooking angle means that the hooks are formed at sharp angles, such that the hooks are, for example, at an acute angle with respect to the portion of the closure element to which the hook is attached. The lower hooks 204B', 206B' are preferably at an angle of 30 degrees to 90 degrees, or more preferably, at an angle of 40 degrees to 90 degrees, 50 degrees to 90 degrees, or 50 degrees to 85 degrees, or most preferably, at an angle of 60 degrees to 80 degrees, with respect to the portion of the closure element to which the hooks are attached. By providing lower hooks 204B', 206B' at sharp angles, the lower hook 204B' of the third closure element 204' aggressively mates or engages with the lower hook 206B' of the fourth closure element 206.' The aggressive mating of the lower hooks 204B', 206B' to each other causes the lower hooks 204B', 206B' to stick together when an opening force is applied to the lower hooks 204B', 206B', i.e., when contents in the bag 100' pull down on or push apart the sidewalls 102', 104' of the bag 100', and thus, apply an opening force to the lower hooks 204B', 206B'.

As in the embodiment of FIGS. 3A-3C, the upper hooks 200A', 202A' of the upper zipper profile 112' of FIG. 21 and the lower hooks 204B', 206B' of the lower zipper profile 114' of FIG. 21 are configured to aggressively mate, and thus, a higher external opening force is necessary to pull open the hooks along the opening 103' of the bag 100', i.e., 200A' and 202A', or to pull open the hooks along the interior of the bag 100', i.e., 204B' and 206B'. A lower internal opening force, however, is needed to open the hooks between the upper zipper profile 112' and lower zipper profile 114' of FIG. 21, since the hooks of the upper zipper profile 112', i.e., 200B' and 202B', and the hook and non-hook portion of the lower zipper profile 114', i.e., 206A' and 204A', are configured to weakly mate Thus, the upper and lower zipper profiles 112', 114' illustrated in FIG. 21, as in the embodiment of FIGS. 3A-3C, will open from the inside-out, meaning, the interior hooks and/or non-hook portion, i.e., 200B', 202B', 206A', and 204A', of the zipper profiles will de-occlude before the exterior hooks 200A', 202A', 204B', and 206B' of the zipper profiles will de-occlude.

In view of the foregoing arrangement of FIG. 21, the upper hooks 200A', 202A' of the upper zipper profile 112' and the lower hooks 204B', 206B' of the lower zipper profile 114' aggressively mate. This, then, requires a higher external opening force or burst strength to open these hooks, thereby providing for a stronger and more leakproof seal along the opening of the bag, as well as along the interior of the bag. Accordingly, a user would be unable to pull apart the opening 103' of the bag 100' without a significant force, and the contents in the bag would be unable to pull apart the lower hooks 204B', 206B' along the interior of the bag without a high burst strength. In contrast, the lower hooks 200B', 202B' of the upper zipper profile 112' and the upper hook 206A' and the non-hook portion 204A' of the lower zipper profile 114' are configured to weakly mate. Thus, a lower internal opening force or burst strength is needed to open these hooks, thereby allowing for a slider with a separator finger to easily de-occlude the interior hooks via the separator finger when a user slides the slider in an opening direction, as will be discussed in more detail below.

Figure 22C:
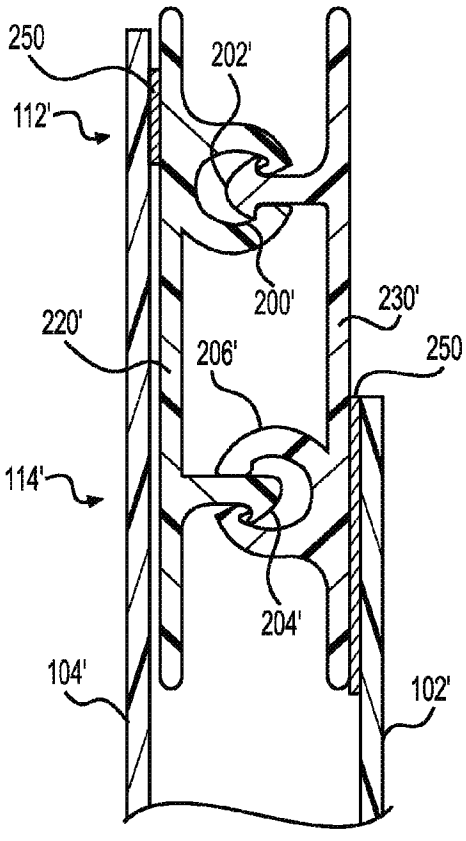
Figure 22B:
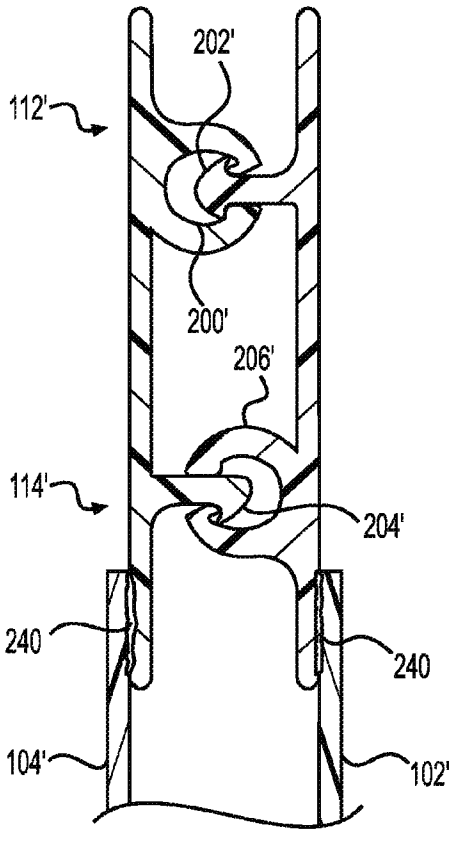
Figure 22A:
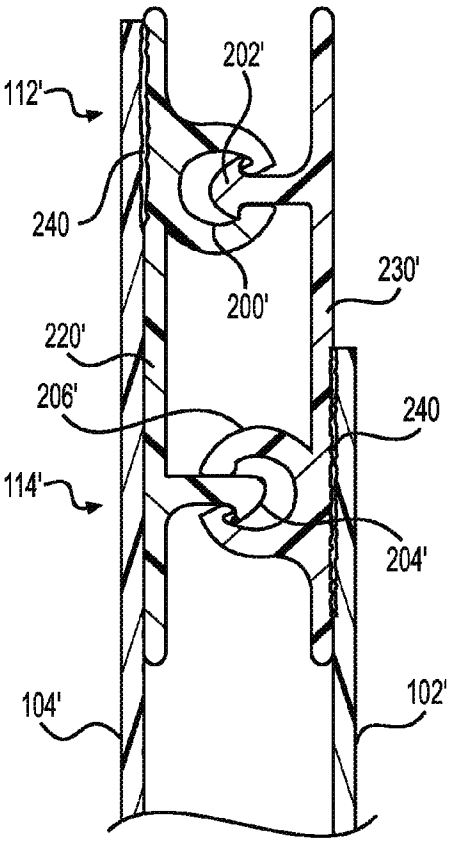
Figure 22F:
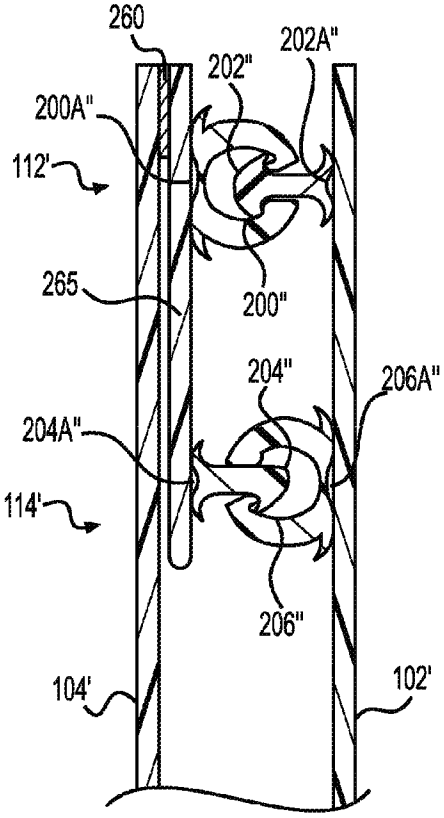
Figure 22E:
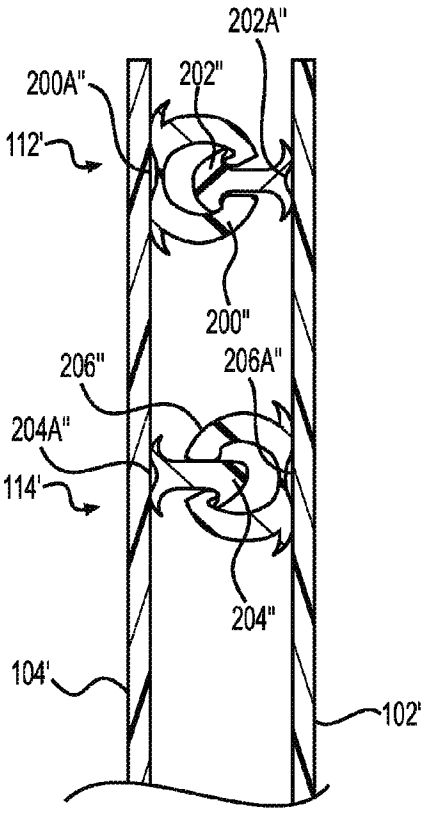
Figure 22D:
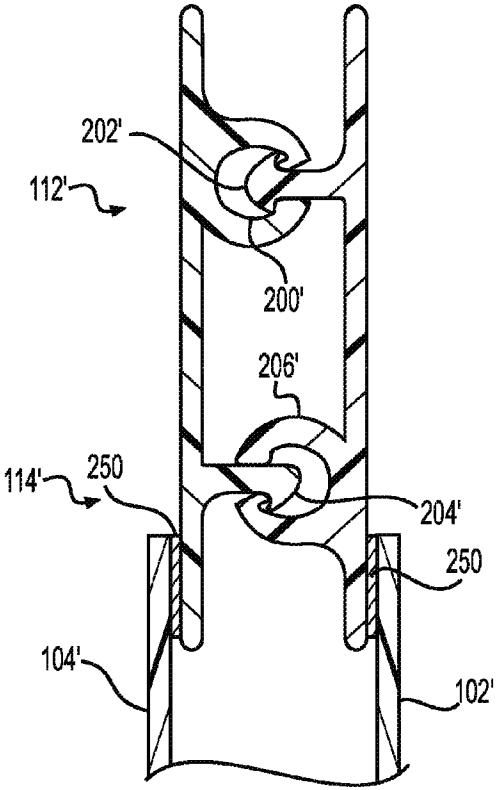

As in the embodiment of FIG. 3A, the backing members 210', 212' can be connected to top edges of the sidewalls 102', 104', respectively, or the backing members 210', 212' can be simply extensions or part of the sidewalls 102', 104'. In this regard, FIGS. 22A-22F illustrate various embodiments for connecting the double zipper profile shown in FIG. 21 to the sidewalls 102', 104' of the bag 100'. Specifically, in FIG. 22A, the sidewall 104' of the bag 100' is connected to at least a portion of the upper zipper profile 112' behind the first closure element 200' with a hot bar lamination 240, while the sidewall 102' of the bag 100' is connected to at least a portion of the lower zipper profile 114' behind the fourth closure element 206' with a hot bar lamination 240. Alternatively, in the embodiment of FIG. 22B, the hot bar lamination 240 is used to connect the sidewalls 102', 104' of the bag 100' to at least a portion of the lower zipper profile 114' below the third and fourth closure elements 204', 206', respectively. In the embodiment of FIG. 22C, the sidewall 104' of the bag 100' is connected to at least a portion of the upper zipper profile 112' behind the first closure element 200' via a connection mechanism 250 (e.g., hot melt glue strip, contact adhesive, or thermal welding) that is disposed between the sidewall 104' and at least a portion of the upper zipper profile 112'. The sidewall 102' of the bag 100' is connected to at least a portion of the lower zipper profile 114' behind the fourth closure element 206' via a connection mechanism 250 (e.g., hot melt glue strip, contact adhesive, or thermal welding) that is disposed between the sidewall 102' and at least a portion of the lower zipper profile 114'. Alternatively, in the embodiment of FIG. 22D, the connection mechanisms 250 are used to connect the sidewalls 102', 104' of the bag 100' to at least a portion of the lower zipper profile 114' that is at or below the third and fourth closure elements 204', 206', respectively. The specific shape and configuration of the first connection mechanism 250 of FIGS. 22C and 22D, however, can be altered without departing from the spirit of the invention and can include any other type of connection mechanism feasible to connect the zipper profile(s) to the sidewalls, including, for example, a hot melt glue strip, contact adhesive, thermal welding, etc. In the embodiments of FIGS. 22E and 22F, the upper and lower zipper profiles 112', 114' include a first closure element 200", a second closure element 202", a third closure element 204", and a fourth closure element 206" that are flangeless, i.e., not attached to backing strips (e.g., 210', 212'). In this regard, the first closure element 200" includes a base member 200A", the second closure element 202" includes a base member 202A", the third closure element 204" includes a base member 204A", and the fourth closure element 206" includes a base member 206A". In the embodiment of FIG. 22E, the base member 200A" of the first closure element 200" and the base member 202A" of the second closure element 202" of the upper zipper profile 112', as well as the base member 204A" of the third closure element 204" and the base member 206A" of the fourth closure element 206" of the lower zipper profile 114' are directly attached to the sidewalls 102', 104' of the bag 100'. Accordingly, no connection mechanisms or lamination is required in the embodiment of FIG. 22E. In the embodiment of FIG. 22F, the base member 202A" of the second closure element 202" of the upper zipper profile 112' and the base member 206A" of the fourth closure element 206" of the lower zipper profile 114' are directly attached to the sidewall 102' of the bag 100', as in the embodiment of FIG. 22E. However, the base member 200A" of the first closure element 200" of the upper zipper profile 112' and the base member 204A" of the third closure element 204" of the lower zipper profile 114' are directly attached to a film layer 265 that is attached to the sidewall 104' of the bag 100' via a connection mechanism 260 (e.g., hot melt glue strip, contact adhesive, or thermal welding) that is disposed between the sidewall 104' and at least a portion of the film layer 265. The film layer 265 is either an additional film layer that is prepared to attach the profiles to the sidewall 104' of the bag 100' or is a portion of the sidewall 104' that has been completely or partially detached from the remainder of the sidewall 104'. Alternatively, the film layer 265 can comprise a portion of the sidewall 104' that has been folded over the top edge 116' of the bag 100'. In the embodiments of FIGS. 22A-22F, an extended backing strip (e.g., 210', 212') below the lower zipper profile 114' is not required to attach the upper and lower zipper profiles 112', 114' to the sidewalls 102', 104' of the bag 100'. In addition, in the embodiments of FIGS. 22E and 22F, a backing strip of any type is not required to attach the upper and lower zipper profiles 112', 114' to the sidewalls 102', 104' of the bag 100'. However, in each of these embodiments, a means of attaching the zipper profiles 112', 114' to the sidewalls 102', 104' of the bag 100' is provided that provides greater seal strength, while reducing the amount of material (e.g., plastic) necessary to create the zipper profiles 112', 114'. For example, a seal strength can be provided that allows for the various burst strengths discussed above.

FIG. 23 illustrates an embodiment of a slider 120' that can be placed onto the bag 100' of FIGS. 19 and 20. In this embodiment, the slider 120' includes first and second opposing faces 402', 404' extending from a top wall 401' defining a channel therebetween in which a double zipper, such as the zipper profiles of FIG. 21, can be operatively accepted. The first opposing face 402' includes an arcuate portion 403' that is filled-in with a material forming the slider. The second opposing face 404' also includes a similar arcuate portion that is not shown in FIG. 23. Although the arcuate portion 403' is filled-in in the embodiment shown in FIG. 23, the arcuate portion 403' could alternatively be hollow or partially filled-in. In addition, the arcuate portion 403' can be an ellipse or have an oval shape, as shown in, for example, FIG. 23. However, the arcuate portion 403' could be of a different shape, such as, for example, a circular, rectangular, or square shape, or any other polygonal shape, etc., since the specific shape and configuration of the opposing faces and/or arcuate portions can be altered without departing from the spirit of the invention.

As shown in FIGS. 23 and 24, the slider 120' includes a support member 410' that extends from the top wall 401' into the channel spaced between the first and second opposing faces 402', 404'. The support member 410' includes a second zipper profile opening member 426 at a distal end of the support member 410'. The second zipper profile opening member 426 includes a first shoulder member 426A and a second shoulder member 426B (not shown) that extend orthogonally to the direction of slider travel along the zipper profiles. The first and second shoulder members 426A, 426B preferably comprise arcuate members that extend toward the third and fourth closure elements 204', 206', respectively. The first and second shoulder members 426A, 426B of the second zipper profile opening member 426 enables the distal end of the support member 410' to reach the width necessary to de-occlude the third and fourth closure elements 204', 206' via a wedging action. In this embodiment, the second zipper profile opening member 426 preferably has a width (i.e., from edge of first shoulder member 426A to edge of second shoulder member 426B) of about 40 mils to about 160 mils and more preferably, of about 70 mils to about 128 mils in order to effectively de-occlude the closure elements of a lower zipper profile with the thickness described above, as well as the center-to-center spacing from the upper zipper profile as described above. As shown in FIGS. 24 and 25, the support member 410' also includes a retention member 428A that assists in retaining the slider on the zipper profiles, such that a user cannot easily pull the slider vertically off of the bag. The support member 410' preferably includes a similar retention member (e.g., 428B) on the opposing side to the retention member 428A, which is not shown in FIGS. 24 and 25.

As shown in FIGS. 24 and 25, the slider 120' also includes a first zipper profile opening member 427 that extends from the top wall 401' of the slider 120'. The first zipper profile opening member 427 extends vertically down from the top wall 401' of the slider 120', and an extension member 427A is attached to the first zipper profile opening member 427 and extends parallel to the direction of slider travel. The first zipper profile opening member 427 is configured to open only the first and second closure elements 200', 202' by a wedging action. The extension member 427A is disposed in the area between the upper zipper profile 112' and the lower zipper profile 114' (see, e.g., FIG. 25), such that the extension member 427A is configured to act as a retention means. The extension member 427A also includes a retention member 429, such that the retention member 429, as well as the extension member 427A itself, assist in retaining the slider on the zipper profiles, so that a user cannot easily pull the slider vertically off of the bag. The extension member 427A preferably includes a similar retention member on the opposing side to the retention member 429, which is not shown in FIGS. 24 and 25. As discussed above, the retention member(s) 428A of the support member 410', as well as the extension member 427A and the retention member(s) 429 of the extension member 427A, assist in retaining the slider on the zipper profiles. With respect to the slider 120' of FIGS. 23-25, the first zipper profile opening member 427 is directly attached to the top wall 401' of the slider 210', while the second zipper profile opening member 426 is attached to the support member 410', which in turn is attached to the top wall 401' of the slider 120', such that the slider 120' is composed of two distinct members or separator fingers, namely, the first zipper profile opening member 427 and the support member 410' with the second zipper profile opening member 426. Alternatively, both the first zipper profile opening member 427 and the second zipper profile opening member 426 can each be attached to the support member 410' to create a unitary separator finger or separating mechanism that is composed of a single member. In addition, while the embodiment of the slider 120' of FIGS. 23-25 illustrates the support member 410' and the second zipper profile opening member 426 extending to an area outside of the first and second opposing faces 402', 404', the support member 410' and the second zipper profile opening member 426, can alternatively be positioned entirely within the first and second opposing faces 402', 404' of the slider 120'.

FIGS. 25 and 26 illustrate an embodiment of the slider 120', the support member 410', the first zipper profile opening member 427, and the second zipper profile opening member 426, shown in FIGS. 23 and 24, operatively engaged on the double zipper profile shown in FIG. 21. As shown in FIG. 25, the slider 120' is disposed on the bag 100' and maintains a straddling relation with the upper and lower zipper profiles 112', 114', such that at least the second zipper profile opening member 426 is disposed in the area between the upper zipper profile 112' and the lower zipper profile 114'. In the embodiment of FIG. 25, the first opposing face 404' of the slider 120' has been removed in order to clearly show the positions of the support member 410', the first zipper profile opening member 427, and the second zipper profile opening member 426 on the bag 100'. As shown in FIG. 26, the first and second closure elements 200', 202' of the upper zipper profile are disposed underneath the top wall 401' of the slider 120'. The support member 410', which extends from the top wall 401' of the slider 120', is disposed between the first and second closure elements 200', 202' of the upper zipper profile 112' and the third and fourth closure elements 204', 206' of the lower zipper profile 114'. In particular, the second zipper profile opening member 426 of the support member 410' is disposed in the area between the first and second closure elements 200', 202' of the upper zipper profile 112' and the third and fourth closure elements 204', 206' of the lower zipper profile 114, namely, the second zipper profile opening member 426 is disposed between the first and second isolation sections 220', 230'. By positioning the second zipper profile opening member 426 in such a manner, the first shoulder member 426A and the second shoulder member 426B of the second zipper profile opening member 426 will interact with the third and fourth closure elements 204', 206' of the lower zipper profile by pressing on portions of the first and second isolation sections 220', 230'. The support member 410' and the second zipper profile opening member 426, however, do not extend to a point between or below the third and fourth closure elements 204', 206' of the lower zipper profile. The slider 120' can further include L-shaped shoulders 450', 460' that extend underneath the lower zipper profile, in order to maintain the slider 120' in straddling relation with the zipper profiles. The first opposing face 402' of the slider 120' extends from the top wall 401' to a first bottom portion 430', while the second opposing face 404' of the slider 120' extends from the top wall 401' to a second bottom portion 440'. The L-shaped shoulders 450', 460' are attached to the first and second bottom portions 430', 440', respectively.

Referring to FIGS. 25 and 26, when the slider 120' operatively moves, such as by being slid by a user, along the zipper profiles in an occluding direction, i.e., from right to left in FIG. 25, a first closure bar 470' and a second closure bar 480' occlude the first and second closure elements 200', 202', respectively. The L-shaped shoulders 450', 460' assist in occluding the third and fourth closure elements 204', 206'. When the slider 120' operatively moves in a de-occluding direction, i.e., from left to right in FIG. 25, the first zipper profile opening member 427 de-occludes the first and second closure elements 200', 202' of the upper zipper profile 112' by extending therebetween and wedging the first and second closure elements 200', 202' apart. The extension member 427A and retention member(s) 429, however, which are included to assist in retaining the slider on the zipper profiles, are configured to not interact with or de-occlude the closure elements of the upper or lower zipper profiles 112' 114'. Thereafter, the first and second shoulder members 426A, 426B of the second zipper profile opening member 426, which trail behind the first zipper profile opening member 427 in the de-occluding direction, de-occlude the third and fourth closure elements 204', 206' of the lower zipper profile 112', by pressing outwardly against portions of the first and second isolation sections 220', 230', which forces the third and fourth closure elements 204', 206' apart. As discussed above, the first and second shoulder members 426A, 426B of the second zipper profile opening member 426 enables the distal end of the support member 410' to reach the width necessary to de-occlude the third and fourth closure elements 204', 206' via a wedging action. Moreover, as the first and second shoulder members 426A, 426B of the second zipper profile opening member 426 press outwardly against portions of the first and second isolation sections 220', 230', the non-hook portion 204A' of the third closure element 204' de-occludes from the upper hook 206A' of the fourth closure element 206' due to the configuration of the engagement between the non-hook portion 204A' of the third closure element 204' and the upper hook 206A' of the fourth closure element 206' (see, e.g., FIG. 21). The retention members 428A, 428B (not shown), however, which are included on the support member 410' to assist in retaining the slider on the zipper profiles, are configured to not interact with or de-occlude the closure elements of the upper or lower zipper profiles 112' 114'.

FIG. 27 shows an embodiment of the slider 120' shown in FIGS. 23-25 being operatively engaged on the bag 100' shown in FIG. 19. As illustrated in FIG. 27, the slider 120' maintains a straddling relation with the upper and lower zipper profiles 112', 114', such that at least the second zipper profile opening member 426 of the support member 410' is disposed in the area (e.g., isolation section) between the upper zipper profile 112' and the lower zipper profile 114'. In the embodiment shown in FIG. 27, a detent 500' is included at one end of the bag in the isolation section 220' (see, e.g., FIG. 28) between the upper and lower zipper profiles 112', 114'. The detent 500' comprises an indentation that is capable of engaging with at least one of the first and second shoulder members 426A, 426B of the second zipper profile opening member 426. The engagement of at least one of the first and second shoulder members 426A, 426B of the second zipper profile opening member 426 with the detent 500' ensures that the second zipper profile opening member 426 is not positioned in the isolation section between the upper and lower zipper profiles 112', 114', in such a manner that the support member 410' and the second zipper profile opening member 426 de-occludes the lower zipper profile 114' at the end of the bag 100'. Accordingly, the engagement of at least one of the first and second shoulder members 426A, 426B of the second zipper profile opening member 426 with the detent 500' can provide an end seal that prevents leakage, by ensuring that at least the lower zipper profile 114' is completely occluded along the length of the bag. The detent 500' must therefore, be positioned a predetermined distance from at least the lower zipper profile 114' to ensure an accurate engagement with the at least one of the first and second shoulder members 426A, 426B of the second zipper profile opening member 426. In one embodiment, the detent 500' is disposed in a position that is between at least about 60 mils and about 187.5 mils from the lower zipper profile 114'. Moreover, in another embodiment, the detent 500' must be within 400 mils of the edge (e.g., 106') of the bag 100' to ensure proper occlusion of at least the lower zipper profile 114' at the end of the bag 100'. The engagement of at least one of the first and second shoulder members 426A, 426B of the second zipper profile opening member 426 with the detent 500' can also provide a tactile sensation to a user and/or an audible click, thus assuring the user that the bag is sealed closed. By further tapering the structure of the first and second shoulder members 426A, 426B of the second zipper profile opening member 426, such that the first and second shoulder members 426A, 426B are thinner near the bottom of the indentation and thicker at the top of the indention, the structural integrity of the second zipper profile opening member 426 is maintained, while providing a maximum audio/haptic experience to a user via the engagement of at least one of the first and second shoulder members 426A, 426B of the second zipper profile opening member 426 with the detent 500'. Although this embodiment has a detent 500' on only one end of the bag, the invention also encompasses detents on either one or both ends of the bag.

FIG. 28 is an enlarged partial cross-sectional view of the detent 500' included on the bag shown in FIG. 27. As shown in FIG. 28, the detent 500' is disposed on the first isolation section 220' between the first closure element 200' of the upper zipper profile and the third closure element 204' of the lower zipper profile of the double zipper profile illustrated in FIG. 21. By way of example, the detent 500' can be formed into the first isolation section 220' of the double zipper profile using a punch and die assembly. Alternatively, the detent 500' can be formed by cutting, cold stomping, ultrasonic stomping, molding, or any other method for deforming thermoplastic material.

FIG. 29 shows another embodiment of the slider 120' shown in FIGS. 23-25 being operatively engaged on the bag 100' shown in FIG. 19. As illustrated in FIG. 29, a plurality of detents 501', 502' is included on both ends of the bag 100' in the area (e.g., isolation section) between the upper and lower zipper profiles 112', 114'. The detents 501', 502' comprise indentations that are capable of engaging with at least one of the first and second shoulder members 426A, 426B of the second zipper profile opening member 426. In addition, the detents 501', 502' can provide a holding spot for a user when the user is sliding the slider 120' in either direction on the zipper profiles of the bag 100'. In particular, the detents 501', 502' can be provided with various convexities, such that one of the detents in the plurality of detents 501' is of a convexity that engages with at least one of the first and second shoulder members 426A, 426B of the second zipper profile opening member 426. The other detents of the plurality of detents 501', 502', however, can be of the opposite convexity, such that these detents do not engage with the first and second shoulder members 426A, 426B of the second zipper profile opening member 426, but do provide a holding spot for a user when sliding the slider 120' on the bag 100'. As discussed above, the engagement of at least one of the first and second shoulder members 426A, 426B of the second zipper profile opening member 426 with one of the detents in the plurality of detents 501' can provide an end seal, as well as a tactile sensation to a user and/or an audible click, thus assuring the user that the bag is sealed closed. Although this embodiment has three detents 501', 502' on both ends of the bag, the invention also encompasses any number of detents on either one or both ends of the bag. As discussed above, the detents 501', 502' can be formed using a punch and die assembly. Alternatively, the detents 501', 502' can be formed by cutting, ultrasonic stomping, molding, or any other method for deforming thermoplastic material.

While FIGS. 27-29 illustrate an embodiment with at least one detent 500' at one end of a bag 100', the bag 100' is further shown without any end stomps at the edges or sidewelds of the bag 100'. The sideweld encompasses the areas at the edges of the bag where the sidewalls of the bag, as well as the zipper profiles, are sealed. In one embodiment, the zipper profile(s) will be closed or sealed within 0.16 mils from the edges or ends of the bag 100'. In another embodiment, the sideweld of at least the upper zipper profile 112' results in a sealed zipper profile with a thickness of about 45 mils to about 72 mils, preferably, about 52 mils to about 58 mils, and, most preferably, a thickness of about 56 mils. In this embodiment, the sideweld of the area between the upper and lower zipper profiles 112', 114' (e.g., the isolation section(s) 220', 230') results in a sealed area between the profiles that has a thickness of about 4 mils to about 28 mils, preferably, about 12 mils to about 24 mils, and, more preferably, about 18 mils to about 22 mils. These sidewelds provide an area that both the second zipper profile opening member 426 of the support member 410' and the extension member 427A (see, e.g., FIG. 25) can run into, or become entrapped by, at either the closing end or opening end of the bag, respectively, such that the slider 120' will not fall off of the ends of the bag 100'. Accordingly, the sidewelds provide for axial slider retention without requiring an end stomp or end stop on the bag 100'. In particular, the axial slider retention is provided due to at least the sealing of the upper zipper profile 112' at the edges of the bag 100' by, for example, thermal welding. In one embodiment, such a configuration of the sidewelds, including the thicknesses discussed above, as well as the slider 120' with the second zipper profile opening member 426, the support member 410', and the extension member 427A, provides for an axial slider retention force of about 4 $lb_f$ to about 18 $lb_f$.

FIG. 30 shows another embodiment of a bag 4000 comprising a double zipper profile according to the invention. The partial side view of the bag 4000 illustrated in FIG. 30 includes a first sidewall 4002, as well as an upper zipper profile 4006 and a lower zipper profile 4008 attached to an upper end of the sidewall 4002. A slider 4020 is operatively engaged on the bag 4000 in a straddling relation with the upper and lower zipper profiles 4006, 4008. The slider 4020 includes a separator finger 4022 that rides along a region 4010 defined between the upper zipper profile 4006 and the lower zipper profile 4008. The bag 4020 can further include an end-stop 4005 that is disposed on at least one end of the upper zipper profile 4006 in order to prevent the slider 4020 from coming off of the end of the zipper profiles. In the embodiment illustrated in FIG. 30, the closure elements (not shown) of the upper zipper profile 4006 are configured to provide an audible sound and/or haptic or tactile sensation when engaging each other. The closure elements (not shown) of the lower zipper profile 4008, however, are not configured to provide an audible sound and/or tactile sensation when engaging each other. Accordingly, the lower zipper profile 4008 will be unaltered and thus can be dedicated as a leak resistant seal, while the upper zipper profile 4006 will be altered, as discussed in more detail below, and thus can be dedicated as the audio/haptic feedback profile. Such a configuration of providing closure elements of an upper zipper profile that are configured to provide an audible sound and/or haptic or tactile sensation when engaging each other can be utilized with any of the embodiments of the double zipper profiles and/or sliders described above.

A variety of techniques is known for providing such audible and tactile features, with one example being the provision of indentations intermittently along the length of the profiles of the closure elements, or, more generally, making the closure elements discontinuous along their lengths. FIGS. 31A through 31D illustrate three embodiments of indentations or structural discontinuities that can be used to provide the audible and/or tactile features to the upper zipper profile 4006 shown in FIG. 30, as well as to the various zipper profiles depicted in FIGS. 3A-3E, 7A-8B, 15A, and 21. FIG. 31A displays a closure element 5000 of a zipper profile that has not been deformed, and thus will not provide any type of audible or tactile feature when engaging with an opposing closure element of the zipper profile. FIG. 31B displays a closure element 5010 of a zipper profile that has been partially deformed by providing one-sided indentations 5011 intermittently along the length of the closure element 5010. In particular, the closure element 5010 includes a one-sided deformation or indentation 5011 provided adjacent to a non-deformed portion 5012 of the closure element 5010. FIG. 31C displays a closure element 5020 of a zipper profile that has been partially deformed by providing indentations 5021 intermittently along the length of the closure element 5020. In particular, the closure element 5020 includes a deformation or indentation 5021 provided adjacent to a non-deformed portion 5022 of the closure element 5020, such that the deformation or indentation 5021 comprises a portion of the closure element 5020 that is flattened or pressed inwardly and upwardly. FIG. 31D displays a closure element 5030 of a zipper profile that has been partially deformed by providing two-sided indentations 5031 intermittently along the length of the closure element 5030. In particular, the closure element 5030 includes a two-sided deformation or indentation 5031 provided adjacent to a non-deformed portion 5032 of the closure element 5030. The deformations or intermittent indentations cause the closure elements of the zipper profile to close together with a vibratory or bumpy feel, or with an audible clicking sound, or with both a bumpy feel and an audible clicking sound, as the slider travels along the closure elements of the zipper profile(s). The two-sided deformations or indentations 5031 shown in FIG. 31D, however, will likely provide a much larger audio/haptic feedback compared to the one-sided deformations or indentations 5011 shown in FIG. 31B or the deformations or indentations 5021 of FIG. 31C. An example of providing closure elements of a bag with audible or tactile features can be found in U.S. Pat. No. 5,140,727, the disclosure of which is incorporated by reference herein in its entirety. Although the embodiments discussed above provide audible and/or tactile features as indentations that are disposed intermittently along the length of the profiles of the closure elements, the indentations can also be provided to portions of the backing strips 210, 212, 210', and 212' that are above, below, behind, and/or between the closure elements of the closure profiles.

FIG. 32 illustrates another embodiment for providing audible and/or tactile features to an upper zipper profile of a double zipper profile according to the invention. Specifically, FIG. 32 illustrates the bag 100 shown in FIG. 1, with the slider 2000 shown in FIG. 18A operatively engaged on the bag 100 and in a straddling relation with the upper and lower zipper profiles 112, 114 of the bag 100. The upper zipper profile 112 shown in FIG. 32, however, has been altered or deformed by, for example, a directional saw tooth, to provide intermittent deformations 6000 along the length of the upper zipper profile 112. The deformations 6000 of the upper zipper profile 112 will provide an audible and/or tactile feature when the slider 2000 travels along the upper zipper profile 112. In particular, the slider 2000 can include, for example, a flapper member (not shown) that extends from a top wall of the slider 2000 and engages with the deformations 6000 of the upper zipper profile 112 as the slider moves from one end of the upper zipper profile 112 to the other end. The configuration of a flapper member or other element(s) in the slider 2000, as well as the specific shape and/or configuration of the deformations, can be altered in order to provide for the desired audio/haptic feedback without departing from the spirit of the invention. The configuration of the deformations 6000 of the upper zipper profile 112 of FIG. 32 can also be provided to the upper zipper profile 112' of the bag 100' of the FIG. 19.

FIG. 33 illustrates another embodiment for providing audible and/or tactile features to a double zipper profile according to the invention. Specifically, FIG. 33 illustrates the bag 100 and the slider 120 shown in FIG. 1, with the slider 120 operatively engaged on the bag 100 and in a straddling relation with the upper and lower zipper profiles 112, 114 of the bag 100. The area between the upper zipper profile 112 and the lower zipper profile 114 shown in FIG. 33, however, has been altered or deformed by, for example, a deformation wheel, knives, or a bar using heat and/or pressure, to provide a plurality of indentations 7000A, 7000B, 8000A, and 8000B along the lengths of the upper and lower zipper profiles 112, 114. The indentations 7000A, 7000B, 8000A, and 8000B will provide an audible and/or tactile feature when the slider 120 travels along the upper and lower zipper profiles 112, 114. In particular, the indentations 7000A, 7000B, 8000A, and 8000B comprise, for example, vertically oriented grooves or slits that interact with portions of the slider 120 to provide audible and/or tactile feedback, such as sound or vibrations, to a user when the slider 120 is moved along the double zipper profile. Although the indentations 7000A, 7000B, 8000A, and 8000B are shown as vertically oriented grooves or slits in FIG. 33, the indentations 7000A, 7000B, 8000A, and 8000B can also comprise, for example, dimples, ribs, bumps, protrusions, ridges, or grooves, and can further comprise any shape that will provide an audible and/or tactile feedback, such as, for example, arcuate, rectangular, or v-shaped, diagonal, horizontal, circular, etc.

In the embodiment of FIG. 33, the indentations 7000A are spaced apart from each other, along the length of the double zipper profile, at a regularly repeating interval or pattern, while indentations 7000B are also spaced apart from each other, along the length of the double zipper profile, at a regularly repeating interval. The spacing of the indentations 7000A from each other may be the same or different as the spacing of the indentions 7000B from each other. For example, indentations 7000A comprise a first series of regularly spaced indentations, while indentations 7000B comprise a second series of regularly spaced indentations. The indentations 7000A, however, are spaced apart from each other at a distance that differs from the distance that the indentations 7000B are spaced apart from each other. With such a configuration, the indentations 7000A will produce a first sound at a first frequency as the slider 120 interacts with the indentations 7000A, while the indentations 7000B will produce a second sound at a second frequency as the slider 120 interacts with the indentations 7000B. Similarly, indentations 8000A comprise a first series of regularly spaced indentations, while indentations 8000B comprise a second series of regularly spaced indentations. As with the indentations 7000A and 7000B, the spacing of the indentations 8000A from each other may be the same or different as the spacing of the indentions 8000B from each other. In the embodiment of FIG. 33, the indentations 8000A are spaced apart from each other at a distance that differs from the distance that the indentations 8000B are spaced apart from each other. Accordingly, as discussed above, the indentations 8000A will produce a first sound at a first frequency as the slider 120 interacts with the indentations 8000A, while the indentations 8000B will produce a second sound at a second frequency as the slider 120 interacts with the indentations 8000B. The sounds or frequencies produced by each of the indentations 7000A, 7000B, 8000A, and 8000B may be the same or different from each other. Moreover, the spacing of each of the indentations 7000A, 7000B, 8000A, and 8000B, along the length of the double zipper profile, may be the same or different from each other. While the embodiment of FIG. 33 illustrates a first series of regularly spaced indentations (7000A, 8000A) and second series of regularly spaced indentations (7000B, 8000B) on each side of the double zipper profile, only a single series of regularly spaced indentations can be provided on one or both sides of the double zipper profile, or more than two series of regularly spaced indentations can be provided on one or both sides of the double zipper profile.

In addition, in the embodiment of FIG. 33, the indentations 7000A and 7000B are provided on an exterior surface of the double zipper profile, in the area between the upper and lower zipper profiles 112, 114, while the indentations 8000A and 8000B are provided on an interior surface of the double zipper profile, in the area (e.g., isolation section) between the upper and lower zipper profiles 112, 114. The indentations 7000A, 7000B, 8000A, and 8000B, however, can be provided on either one or both of the exterior surface and the interior surface of the double zipper profile, or any combination thereof. Alternatively, the indentations 7000A, 7000B, 8000A, and 8000B can be provided on only the exterior surface and/or the interior surface of one side of the double zipper profile. Furthermore, the specific shape and/or configuration of the indentations can be altered in order to provide for the desired audio/haptic feedback without departing from the spirit of the invention. For example, the indentations can comprise slits, dimples, ribs, bumps, protrusions, ridges, or grooves, and can further comprise any shape that will provide an audible and/or tactile feedback, such as, for example, arcuate, rectangular, or v-shaped, diagonal, horizontal, circular, etc. The configuration of the indentations 7000A, 7000B, 8000A, and 8000B of the bag 100 of FIG. 33 can also be provided to the bag 100' of the FIG. 19. Moreover, any combination of the deformations or indentations provided to the zipper profiles themselves, e.g., 5011, 5021, and 5031 of the embodiments of FIGS. 31B-31D, as well as to the areas between the zipper profiles, e.g., indentations 7000A, 7000B, 8000A, and 8000B of the embodiment of FIG. 33, can be provided to the bag 100, 100' in order to achieve the desired audio/haptic feedback.

Illustrative thermoplastic materials that could be used to form the various bags discussed above include, for example, polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Still other materials that may be used include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols. Those skilled in the art will recognize that a wide variety of other materials may also be used to form the bags.

The upper and lower zipper profiles of the various embodiments discussed above may each be formed of thermoplastic, such as low density polyethylene (LDPE), high density polyethylene (HDPE), linear low density polyethylene (LLDPE), and combinations thereof. In one embodiment, for example, the backing members can be formed of a mixture of HDPE, LDPE, and LLDPE to be more rigid, and the closure elements and/or rib members are formed of LDPE to be suppler. The upper and lower zipper profiles may be disposed on a bag 100, 100' such as by laminating at least a portion of the backing members to the sidewalls 102, 104, 102', 104', respectively, of the bag 100, 100'. Alternatively, the portion of the backing members extending beneath the lower zipper profile 114, 114' can be omitted (see, e.g., FIGS. 3D, 3E, and 22A-22F), such that the portion of the backing members between the upper and lower zipper profiles (e.g., in the isolation sections) is disposed on the bag 100, 100' such as by laminating the backing members to the sidewalls 102, 104, 102', 104', respectively, of the bag 100, 100'.

It should be noted that, although the various bags described herein include two pairs of closure elements, other embodiments of the bags can include more than two pairs of closure elements. It should also be noted that the closure elements of the zipper profiles do not necessarily need to fully extend to the edges of the bags. For example, in some embodiments, the bag 100, 100' may include extended sealed sections at the edges 106, 106' and 108, 108' of the bag 100, 100', with the closure elements of the zipper profiles 112, 114, 112', 114' configured to extend only from one sealed section to the other, and not all the way to the edges 106, 106' and 108, 108' of the bag 100, 100'.

Each of the sliders illustrated and described herein may be operatively engaged with a double zipper profile, such as upper zipper profile 112, 112' and lower zipper profile 114, 114'. The sliders are configured such that, during use, a user will need to provide a force, in the range of about 60 grams to about 200 grams, to the slider, to slide the slider along the double zipper profile of the bag 100, 100' and to ensure an effective opening, i.e., de-occluding, of the closure elements of the upper and lower zipper profiles 112, 114, 112', 114'. The sliders may be made in multiple parts and welded together, or the parts may be constructed to be snapped together either with or without hinged elements. The sliders may also be of one piece construction. The sliders can be made using any desired method, such as, for example, injection molding or any other method. The sliders can be molded from any suitable plastic such as, for example, nylon, polypropylene, polystyrene, acetal, toughened acetal, polyketone, polybutylene terephthalate, high density polyethylene, polycarbonate, or acrylonitrile butadiene styrene (ABS). The sliders can be clear, opaque, or colored. Furthermore, it is contemplated that parts and features of any one of the specific embodiments of the various sliders can be interchanged with parts and features of any other embodiments without departing from the spirit of the invention.

Although this invention has been described with respect to certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application, and the equivalents thereof, rather than by the foregoing description.

INDUSTRIAL APPLICABILITY

The closure assemblies described herein provide a beneficial way of sealing and resealing openings of almost any kind, such as by occluding and de-occluding a pouch or a thermoplastic storage bag for storing products therein. The double zipper profile may provide a multiple barrier seal when the opposing closure elements are occluded. The slider may completely seal and unseal the double zipper profile without having any leaks when the slider is at the closed end of the double zipper.

We claim:

1. A storage bag comprising:

(A) a first sidewall;

(B) a second sidewall connected to the first sidewall so as to form an interior of the bag with an opening to the interior;

(C) a first zipper profile positioned adjacent to the opening of the bag, the first zipper profile comprising (i) a first closure element attached to the first sidewall and (ii) a second closure element attached to the second sidewall and extending substantially parallel to the first closure element, the first closure element and the second closure element both extending along the length of the first zipper profile between a first side of the first zipper profile and a second side of the first zipper profile, and the first closure element being configured to interlock with the second closure element to form a seal for the opening of the bag;

(D) a second zipper profile positioned underneath the first zipper profile, the second zipper profile comprising (i) a third closure element attached to the first sidewall and (ii) a fourth closure element attached to the second sidewall and extending substantially parallel to the third closure element, the third closure element and the fourth closure element both extending along the length of the second zipper profile between a first side of the second zipper profile and a second side of the second zipper profile, and the third closure element being configured to interlock with the fourth closure element to form a second seal for the opening of the bag;

(E) a first isolation section positioned between the first closure element and the third closure element, the first isolation section being free from any closure elements, interlocking elements, and non-interlocking elements;

(F) a second isolation section positioned between the second closure element and the fourth closure element, the second isolation section being free from any closure elements, interlocking elements, and non-interlocking elements; and (G) a slider positioned in a straddling relation with the first zipper profile and the second zipper profile, the slider being configured to slide along the first and second zipper profiles (a) to occlude the first and second closure elements of the first zipper profile and the third and fourth closure elements of the second zipper profile when the slider is slid in a first direction, and (b) to de-occlude the first and second closure elements of the first zipper profile and the third and fourth closure elements of the second zipper profile when the slider is slid in a second direction, the slider including:

(a) a top wall;

(b) a first zipper profile opening member that extends directly from the top wall, (ii) is configured to only de-occlude the first and second closure elements of the first zipper profile when the slider is slid in the second direction, and (iii) is attached to an extension member that (1) extends parallel to the second direction, (2) is disposed between the first isolation section and the second isolation section, and (3) is configured to only retain the slider on the bag; and (c) a support member that extends directly from the top wall to a distal end thereof, the support member including (i) a second zipper profile opening member at the distal end thereof, the second zipper profile opening member (1) being disposed between the first isolation section and the second isolation section, (2) including a first shoulder member and a second shoulder member that each extends orthogonally to the second direction, (3) being configured to only de-occlude the third and fourth closure elements of the second zipper profile when the slider is slid in the second direction, by pressing the first shoulder member and the second shoulder member against at least one of the first isolation section and the second isolation section, and (4) being separate and distinct from the first zipper profile opening member, and (ii) at least a first retaining member that is (1) disposed between the first isolation section and the second isolation section, and (2) configured to only retain the slider on the bag.

2. The storage bag according to claim 1, wherein the first closure element and the second closure element each comprises an upper hook and a lower hook, such that the upper hooks of the first and second closure elements are configured with aggressive hooking angles as compared to the lower hooks of the first and second closure elements.

3. The storage bag according to claim 2, wherein the upper hook of the first closure element is at an angle of fifty degrees to ninety degrees with respect to a portion of the first closure element to which the upper hook is attached, and the upper hook of the second closure element is at an angle of forty-five degrees to ninety degrees with respect to a portion of the second closure element to which the upper hook is attached.

4. The storage bag according to claim 2, wherein the lower hook of the first closure element is at an angle of fifty degrees to ninety degrees with respect to a portion of the first closure element to which the lower hook is attached, and the lower hook of the second closure element is at an angle of fifty degrees to one hundred ten degrees with respect to a portion of the second closure element to which the lower hook is attached.

5. The storage bag according to claim 1, wherein the third closure element comprises a non-hook portion and a lower hook, and the fourth closure element comprises an upper hook and a lower hook, such that the lower hooks of the third and fourth closure elements are configured with aggressive hooking angles as compared to the non-hook portion of the third closure element and the upper hook of the fourth closure element.

6. The storage bag according to claim 5, wherein the lower hook of the third closure element is at an angle of thirty-seven degrees to eighty-seven degrees with respect to a portion of the third closure element to which the lower hook is attached, and the lower hook of the fourth closure element is at an angle of fifty degrees to ninety degrees with respect to a portion of the fourth closure element to which the lower hook is attached.

7. The storage bag according to claim 5, wherein the upper hook of the fourth closure element is at an angle of about fifty degrees to about ninety degrees with respect to a portion of the fourth closure element to which the hook is attached.

8. The storage bag according to claim 1, wherein at least one of the first isolation section and the second isolation section has a thickness that is less than the thickness of at least one of (i) the closure elements of the first zipper profile and (ii) the closure elements of the second zipper profile.

9. The storage bag according to claim 1, wherein at least one of the first closure element and the second closure element of the first zipper profile is provided with a plurality of indentations that produces a sound when the first and second closure elements interlock with each other.

10. The storage bag according to claim 9, wherein the plurality of indentations is evenly spaced from each other and provided throughout the length of the first zipper profile.

11. The storage bag according to claim 1, wherein the first zipper profile is provided with a plurality of deformations that produces a sound when the slider is slid along the first zipper profile in at least one of a first direction and a second direction.

12. The storage bag according to claim 1, wherein a plurality of indentations is provided in at least one of an exterior surface and an interior surface of at least one of the first isolation section and the second isolation section, the plurality of indentations being configured to produce a sound when the slider is slid in at least one of the first direction and the second direction.

13. The storage bag according to claim 1, wherein the first shoulder member and the second shoulder member are each disposed between the first isolation section and the second isolation section.

14. The storage bag according to claim 1, wherein the first zipper profile opening member de-occludes the first and second closure elements of the first zipper profile before the second zipper profile opening member de-occludes the third and fourth closure elements of the second zipper profile.

15. The storage bag according to claim 1, wherein the slider further includes at least one closing bar configured to occlude at least one of (i) the first and second closure elements of the first zipper profile and (ii) the third and fourth closure elements of the second zipper profile.

16. The storage bag according to claim 1, wherein the at least a first retaining member engages with at least one of the first and second closure elements of the first zipper profile in order to retain the slider on the bag.

17. The storage bag according to claim 1, wherein the extension member includes at least a second retaining member that engages with at least one of the first and second closure elements of the first zipper profile in order to retain the slider on the bag.

18. The storage bag according to claim 1, wherein at least one of the first zipper profile and the second zipper profile includes at least one end-stop to prevent the slider from falling off of the bag.

19. The storage bag according to claim 1, wherein at least one of the first zipper profile and the second zipper profile is free of an end-stop.

20. The storage bag according to claim 1, further comprising at least one detent positioned between the first zipper profile and the second zipper profile in at least one of the first isolation section and the second isolation section, wherein the second zipper profile opening member is capable of engaging with the detent.

21. The storage bag according to claim 20, wherein the at least one detent is positioned on at least one end of the bag to provide a leak-proof end seal by engaging with the second zipper profile opening member and closing at least the second zipper profile along the length of the bag.

* * * * *